US006783925B1

(12) United States Patent
Yasuda

(10) Patent No.: US 6,783,925 B1
(45) Date of Patent: Aug. 31, 2004

(54) THERMALLY PROCESSED IMAGE FORMING MATERIAL

(75) Inventor: Shoji Yasuda, Minami-Ashigara (JP)

(73) Assignee: Fuji Photo Film Co., LTD, Kanagawa (JP)

( * ) Notice: Subject to any disclaimer, the term of this patent is extended or adjusted under 35 U.S.C. 154(b) by 45 days.

(21) Appl. No.: 09/617,433

(22) Filed: Jul. 14, 2000

(30) Foreign Application Priority Data

Jul. 16, 1999 (JP) ..... 11-203413
Sep. 28, 1999 (JP) ..... 11-273591

(51) Int. Cl.[7] ..... G03C 1/498
(52) U.S. Cl. ..... 430/619; 430/598; 430/613; 430/617; 430/620
(58) Field of Search ..... 430/619, 617, 430/620, 613, 598; 503/201

(56) References Cited

FOREIGN PATENT DOCUMENTS

EP 0887701 A1 12/1998
EP 0921433 A1 6/1999
WO WO 9734196 9/1997

*Primary Examiner*—Thorl Chea
(74) *Attorney, Agent, or Firm*—Birch, Stewart, Kolasch & Birch, LLP

(57) ABSTRACT

A thermally processed image forming material containing elsewhere on a support a reducing agent, a binder and non-photosensitive fatty silver salt grains was disclosed, in which (1) the non-photosensitive fatty acid silver salt grains are prepared by mixing and reacting a silver ion-containing solution, the solvent of which being water or a mixture of water and an organic solvent, with a solution of a fatty acid alkali metal salt, the solvent of which being water, an organic solvent, or a mixture of water and an organic solvent, in a closed mixing means, or (2) the non-photosensitive fatty acid silver salt grains are prepared by micro-dispersing the reaction mixture at an operating pressure of 1,800 kg/cm$^2$ or above using a ultrahigh pressure dispersion apparatus. Such thermally processed image forming material is excellent in the coated surface quality, and can afford an image which is low in fog and high in Dmax (maximum density).

9 Claims, 7 Drawing Sheets

THERMALLY PROCESSED IMAGE FORMING MATERIAL

TECHNICAL FIELD

The present invention relates to a thermally processed image forming material, and more particularly to the material suitable for photographic printing plate making using a scanner or image setter, or for medical purposes, and still more particularly to the material for photographic printing plate making or medical purposes having an excellent coated surface property and being capable of producing images with a low fog and high Dmax (maximum density).

RELATED ART

There are a variety of known photosensitive materials having on a support a photosensitive layer and producing an image by image exposure. Of these, a technique for producing image by heat development is worth a particular mention in that allowing environmental preservation and simplifying the image producing means.

A strong need for reducing the volume of waste process solution has arisen in recent fields of photographic printing plate making or medical diagnosis from viewpoints of environmental preservation and space saving. Thus a technology related to a photothermographic material for photographic printing plate making or medical diagnosis has been desired, the material being such that affording efficient laser exposure and providing a clear black image with high resolution and sharpness. Such photothermographic material can provide the user with a more simple and environment-conscious heat development and processing system using no solution-base process chemical.

The image producing method based on heat development is disclosed, for example, in U.S. Pat. Nos. 3,152,904 and 3,457,075 and "Thermally Processed Silver Systems" written by D. Morgan and B. Shely, Imaging Processes and Materials, Neblette's 8th ed., edited by Sturge, V. Walworth and A. Shepp, Chapter 9, p.279, (1989). Such photosensitive material contains an reducible non-photosensitive silver source (e.g., organic acid silver salt), a catalytic amount of photocatalyst (e.g., silver halide) and a reducing agent for silver, all of which being generally dispersed in an organic binder matrix. While the photosensitive material is stable at the room temperature, it will produce silver through a redox reaction between the reducible silver source (which serves as an oxidizing agent) and the reducing agent when heated to a high temperature (80° C. or above, for example) after light exposure. The redox reaction is promoted by a catalytic action of the latent image produced by the light exposure. That is, the silver generated by the reaction of the reducible silver within the exposed area provides a black spot, which makes a contrast with the non-exposed area and is recognizable as an image.

The silver source employed by such system generally refers to a silver salt of a fatty acid, and a variety of methods for producing thereof have been known. Examples of the methods include such that preparing an organic acid silver salt in a concomitant solution of water and water-insoluble solvent as disclosed for example in JP-A-49-93310 (the code "JP-A" as used herein means an "unexamined published Japanese patent application"), JP-A-49-94619 and JP-A-53-68702; such that preparing an organic acid silver salt in an aqueous solution as disclosed in JP-A-53-31611, JP-A-54-4117 and JP-A-54-46709; and such that preparing an organic acid silver salt in an organic solvent as disclosed in JP-A-57-186745, JP-A-47-9432 and U.S. Pat. No. 3,700,458. In principle, the organic acid silver salt is obtained by dissolving a fatty acid into water under heating to a temperature of the melting point thereof or above, adding sodium hydroxide or an alkali metal salt under vigorous stirring, and further adding silver nitrate to convert an alkali soap into a silver soap.

The alkali soap forms micell in the aqueous solution, which appears as a milky liquid. The conversion reaction from such micellar state to silver salt, however, often suffers from a problem in production stability. Thus as a measure for obtaining a homogeneous solution of alkali soap, use of a mixed solution of water and alcohol as a solvent is disclosed in JP-A-55-40607.

Now the alkali soap shows alkalinity as its name suggests, so that the silver soap is prepared under a high pH environment. Adding silver nitrate to an alkali solution, however, not only produces silver oxide as a by-product but also results in an undesirable production of silver nucleus by an action of a trace amount of contaminant which inevitably generates during the production and exhibits a high reducing activity under such high-pH environment. Such by-product is quite disadvantageous in that degrading property of the thermally processed photographic material, and more specifically in that causing undesirable fog and degrading the coated surface quality. From this viewpoint, a method for obtaining a homogeneous solution to suppress the generation of the by-product is disclosed in JP-A-55-40607, in which fog still remains unsolved.

In JP-A-9-127643, disclosed is a method for producing silver salt based on simultaneous measuring and addition of an alkali metal salt solution and silver nitrate solution, and is specified as simultaneous addition of an aqueous sodium behenate solution and isopropyl alcohol. While the method is successful in at least lowering the high pH during the reaction to the medium range and thereby in suppressing the generation amount of salver oxide, fog still cannot thoroughly be cleared and the coated surface quality still cannot be improved due to a weak reducibility of isopropyl alcohol.

As described above, preparation of fatty acid silver salt needs special accounts such that eliminating as possible reducible substances during the formation of fatty acid silver salt, controlling the grain size and controlling the grain form, where all these requirements cannot be satisfied at a time by the conventional method.

In the conventional production of a thermally processed material using the fatty acid silver salt, a photosensitive layer thereof is often formed by coating a coating liquid containing an organic solvent such as toluene, methyl ethyl ketone or methanol. Using an organic solvent as the solvent, however, is not only disadvantageous in terms of safety in the production processes, adverse effects on human body, and high cost ascribable to the solvent recovery or the like, but is also inappropriate in terms of providing an environment-conscious photothermographic material.

Thus a method for forming, using a water-base coating liquid, the photosensitive layer (also referred as "water-base photosensitive layer"hereinafter) is proposed. For example, JP-A-49-52626 and JP-A-53-116144 disclose cases using gelatin as a binder. In JP-A-50-151138, a case using polyvinyl alcohol as a binder is described.

A case with a combined use of gelatin and polyvinyl alcohol is found in JP-A-60-61747. As another exemplary case, the photosensitive layer using a water-soluble polyvinyl acetal as a binder is described in JP-A-58-28737.

Using a water-soluble binder allows the photosensitive layer to be formed with a water-base coating liquid and is beneficial from environmental and economic viewpoints. The water-soluble polymer binder is, however, less compatible with the fatty acid silver salts, and may interact with the photographic additives other than the organic silver salt, which are usually dissolved or dispersed also in a water-base solvent, to produce an undesirable agglomeration and thereby to make it difficult to obtain a good surface quality.

In order to obtain practically agreeable quality of the coated surface using the water-base coating liquid containing a fatty acid silver salt, the fatty acid silver salt must be kept in a finely dispersed state in the water-base solution without causing agglomeration. Discovery of a method for finely dispersing the fatty acid silver salt is thus desired. One method generally accepted relates to such that producing a hydrophobic grain dispersion of a fatty acid silver salt, separating the grain therefrom by filtration to obtain a solid matter, and re-dispersing the solid matter after being mixed with a dispersing agent as described by D. Kloosterboer in Imaging Processes and materials, Neblette's 8th ed., edited by Sturge, V. Walworth and A. Shepp, p.279, (1989).

Fine dispersion operation of the fatty acid silver salt can be effected by mechanical dispersion in the presence of a dispersing agent using a known pulverizing means (e.g., high-speed mixer, homogenizer, high-speed impact mill, banbury mixer, homomixer, kneader, ball mill, vibration ball mill, epicyclic ball mill, attritor, sand mill, bead mill, colloid mill, jet mill, roller mill, trommel and high-speed stone mill). These methods, however, produce only a coating liquid including a lot of agglomerated grains and are thus causative of degraded surface quality, and, worse than all, tend to indiscriminately cleave the primary grains of the fatty acid silver salt which are originally crystallized as a water-insoluble salt, so that excessive silver nuclei are generated on the crystal cleavage plane of the grains and thereby to increase fog.

On the other hand, JP-B-7-119953 (the code "JP-B" as used herein means an "examined Japanese Patent Publication"), JP-A-8-137044 and JP-A-8-238848 disclose methods such that finely dispersing the fatty acid silver salt by pressure treatment. The methods, however, relate to an organic solvent-base dispersion and stand on a concept different from solving the foregoing problem.

In JP-A-9-127643, disclosed is a method such that obtaining a dispersion of the fatty acid silver salt by simultaneous measuring and addition of an alkali metal salt solution and silver nitrate solution, and then directly desalting the dispersion by dialysis or ultra-filtration. This method is preferable at least in that the primary grain obtained in the crystallization process of the fatty acid silver salt can be incorporated as intact into the photosensitive layer without being crushed. The method, however, still suffers from problems in agglomeration of the grains under a condition of high salt concentration, and in thickening during concentration of the dispersion, which makes the method difficult to be accepted as a measure for obtaining a practical coating liquid.

Another problem resides in that vigorous stirring is required when the alkali metal salt solution and silver nitrate solution are mixed in order to obtain a fine and monodisperse grains of the fatty acid silver salt. In particular, since a solution of a fatty acid alkali metal salt dissolved at a high temperature will instantaneously deposit crystal due to abrupt cooling upon the addition, a slow dilution speed and moderate fluidization will undesirably result in large and coarse grains. Raising the stirring speed during the addition into a tank in which a gas/liquid interphase is formed, however, causes entrainment of the air. Since the fatty acid silver salt grains are strongly hydrophobic and will adhere on the surface of the entrained air bubbles, which not only prevents bubble rupture but also causes agglomeration of adjacent grains on the surface of the bubbles. The liquid such entraining the air appears like a whipped cream, and for the case of desalting the by-produced salt through ultra-filtration, this will significantly degrade the handling property, and the agglomerated grains will clog the filtration membrane.

Temperature of the reaction liquid after the reaction between the silver ion-containing solution and the solution of a fatty acid alkali metal salt is preferably kept around the room temperature, since too high temperature will result in growth of the grains by a physical ripening process. Whereas, the temperature needs be kept at 50° C. or above to obtain a stable solution of an alkali metal salt of a long-chained fatty acid, so that it is necessary to ensure a rapid heat exchange so as to cancel an incoming heat introduced with the added liquid. In this point, a measure for providing a jacket vessel to a tank or the like suffers from a problem in that a heat-exchangeable area educes as volume of the reaction liquid increases, which makes it difficult to scale up the production process.

As described above, a stable method for preparing a water-base coating liquid containing fatty acid silver salt grains capable of affording the thermally processed image forming material with an excellent coated surface quality and optical properties such as low haze and low fog has not been discovered yet.

It is therefore an object of the present invention to provide a thermally processed image forming material allowing fabrication by water-base coating, which is environmentally and economically advantageous, having an excellent coated surface property, and being capable of producing an image with low fog and high black density.

SUMMARY OF THE INVENTION

The present inventors found after extensive investigations for achieving the above object that an excellent thermally processed image forming material capable of affording a desired effect can be obtained by incorporating non-photosensitive fatty acid organic silver salt grains; where (1) the grains being obtained by mixing and reacting a silver ion-containing aqueous solution with a solution of a fatty acid alkali metal salt within a closed liquid mixing means or (2) by micro-dispersing the reaction mixture at a predetermined operating pressure using a ultrahigh pressure dispersion apparatus; such findings led us to propose the present invention.

That is, the present invention is to provide a thermally processed image forming material containing elsewhere on a support a reducing agent, a binder and non-photosensitive fatty silver salt grains characterized in that (1) the non-photosensitive fatty acid silver salt grains are prepared by mixing and reacting a silver ion-containing solution, the solvent of which being water or a mixture of water and an organic solvent, with a solution of a fatty acid alkali metal salt, the solvent of which being water, an organic solvent, or a mixture of water and an organic solvent, in a closed mixing means, or (2) the non-photosensitive fatty acid silver salt grains are prepared by micro-dispersing the reaction mixture at an operating pressure of 1,800 kg/cm$^2$ or above using a ultrahigh pressure dispersion apparatus.

In a preferred embodiment of the present invention, the non-photosensitive fatty silver salt grains are prepared by cooling a reaction mixture obtained after the reaction proceeded within the closed mixing means. In another preferred embodiment of the present invention, the non-photosensitive fatty acid silver salt grains are prepared by micro-dispersing the reaction mixture, obtained after the reaction proceeded within the closed mixing means, at an operating pressure of 1,800 kg/cm$^2$ or above using a ultrahigh pressure dispersion apparatus, and in particular, in a ultrahigh pressure jet flow.

The thermally processed image forming material of the present invention preferably contains an additional silver halide.

The thermally processed image forming material of the present invention preferably has an image producing layer which contains the non-photosensitive fatty silver salt grains and the binder, and a polymer latex having a glass transition point of −30° C. to 40° C. comprises 50 wt % or more of the binder. Note in this specification that a certain range of values expressed using a word "to" always includes both end values given before and after thereof.

The thermally processed image forming material of the present invention preferably contains at least a single species of nucleation aid in at least one layer provided on the same side of the image producing layer on the support.

The nucleation aid is preferably at least any one of a compound selected from the group consisting of a substituted alkene derivative expressed by the general formula (1) below, a substituted isooxazole derivative expressed by the general formula (2) below, and an acetal derivative expressed by the general formula (3) below:

(1)

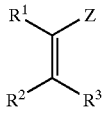

(where, $R^1$, $R^2$ and $R^3$ independently represent a hydrogen atom or substituent: Z represents an electron attracting group or silyl group; and, $R^1$ and Z, $R^2$ and $R^3$, $R^1$ and $R^2$, or $R^3$ and Z may individually bind with each other to form a cyclic structure), (2)

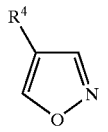

(where, $R^4$ represents a substituent), and (3)

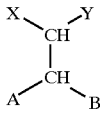

(where, X and Y independently represent a hydrogen atom or substituent; A and B independently represent alkoxy group, alkylthio group, alkylamino group, aryloxy group, arylthio group, anilino group, heterocyclic oxy group, heterocyclic thio group or heterocyclic amino group; and, X and Y, or A and B may individually bind with each other to form a cyclic structure).

BRIEF DESCRIPTION OF THE DRAWINGS

The above and other objects and features of the invention are apparent to those skilled in the art from the following referred embodiments thereof when considered in conjunction with the accompanied drawings, in which.

DETAILED DESCRIPTION OF THE INVENTION

Methods and modes for applying the thermally processed image forming material of the present invention will be detailed hereinafter.

The thermally processed image forming material of the present invention is such that containing elsewhere on a support a reducing agent, a binder and non-photosensitive fatty silver salt grains, where the non-photosensitive fatty acid silver salt grains are prepared by (1) mixing and reacting a silver ion-containing solution, the solvent of which being water or a mixture of water and an organic solvent, with a solution of a fatty acid alkali metal salt, the solvent of which being water, an organic solvent, or a mixture of water and an organic solvent, in a closed mixing means, or (2) micro-dispersing the reaction mixture at an operating pressure of 1,800 kg/cm$^2$ or above using a ultrahigh pressure dispersion apparatus.

Figure 1:
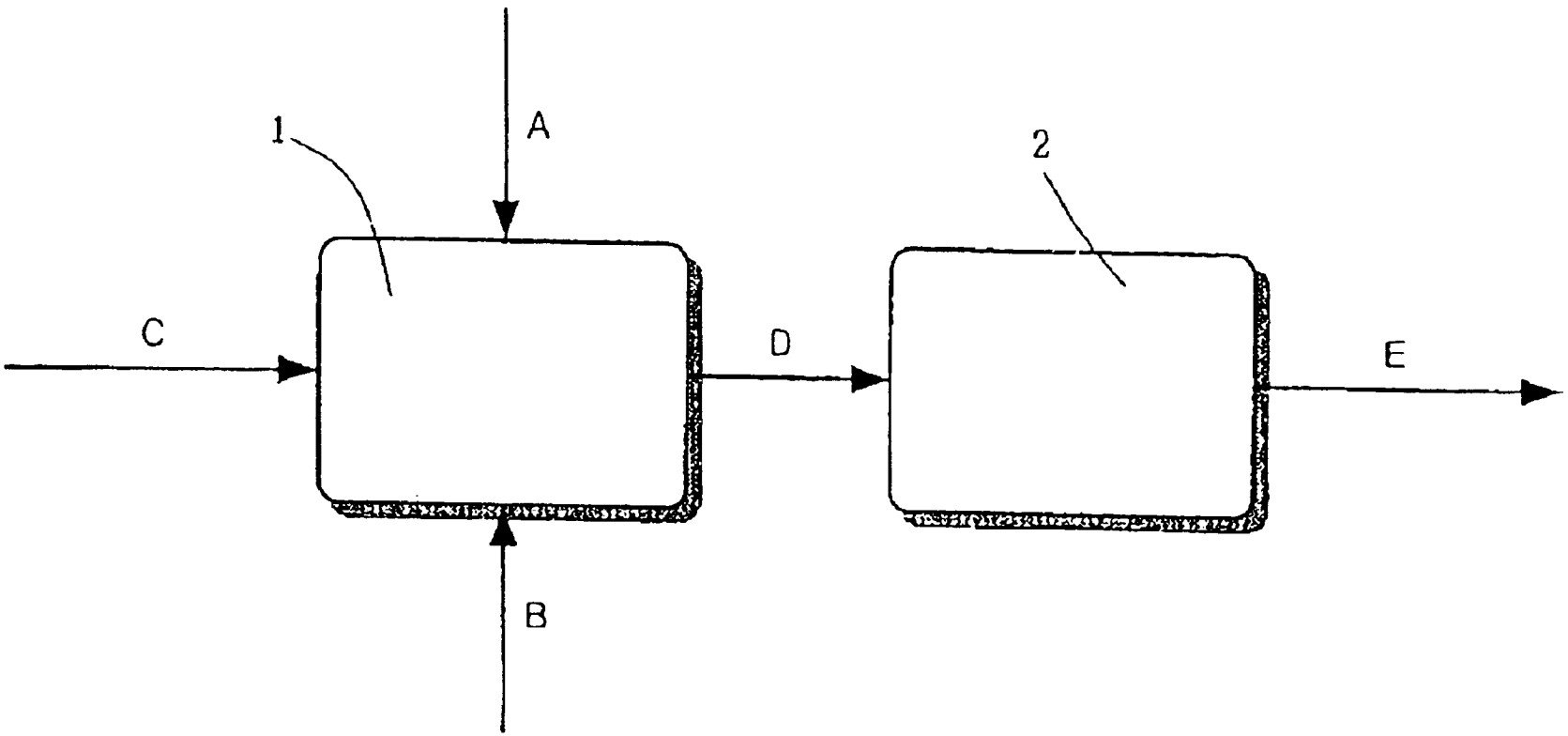
FIG. 1 is a schematic diagram showing a method for preparing the non-photosensitive fatty acid silver salt grains for use in the present invention.

FIG. 1 shows a schematic diagram showing a method for preparing the non-photosensitive fatty acid silver salt grains for use in the present invention. Symbol 1 is used for a mixing apparatus which is closed and filled with the liquids, and 2 for a heat exchanger. In this figure, "A" is a symbol for a silver ion-containing solution, "B" for a solution of a fatty acid alkali metal salt, and "C" for water or a mixture of water and an organic solvent, or a reaction mixture containing the non-photosensitive fatty acid silver salt grains obtained after the reaction. These liquids are joined within the mixing apparatus to prepare the reaction mixture "D" containing fatty acid silver salt grains, which is then fed to a heat exchanger 2 to be cooled.

Figure 2:
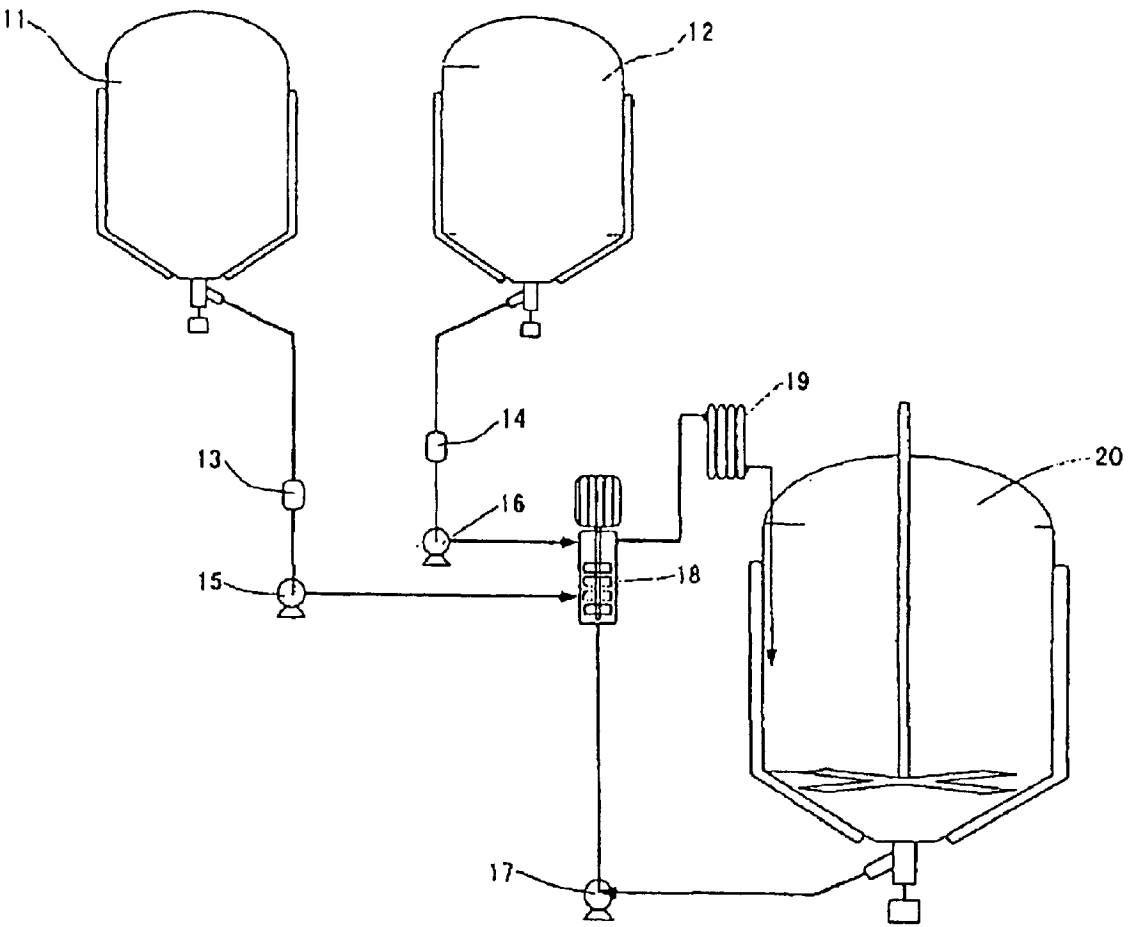
FIG. 2 is a schematic view showing an exemplary constitution of an apparatus used for preparing the non-photosensitive fatty acid silver salt grains for use in the present invention.

FIG. 2 shows one embodiment relating the method for preparing the non-photosensitive fatty acid silver salt grains for use in the present invention. Symbols 11 and 12 in the figure represent tanks for storing under predetermined temperatures the silver ion-containing solution and the solution of the fatty acid alkali metal salt, respectively. Symbols 13 and 14 represent flow meters for measuring flow rates of these liquids fed via pumps 15 and 16 to a liquid-filled closed mixing apparatus 18. In this embodiment, provided as a third component is a pump 17 for feeding the obtained dispersion of the fatty acid silver salt grains back to the liquid-filled mixing apparatus 18. The liquid after completion of the reaction within the mixing apparatus 18 is introduced into a heat exchanger 19, and is rapidly cooled.

The silver ion-containing solution used in the present invention preferably has a pH value of 1 to 6, and more preferably 1.5 to 4. Any acid or base can be added for further pH adjustment.

Silver ion concentration of the silver ion-containing solution used in the present invention may arbitrarily be selected, where a preferable range as expressed in molar concentration is from 0.03 to 6.5 mol/L, and more preferably 0.1 to 5 mol/L.

To successfully form the fatty acid silver salt grains in the present invention, at least one of the silver ion-containing solution, the alkali metal salt solution of the fatty acid, and a solution preliminarily provided in the reaction field must contain an organic solvent in an amount so that the alkali metal salt of the fatty acid can fully be dissolved to give a substantially transparent solution, rather than forming rod-like aggregates or micells. While single use of an organic solvent is also allowable, use of a mixed solution with water is more preferable.

The organic solvent used in the present invention may be of any type so far as having water solubility and above-described properties, whereas those adversely affecting photographic properties are not preferable. Preferable examples of such solvent include water-miscible alcohol and acetone, and more preferable examples relate to tertiary alcohols having a carbon number of 4 to 6. The fatty acid composing the alkali metal salt of the fatty acid is such that being capable of generating a silver salt which is relatively stable against the light, but can produce silver image when heated at 80° C. or higher in the presence of light-exposed photocatalyst (e.g., latent image of photosensitive silver halide) and a reducing agent. The fatty acid is preferably a long-chained fatty carboxylic acid specifically having a carbon number of 10 to 30, more preferably 12 to 26. Preferable examples of the fatty carboxylic acid include cerotic acid, lignoceric acid, behenic acid, erucic acd, arachidinic acid, stearic acid, oleic aced, lauric acid, caproic acid, myristic acid, palmitic acid, maleic aced, fumaric acid, tartaric acid, linolic acid, butyric acid, camphoric acid and mixtures thereof.

The alkali metal composing the alkali metal salt of the fatty acid used in the present invention is typified as sodium or potassium. The alkali metal salt of the fatty acid can be obtained by adding NaOH or KOH to the fatty acid, in which it is preferable to limit an amount of use of the alkali metal less than that of the fatty acid so that a part of the fatty acid will remain unreacted. An amount of the remaining fatty acid is 3 to 50 mol % relative to the total fatty acid, and preferably 3 to 30 mol %. It is also allowable in the preparation to add an excessive amount of an alkali and then add an acid such as nitric acid or sulfuric acid to neutralize the excessive portion of the alkali.

The silver-ion containing solution, the solution containing the fatty acid alkali metal salt, or the solution pre-charged in the closed mixing apparatus to which two above solutions will be charged may be added with a dispersing agent such as, for example, a compound expressed by the general formula (1) of JP-A-62-65035, a water-soluble N-heterocyclic compound having a solubility-expressing group as disclosed in JP-A-62-150240, an inorganic peroxide as disclosed in JP-A-50-101019, a sulfur compound as disclosed in JP-A-51-78319, a disulfide compound as disclosed in JP-A-57-643 and hydrogen peroxide.

The solution of the fatty acid alkali metal salt preferably contains the organic solvent in an amount of 3 to 70 vol % of water volume, and preferably 5 to 50 vol %. Since an optimum solvent volume can vary depending on the reaction temperature, it is preferable to determine the optimum volume in a trial-and-error manner.

Concentration of the fatty acid alkali metal salt used in the present invention is preferably 5 to 50 wt %, more preferably 7 to 45 wt %, and still more preferably 10 to 40 wt %.

A desired fatty acid silver salt can be prepared by simultaneously adding the silver ion-containing solution and the solution of fatty acid alkali metal salt. In such a case, it is preferable that 10 to 100%, more preferably 30 to 100%, and still more preferably 50 to 100% of the total amount of addition of silver is added simultaneously with the solution containing a nearly equal molarity of the fatty acid alkali metal salt. When either solution is precedently added, the silver ion-containing solution in precedence is more preferable.

Temperatures of the silver-ion containing solution and the solution of the fatty acid alkali metal salt may appropriately be selected in order to obtain desired grains. The temperature of the silver-ion containing solution is preferably selected to 5 to 60° C., and more preferably 5 to 40° C., for the purpose of ensuring stability of the liquid. The temperature of the solution of the fatty acid alkali metal salt is preferably 50 to 90° C., and more preferably 60 to 85° C., for the purpose of keeping a certain temperature required for avoiding crystallization or solidification of the alkali soap.

The temperature of the reaction liquid during the formation of the silver salt may arbitrarily be selected, where it is preferably within a range from 5 to 70° C., more preferably from 10 to 50° C., and still more preferably 20 to 45° C. in terms of improving properties as an image recording material.

Various approaches are allowable for preparing the fatty acid silver salt grains. To obtain the grains appropriate for the present invention, it is preferable to lower solubility of the fatty acid silver salt in the reaction region. The present inventors have found from the investigations that the longer the duration of the reaction became, the smaller the grain size became. It was thus concluded that, to obtain a desired grain size, the reaction period must be determined by a trial-and-error manner.

There is no particular limitation on the apparatus used for producing the silver salt. As for the mixing apparatus in particular, a variety of available models include those of bulk stirring type using anchor wing or paddle wing; emulsifying dispersion type such as dissolver and homogenizer; static mixing apparatuses such as static mixer and sluzer mixer; and those based on combination of any of these types.

Order of the addition of the silver ion-containing solution and the solution of a fatty acid alkali metal salt may be any one of such that adding both liquids in the same closed mixing apparatus; such that adding either one of which in the upper stream side of the closed mixing apparatus and adding the other in the closed mixing apparatus; such that adding both liquids in the upper stream side of the closed mixing apparatus; such that adding, together with the above two liquids, a third liquid in the same closed mixing apparatus, where the third liquid being water, a mixture of water and an organic solvent used in the silver ion-containing solution and the solution of a fatty acid alkali metal salt, or a reaction liquid in which the non-photosensitive fatty acid silver salt grains are already produced; such that adding any two liquids in the upper stream side of the closed mixing apparatus in an arbitrary order and adding one remaining liquid in the closed mixing apparatus; and such that composing the mixing apparatus with a plurality of units connected in series, and adding one or two liquids in the individual units.

Also duration or the addition of the silver ion-containing solution and the solution of the fatty acid alkali metal salt is arbitrarily selected, and the addition can be effected at a constant rate, or in a accelerated or decelerated mode according to an arbitrary time function.

Possible methods for rapidly cooling temperature of the liquid obtained after the reaction between the silver ion-containing solution and the solution of the fatty acid alkali metal salt include such that previously cooling liquids to be fed to the mixing apparatus, such liquids being any one of the silver ion-containing solution, water, a mixture of water and an organic solvent, or the reaction liquid containing the fatty acid silver salt grains; such that cooling the mixing apparatus per se; and such that providing a heat exchanger between the mixing apparatus and the tanks. The liquid temperature obtained after the reaction between the silver ion-containing solution and tine solution of fatty acid alkali metal salt is preferably 5 to 70° C., more preferably 10 to 50° C., and still more preferably 20 to 45° C. To further improve properties of the image recording material, the cooling rate is preferably such that ensuring a desired temperature within 0.05 to 10 seconds, more preferably 0.05 to 5 seconds, and still more preferably 0.05 to 1 seconds after both liquids are joined.

While there is no particular limitation on the shape of the fatty acid silver salt grains, scaly shape or needle-like shape is preferable. Sphere-equivalent diameter of the fatty acid silver salt grains prepared by the above procedures is preferably 0.1 to 0.8 $\mu$m, and more preferably 0.1 to 0.6 $\mu$m. Long edge/short edge ratio of the grain is preferably 1 to 4, more preferably 1 to 3, and still more preferably 1 to 2. Aspect ratio of the grain [grain size (circle-equivalent diameter) of the major plane/grain thickness] is preferably 2 to 30, and more preferably 2 to 15. Grain thickness is preferably 0.01 to 0.20 $\mu$m, and more preferably 0.01 to 0.15 $\mu$m. The grains satisfying the above requirements preferably account for 30 to 100% of the projected area of the total grains, more preferably 50 to 100%, and still more preferably 70 to 100%.

Grain size distribution of the organic silver salt is preferably of monodisperse as possible. Coefficient of variation of the grain size of the fatty acid silver salt grains is preferably 20% or below, more preferably 18% or below, and still more preferably 15% or below, where the coefficient of variation is defined as a value obtained by dividing a standard deviation of a grain diameter by the grain diameter and then multiplied by 100. An exemplary procedure for the measurement include irradiating laser light to the fatty acid silver salt dispersed in a solution; deriving an autocorrelation function with respect to the time-dependent fluctuation in the scattered light intensity; and thereby obtaining grain size (volume weighted mean diameter), which is known as the dynamic light scattering method.

The fatty acid silver salt grains for use in the present invention is preferably desalted. Methods for desalting are not limitative and any known method is permissible, where centrifugal filtration, suction filtration, ultrafiltration, and flocculation washing based on coagulation are preferable. Particularly preferable is ultrafiltration, where a conventional process known for desalting/concentrating the silver halide emulsion is applicable. Description of such ultrafiltration is found in Research Disclosure No. 10, p.208 (1972), No. 13, p.122 (1975) and No. 16, p.351 (1977). Pressure difference and flow rate, which are critical operation parameters, can be determined referring to a characteristics curve shown in "Maku Riyo Gijyutsu Eandobukku (handbook of Membrane Utilization Technology)" by Haruhiko Ohya, published by Saiwai Shobo Shuppan (1978), p.275, while it is necessary to find out an optimum condition for suppressing grain agglomeration or fog depending on a target fatty acid silver dispersion to be processed. Replenishment of a solvent lost during the membrane permeation can be conducted by the constant-volume method based on continuous feeding of the solvent, or the batch method based on intermittent portion-wise addition, where the former method being preferred as judged from a relatively short process time for the desalting. Pure water obtained after ion exchange or distillation will successfully be used as a solvent to be replenished, which can also contain a pH adjusting agent, a dispersing agent or a poor solvent for the dispersing agent in order to attain a desirable value for pH, concentration of the dispersing agent or concentration of the poor solvent for the dispersing agent. It is also allowable to add these additives directly to the fatty acid silver dispersion.

There are various types of the modular ultra-filtration membrane such as disc type, spiral type, cylindrical type and hollow fiber type, which are commercially available from Asahi Chemical, Dicel Chemical Industries, Ltd., Toray Industries, Inc. and Nitto Denko Corporation. Among these, the spiral type and hollow fiber type are preferable from the viewpoints of total membrane area and washability. Fractional molecular weight of the membrane, which provides an index for a threshold value of membrane-permeable components, must be determined based on the molecular weight of the dispersing agent being used, which is preferably 5,000 to 50,000, and more Preferably 5,000 to 15,000.

A water-soluble dispersing agent can be added to the silver ion-containing solution, solution of fatty acid alkali metal salt or reaction liquid in the present invention. That is, the dispersing agent can be contained in the reaction liquid in the process of forming the fatty acid silver salt or separately prepared solution of the dispersing agent; or in the finished liquid after the fatty acid silver salt grains are formed. The dispersing agent can be of any type so far as it can disperse the generated fatty acid silver salt grains. Specific examples thereof comply with those for the fatty acid silver salt described later.

The fatty acid silver salt grains available in the present invention will have a form of solid micrograin dispersion assisted by the dispersing agent so as to achieve a small grain size and an agglomeration-free nature. In the process of producing such solid micrograin dispersion, it is preferable to avoid only the agglomeration while preventing the produced grains from being fractured. Such state can be judged by comparing TEM (transmission electron microscope) photographs of the grains taken before water washing and after the dispersion. The grains for use in the present invention are preferably such that the projected area of which being not altered by 30% or more, more preferably 20% or more, and still more preferably 10% or more, when the average grain sizes before the water washing and after the dispersion are compared. The dispersion is preferably effected by converting a water-base dispersion of the fatty acid silver salt into a high-pressure and high-speed flow, which is followed by an abrupt pressure drop.

It is preferable that the dispersion contains substantially no photosensitive silver salt during the dispersion, since presence of the photosensitive silver salt during the dispersion may increase fog and significantly lower the sensitivity. In the present inventions a content of the photosensitive silver salt in the water-base dispersion to be dispersed is 0.1 mol % or less relative to 1 mol of the organic acid silver salt contained therein, without any intentional addition of the photosensitive silver salt.

Dispersion apparatuses and technologies available for implementing the above dispersion in the present invention are detailed, for example, in "Bunsankei Reoroji to Bunsanka Gijutsu (Dispersed System Rheology and Dispersion Technology)", by Toshio Kajiuchi and Hiroki Usui, 1991, issued by Sinzansha Shuppan, p.357–403; "Kagaku Kogaku no Sinpo (Advances in Chemical Engineering) Vol. 24", ed. Tokai Section, The Society of Chemical Engineers, 1990, issued by Maki Shoten, p.184–185. A dispersion method employed in the present invention is such that feeding the water-base dispersion containing at least fatty acid silver salt into a piping while being pressurized with a high-pressure pump or the like, allowing the dispersion to pass through a narrow slit, and then causing an abrupt pressure drop to the dispersion thereby completing a fine dispersion.

As for a high-pressure homogenizer available in the present invention, an uniform and effective dispersion is generally considered to be effected by dispersion forces such as (a) "shearing force" generated when dispersoid passes through a narrow gap under a high pressure and at a high speed, and (b) "cavitation force" generated when the dispersoid is released from the high pressure state to the normal pressure state. Galling homogenizer has long been known as such kind of dispersion apparatus, in which a pressure-fed solution to be dispersed is converted into a high-speed flow at a narrow gap on a cylinder surface, then rushed to be collided with the peripheral wall, thereby allowing emulsification or dispersion assisted by the impact force. Operating pressure is, in general, selected in a range from 100 to 600 kg/cm$^2$, and flow rate in a range several to 30 m/second. There is also proposed an apparatus such that having a saw-toothed high flow rate portion to increase the number of collision for a higher dispersion efficiency. Recent new developments for enabling the dispersion at a still higher pressure range typically include Microfluidizer (product of Microfluidex International Corporation), and Nanomizer (product of Tokushu Kika Kogyo Co., Ltd.).

The fatty acid silver salt grains for use in the present invention can be dispersed in a desired grain size by properly adjusting the flow rate, pressure difference at the time of the pressure crop and the number of repetition of the process. Taking photographic properties and the grain size into account, the flow rate is preferably from 200 to 600 m/sec, more preferably from 300 to 600 m/sec, and the pressure difference at the pressure drop is preferably from 900 to 3,000 kg/cm$^2$, and more preferably from 1,500 to 3,000 kg/cm$^2$. The number of repetition of the process is selectable as required. While this is generally selected as once to as much as 10 times, once to as much as 3 times is preferred from the viewpoint of productivity. Raising the temperature of such water-base dispersion under high pressure is undesirable from the viewpoint of dispersibility and photographic properties, that is, raising the temperature above 90° C. tends to result in increased grain size and increased fogging. It is thus preferable in the present invention to provide a cooling step before the conversion into the high-pressure, high-speed flow and/or after the pressure drop, to maintain the temperature of the water-base dispersion within a range from 5 to 90° C., more preferably from 5 to 80° C., and still more preferably 5 to 65° C. Providing such cooling step is particularly beneficial when the dispersion is proceeded under the pressure as high as 1,500 to 3,000 kg/cm$^2$. A cooler is properly selected, depending on the required capacity of heat exchange, from those being equipped with a double pipe or triple pipe as combined with a static mixer; shell-and-tube heat exchanger; and coiled heat exchanger. The diameter, wall thickness and material of the pipe are properly be selected, considering the operating pressure, so as to improve the efficiency of the heat exchange. Coolants available for the cooler is selectable, depending on the required amount of heat exchange, from well water at 20° C.; cold water at 5 to 10° C. fed from a chiller; and, as requested, ethylene glycol/water at −30° C.

In order to obtain a dispersion of a fatty acid silver salt grains allowing a high S/N, having a small grain size and causing no agglomeration, it is in particular desirable to prepare a water-base dispersion, containing a non-photosensitive fatty acid silver salt contributing the image production but substantially no photosensitive silver salt, using a ultrahigh pressure dispersion apparatus. Specific examples or such ultrahigh pressure dispersion apparatus are such that equipped with a dispersion cell shown in FIG. 5 or FIG. 6.

Figure 5:
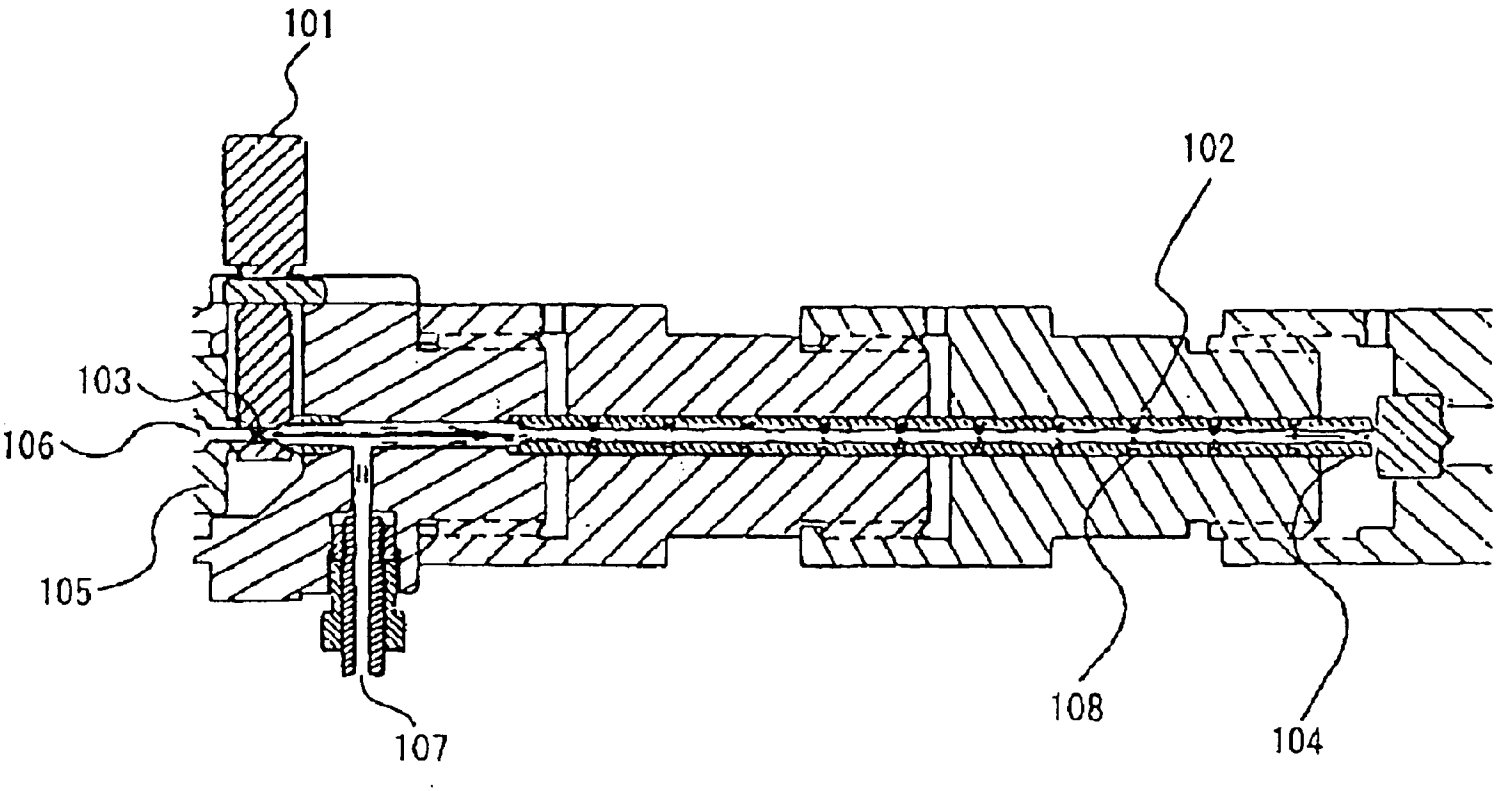
FIG. 5 is a sectional view showing an exemplary constitution of a dispersion cell of a ultrahigh pressure dispersion apparatus used for micro-dispersing the non-photosensitive fatty acid silver salt grains for use in the present invention.

FIG. 5 is a sectional view of a dispersion cell of the dispersion apparatus. Symbol 101 denotes a nozzle having at the end thereof an orifice 103, the diameter of which being arbitrarily selected within a range from 0.1 to 0.2 mm. The nozzle 101 is preferably made of zirconia. Symbol 102 indicates an absorption cell, which is composed of a plurality of unit cells made of zirconia or the like having an inner diameter of 0.5 to 1 mm (arbitrary) and a length of 1 cm. Adjacent unit cells are jointed via PEEK (polyetheretherketone) seals 108 having an inner diameter larger than that of the unit cells, which produces recessed portions along the inner wall of the absorption cell 102. Symbol 104 indicates a liquid inverting plug, 105 indicates a coupling for converting the liquid flow into laminar flow or turbulent flow, 106 indicates an inlet of the pre-dispersion liquid, and 107 indicates an outlet of the post-dispersion liquid.

The pre-dispersion liquid enters from the inlet 106 while being pressurized with a high pressure pump and is then burst out from the nozzle 101 as a jet flow as indicated by an arrow into an absorption cell 102. The jet flow is inverted by the liquid inverting plug 104 and is returned along the outer surface of the jet flow, in which shearing force generated at the interface of the forwarding flow and returning flow will effect the dispersion and emulsification. The mixing also occurs at the recessed portions (discussed later referring to FIG. 7) aligned above the seals 108 along the inner wall of the absorption cell 102. It is also allowable to apply back pressure to the outlet 107.

When the apparatus shown in FIG. 5 is used, it is preferable to preliminarily disperse the liquid to be dispersed using a dissolver, colloid mill or the like.

Figure 6:
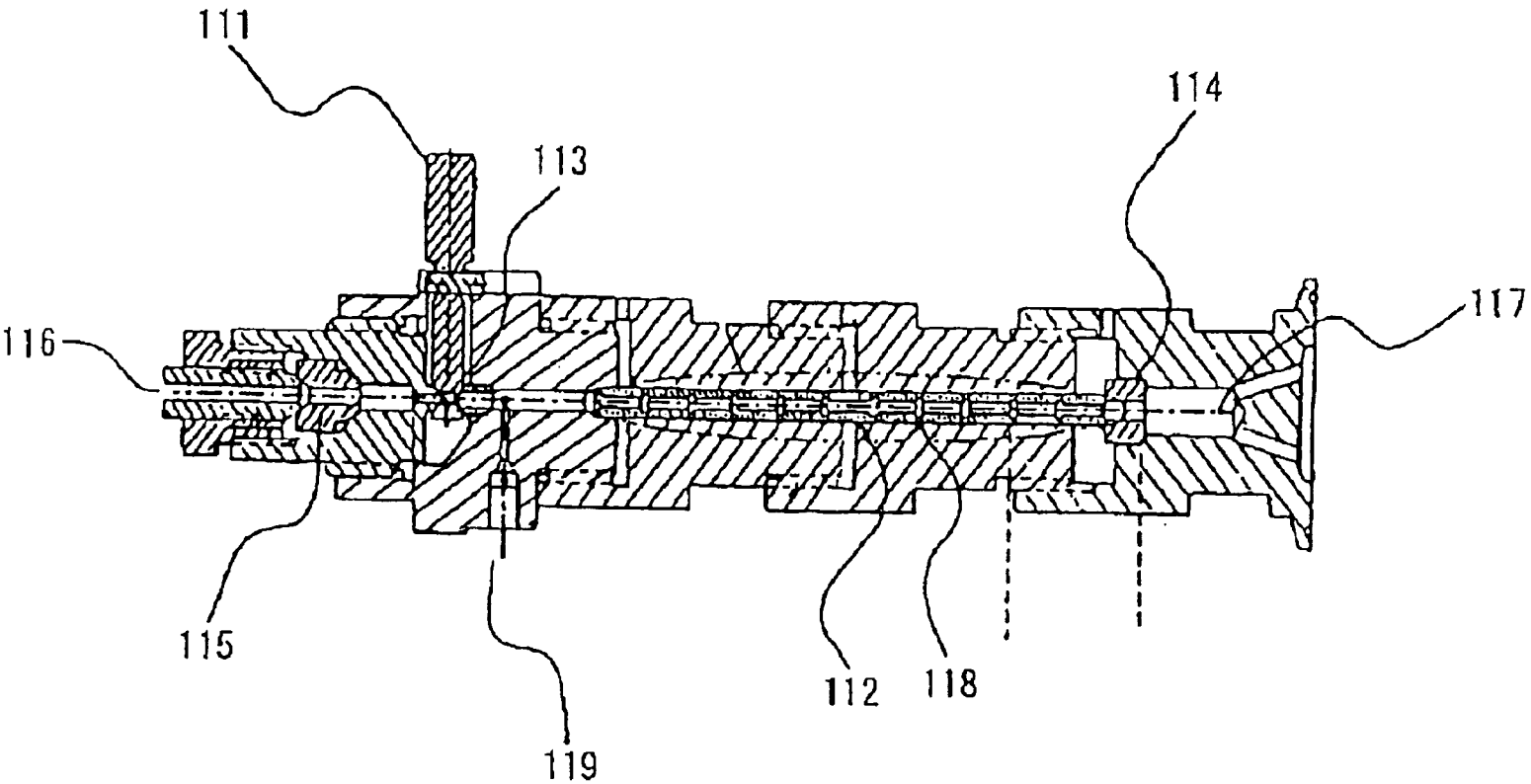
FIG. 6 is a sectional view showing another exemplary constitution of a dispersion cell of a ultrahigh pressure dispersion apparatus used for micro-dispersing the non-photosensitive fatty acid silver salt grains for use in the present invention.

FIG. 6 is a sectional view of another dispersion cell of the dispersion apparatus. Symbol 111 denotes a nozzle having at the end thereof an orifice 113, the diameter of which being arbitrarily selected within a range from 0.1 to 0.2 mm. The nozzle 111 is preferably made of zirconia. Symbol 112 indicates an absorption cell, which is composed of a plurality of unit cells made of zirconia or the like having an inner diameter of 0.5 to 1 mm (arbitrary) and a length of 1 cm. Adjacent unit cells are jointed via seals 118 having an inner diameter larger than that of the unit cells, which produces recessed portions along the inner wall of the absorption cell 112. Symbol 114 indicates a plug which allows the liquid flow rightward without being inverted. Symbol 115 indicates a coupling for converting the liquid flow into laminar flow or turbulent flow, 116 indicates an inlet of the pre-dispersion liquid, and 117 indicates an outlet of the post-dispersion liquid. Symbol 119 indicates an inlet of a composition or powders to be mixed with the liquid introduced from the inlet 116. A powder introducing device such as a pump or hopper may be attached thereto to allow introduction of the liquids or powders.

The pre-dispersion liquid enters from the inlet 116 while being pressurized with a high pressure pump and is then burst out from the nozzle 111 as a jet flow into an absorption cell 112. The jet flow is sheared along the inner wall of the absorption cell 112 or in the recessed portions, thereby to promote the dispersion, mixing and emulsification. It is also allowable to apply back pressure to the outlet 117.

Using the dispersion cell as shown in FIG. 6 allows introduction of a dispersing agent such as polyvinyl alcohol and an fatty acid silver salt grains in a form of a wet cake from the different inlets of the absorption cell, without a need of preliminary dispersion.

Figure 7:
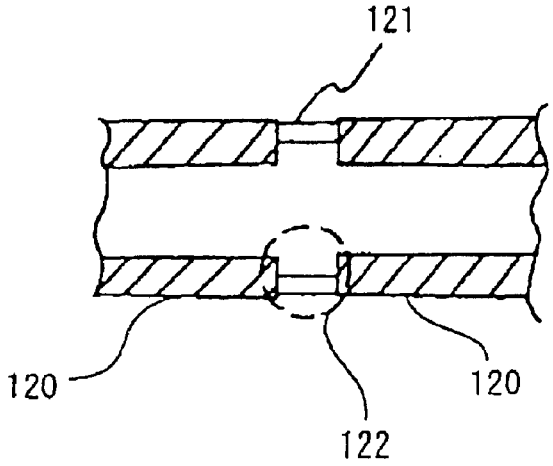
FIG. 7 is an expanded sectional view showing a seal 108 or 118 made of PEEK (polyetheretherketone) in FIG. 5 or 6.

FIG. 7 is an expanded sectional view of the seals 108 or 118 shown in FIG. 5 or FIG. 6. In the drawing, symbol 120 is used for the absorption cell, 121 for the PEEK-made seal, and symbol 122 for the recessed portion.

To a dispersion cells shown in FIGS. 5 and 6, the dispersion liquid or compositions can be introduced after being adjusted at an arbitrary temperature within a range not causative of decomposition or vaporization. The post-dispersion liquid can be cooled, using a heat exchanger or the like, to an arbitrary temperature within a range not causative of freezing.

It is also allowable to connect the dispersion cell shown in FIGS. 5 or 6 to the outlet 117 shown in FIG. 6.

Specific examples of the dispersion apparatus available in the present invention include DeBEE2000 (product of Bee International, Ltd.), Micro Fluidizer M-110S-EH (product of Microfluidex International Corporation) equipped with G10Z interaction chamber.

In the present invention, the non-photosensitive fatty acid silver salt is pulverized using a ultrahigh pressure dispersion apparatus with an operating pressure of 1,800 kg/cm$^2$ or above, more preferably 2,000 kg/cm$^2$ or above, and still more preferably 3,000 to 5,000 kg/cm$^2$. The pressure is preferably constant The pulverization using such ultrahigh pressure dispersion apparatus preferably proceeds in a ultrahigh pressure jet flow. The initial velocity of the jet flow is preferably 300 m/sec or above, more preferably 400 m/sec, and still more preferably 600 m/sec. Now the jet flow in the context of the present invention relates to a liquid flow.

The dispersing agent can be properly selected from, for example, synthetic anionic polymers such as polyacrylic acid, copolymers of acrylic acid, maleic acid copolymers, maleic acid monoester copolymers and acryloylmethylpropanesulfonic acid copolymers; semisynthetic anionic polymers such as carboxymethylated starch and carboxymethylcellulose; anionic polymers such as alginic acid and pectic acid; anionic surfactants such as disclosed in JP-A-52-92716 and WO 88/04794; compounds disclosed in JP-A-9-179243; known anionic, nonionic and cationic surfactants; other known polymers such as polyvinyl alcohol, polyvinylpyrrolidone, carboxymethyl cellulose, hydroxypropyl cellulose, and hydroxypropylmethyl cellulose; naturally occurring polymers such as gelatin and the like.

The concentration of the dispersing agent is preferably 1 to 30 wt % of the fatty acid silver salt, and more preferably 3 to 20 wt %.

The produced dispersion can also be stored under stirring in order to prevent precipitation of the micrograins during storage, or stored in a highly viscous state by producing hydrophilic colloid (e.g., jelly state formed with gelatin). Further, it may be added with a preservative in order to prevent germ proliferation during the storage.

The fatty acid silver salt dispersion obtained by the present invention comprises at least a fatty acid silver salt and water. While there is no specific limitation on the ratio of the fatty acid silver salt and water, it is important to select the ratio so as to ensure an efficient film formation, considering rheological characteristics required for the stable coating, and the production speed depending on the dry moisture content. The fatty acid silver salt preferably accounts for 10 to 50 wt % of the total dispersion, and more preferably 10 to 30 wt %. The electric conductivity of such dispersion is preferably 500 $\mu$S/cm or below and more preferably 1 to 500 $\mu$s/cm.

In the process of preparing the fatty acid silver salt grains for use in the present invention, it is preferable to add a metal ion selected from the group consisting of Ca, Mg, Ce, Al, Zn and Ba in a form of a water-soluble salt other than halide. More specifically, the addition in a form of a nitrate or sulfate is preferable.

The metal ion selected from the group consisting of Ca, Mg, Ce, Al, Zn and Ba can be added at any time provided that it is immediately before the coating. That is, it may be added to the solution used for preparing the fatty acid silver salt or may preliminarily added in the reaction liquid; may be added during or immediately after the production of the fatty acid silver salt; or may be added before or after the preparation of the coating liquid. An amount addition of the metal is preferably $10^{-3}$ to $10^{-1}$ mol per mol of the fatty acid silver salt, and more preferably $5\times10^{-3}$ to $5\times10^{-2}$ mol.

Figure 3:
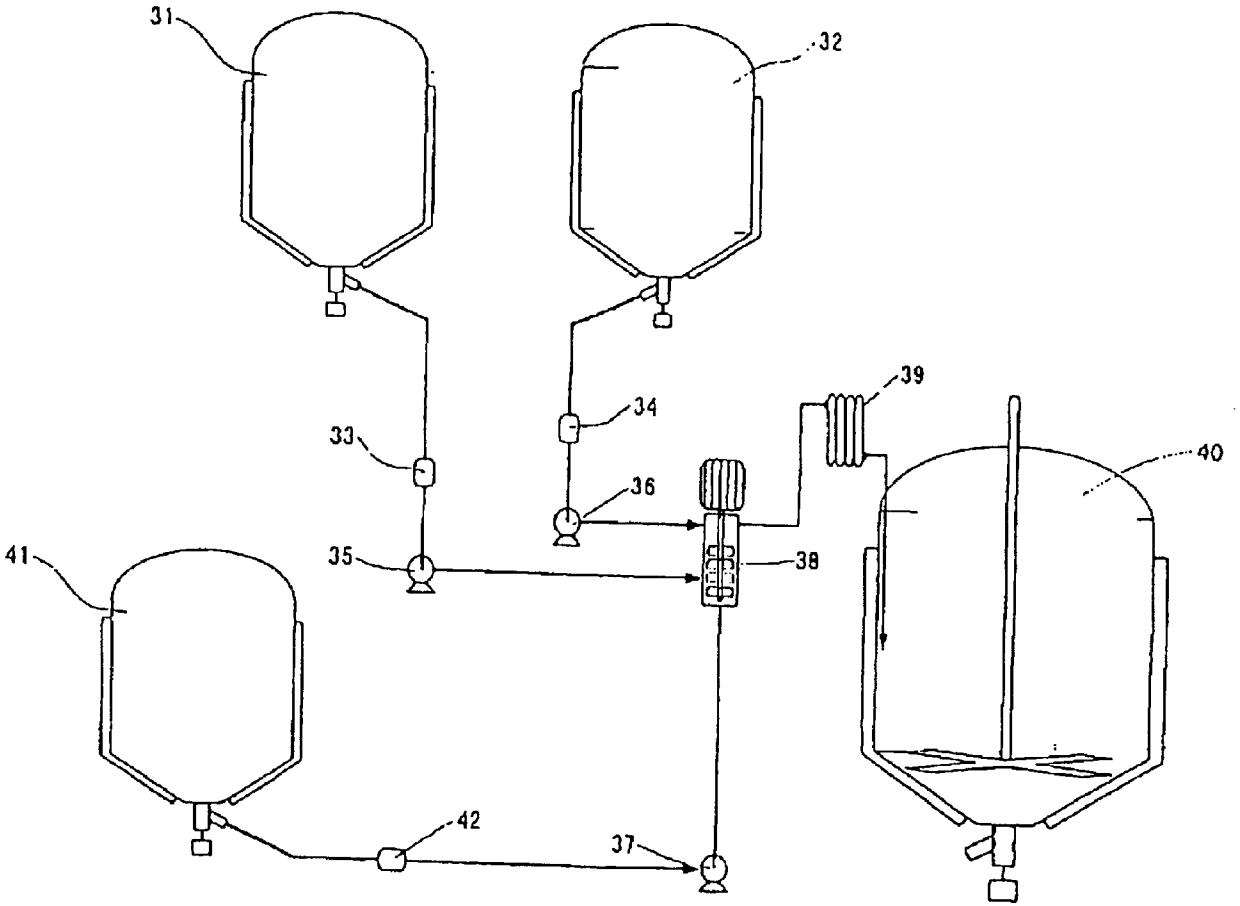
FIG. 3 is a schematic view showing another exemplary constitution of an apparatus used for preparing the non-photosensitive fatty acid silver salt grains for use in the present invention.

While there is no particular limitation on an apparatus for implementing the preparation method of the present invention, a preferable apparatus relates to such that having a first feed means for feeding a silver ion-containing solution, the solvent of which being water or a mixture of water and an organic solvent, to a closed mixing means described later; a second feed means for feeding a solution of a fatty acid alkali metal salt, solvent of which being water, an organic solvent, or a mixture of water and an organic solvent, to the closed mixing means; a third feed means for feeding water, or a mixture of water and an organic solvent to the closed mixing means; and the closed mixing means for mixing matters fed from the first feed means, the second feed means and the third feed means, and discharging a liquid containing non-photosensitive fatty acid silver salt grains. It is preferable that the apparatus is additionally provided with a cooling means for cooling the liquid containing non-photosensitive fatty acid silver salt grains discharged from the closed mixing means (FIG. 3).

Another preferable apparatus for implementing the preparation method of the present invention relates to such that having a first feed means for feeding a silver ion-containing solution, the solvent of which being water or a mixture of water and an organic solvent, to a closed mixing means described later; a second feed means for feeding a solution of a fatty acid alkali metal salt, solvent of which being water, an organic solvent, or a mixture of water and an organic solvent, to the closed mixing means; the closed mixing means for mixing matters fed from the first feed means, the second feed means and a third feed means described next, and discharging a liquid containing non-photosensitive fatty acid silver salt grains; and the third feed means for feeding at least a part of the liquid containing non-photosensitive fatty acid silver salt grains discharged from the closed mixing means back to said closed mixing means. It is preferable that the apparatus is additionally provided with a cooling means for cooling the liquid containing non-photosensitive fatty acid silver salt grains discharged from the closed mixing means (FIG. 2).

In the apparatus shown in FIG. 2, a dispersion of the non-photosensitive fatty acid silver salt grains having a desired concentration can be prepared in the tank 20 by properly regulating the volume of the solution containing non-photosensitive fatty acid silver salt grains fed from the third feed means to the closed mixing apparatus. The concentration of the dispersion of the non-photosensitive fatty acid silver salt grains in the tank 20 becomes higher as the number of repetition of the circulation with the aid of the third feed means increases, so that a proper selection of the circulation conditions can afford a dispersion having a desired concentration. The concentration can be regulated, not only by adjusting such circulation conditions, but also by adjusting conditions for withdrawing the prepared dispersion. Thus a desired dispersion can efficiently be obtained by properly selecting the above conditions while sustaining the continuous operation.

The thermally processed image forming material of the present invention preferably contain at least a single species of nucleation aid in at least one layer provided on the same side of the image producing layer on the support, to obtain an image with excellent photographic properties such as a high sensitivity, high contrast and high black density.

While there is no specific limitation on the nucleation aid, prelferable is a substituted alkene derivative as expressed by the general formula (1), substituted iscoxazole derivative as expressed by the general formula (2), and acetal derivative expressed by the general formulae (3).

(1)

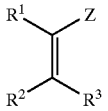

(2)

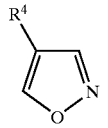

(3)

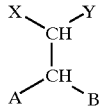

In the general formula (1), $R^1$, $R^2$ and $R^3$ independently represent a hydrogen atom or substituent, and Z represents an electron attracting group or silyl group. In the general formula (1), $R^1$ and Z, $R^2$ and $R^3$, $R^1$ and $R^2$, or $R^3$ and Z may bind with each other to form a cyclic structure. In the general formula (2), $R^4$ represents a substituent. In the general formula (3), X and Y independently represent a hydrogen atom or substituent; A and B independently represent alkoxy group, alkylthio group, alkylamino group, aryloxy group, arylthio group, anilino group, heterocyclic oxy group, heterocyclic thio group or heterocyclic amino group. In the general formula (3), X and Y, or A and B may bind with each other to form a cyclic structure.

The compound expressed by the general formula (1) will be detailed in the paragraphs below.

In the general formula (1), $R^1$, $R^2$ and $R^3$ independently represent a hydrogen atom or substituent, and Z represents an electron attracting group or silyl group. In the general formula (1), $R^1$ and Z, $R^2$ and $R^3$, $R^1$ and $R^2$, or $R^3$ and Z may bind with each other to form a cyclic structure.

When $R^1$, $R^2$ and $R^3$ represent the substituents, examples thereof include halogen atom (fluorine atop, chlorine atom, bromine atom or iodine atom), alkyl group (including cycloalkyl group and active methine group), aralkyl group, alkenyl group, alkynyl group, aryl group, heterocyclic group (including N-substituted nitrogen-containing heterocyclic group), heterocyclic group containing a quaternized nitrogen atom (e.g., pyridinio group), acyl group, alkoxycarbonyl group, aryloxycarbonyl group, carbamoyl group, carboxyl group or salt thereof, imino group, N-substituted imino group, thiocarbonyl group, sulfonylcarbamoyl group, acylcarbamoyl group, sulfamoylcarbamoyl group, carbazolyl group, oxalyl group, oxamoyl group, cyano group, thiocarbamoyl group, hydroxyl group or salt thereof, alkoxy group (including a group containing repetitive units of ethylenoxy group or propylenoxy group), aryloxy group, heterocyclic oxy group, acyloxy group, (alkoxy or aryloxy)carbonyloxy group, carbamoyloxy group, sulfonyloxy group, amino group, (alkyl, aryl or heterocyclic)amino group, acylamino group, sulfonamide group, ureide group, thioureide group, imide group, (alkoxy or aryloxy)carbonylamino group, sulfamoylamino group, semicarbazide group, thiosemicarbazide group, hydrazino group, quaternized ammonio group, oxamoylamino group, (alkyl or aryl)sulfonylureide group, acylureide group, acylsulfamoylamino group, nitro group, mercapto group, (alkyl, aryl or heterocyclic)thio group, acylthio group, (alkyl or aryl)sulfonyl group, (alkyl or aryl)sulfinyl group, sulfo group or salt thereof, sulfamoyl group, acylsulfamoyl group, sulfonylsulfamoyl group or salt thereof, phosphoryl group, group containing phosphate amide or phosphate ester structure, silyl group and stannyl group.

These substituents may further be substituted by these substituents.

The electron attracting group represented by Z in the general formula (1) is such substituent having a positive Hammett's substituent constant $\sigma_P$, which is typified as cyano group, alkoxycarbonyl group, aryloxycarbonyl group, carbamoyl group, imino group, N-substituted imino group, thiocarbonyl group, sulfamoyl group, alkylsulfonyl group, arylsulfonyl group, nitro group, halogen atom, perfluoroalkyl group, perfluoroalkanamide group, sulfonamide group, acyl group, formyl group, phosphoryl group, carboxyl group (or salt thereof), sulfo group (or salt thereof), heterocyclic group, alkenyl group, alkynyl group, acyloxy group, acylthio group, sulfonyloxy group, or aryl group substituted by these electron attracting groups. Here, the heterocyclic group is defined as saturated or unsaturated heterocyclic group, which is typified as pyridyl group, quinolyl group, pyradinyl group, quinoxalinyl group, benzotriazolyl group, imidazolyl group, benzinidazolyl group, hydantoin-1-yl group, succinimido group and phthalimido group.

The electron attracting group expressed by Z in the general formula (1) may further have arbitrary substituent, and such substituent may be any one of those listed in the above in relation to $R^1$, $R^2$ and $R^3$as the substituents.

In the general formula (1), $R^1$ and Z, $R^2$ and $R^3$, $R^1$ and $R^2$, or $R^3$ and Z may bind with each other to form a cyclic structure, where the cyclic structure thus obtained may be a non-aromatic carbon ring or a non-aromatic heterocycle.

Preferable ranges of the compound expressed by the general formula (1) will be detailed next.

Specific examples of the preferable silyl group represented by Z in the general formula (1) include trimethylsilyl group, t-butyldimethylsilyl group, phenyldimethylsilyl group, triethylsilyl group, triisopopylsilyl group and trimethylsilyldimethylsilyl group.

The electron attracting group represented by Z in the general formula (1) is preferably such that having a total carbon number of 0 to 30, which is typified as cyano group, alkoxycarbonyl group, aryloxycarbonyl group, carbamoyl group, thiocarbonyl group, imino group, N-substituted imino group, sulfamoyl group, alkylsulfonyl group, arylsulfonyl group, nitro group, perfluoroalkyl group, acyl group, formyl group, phosphoryl group, acyloxy group, acylthio group or phenyl group substituted by an arbitrary electron attracting group. Among these more preferable are cyano group, alkoxycarbonyl group, carbamoyl group, imino group, sulfamoyl group, alkylsulfonyl group, arylsulfonyl group, acyl group, formyl group, phosphoryl group, trifluoromethyl group or a phenyl group substituted by an arbitrary electron attracting group; and still more preferable are cyano group, formyl group, acyl group, alkoxycarbonyl group, imino group or carbamoyl group.

The group represented by Z in the general formula (1) is preferably an electron attracting group.

The substituent represented by $R^1$, $R^2$ or $R^3$ in the general formula (1) is preferably a group having a total carbon number of 0 to 30, which is exemplified as a group based on the same definition as the above-described electron attracting group represented by Z in the general formula (1), as well as alkyl group, hydroxyl group (or salt thereof), mercapto group (or salt thereof), alkoxy group, aryloxy group, heterocyclic oxy group, alkylthio group, arylthio group, heterocyclic thio group, amino group, alkylamino group, arylamino group, heterocyclic amino group, ureide group, acylamino group, sulfonamide group or substituted or unsubstituted aryl group.

In the general formula (1), $R^1$ is more preferably an electron attracting group, aryl group, alkylthio group, alkoxy group, acylamino group, hydrogen atom or silyl group.

When $R^1$ represents an electron attracting group, the electron attracting group is preferably such that having a total carbon number of 0 to 30, and examples thereof include cyano group, nitro group, acyl group, formyl group, alkoxycarbonyl group, aryloxycarbonyl group, thiocarbonyl group, imino group, N-substituted imino group, alkylsulfonyl group, arylsulfonyl group, carbamoyl group, sulfamoyl group, trifluoromethyl group, phosphoryl group, carboxyl group (or salt thereof) or saturated or unsaturated heterocyclic group. Among these, more preferable is cyano group, acyl group, formyl group, alkoxycarbonyl group, carbamoyl group, imino group, N-substituted imino group, sulfamoyl group, carboxyl group (or salt thereof) or saturated or unsaturated heterocyclic group; and still more preferable is cyano group, formyl group, acyl group, alkoxycarbonyl group, carbamoyl group, or saturated or unsaturated heterocyclic group.

When $R^1$ represents an aryl group, the aryl group is preferably a substituted or unsubstituted phenyl group having a total carbon number of 6 to 30. While the substituent thereof can arbitrarily be selected, preferable is an electron attracting substituent.

In the general formula (1), $R^1$ is more preferably an electron attracting group or aryl group.

The substituent represented by $R^2$ or $R^3$ in the general formula (1) is preferably exemplified as a group based on the same definition as the above-described electron attracting group represented by Z in the general formula (1), as well as alkyl group, hydroxyl group (or salt thereof), mercapto group (or salt thereof), alkoxy group, aryloxy group, heterocyclic oxy group, alkylthio group, arylthio group, heterocyclic thio group, amino group, alkylamino group, anilino group, heterocyclic amino group, acylamino group, or substituted or unsubstituted phenyl group.

It is more preferable that either $R^2$ or $R^3$ represents a hydrogen atom and the other represents a substituent. Such substituent is preferably an alkyl group, hydroxyl group (or salt thereof), mercapto group (or salt thereof), alkoxy group, aryloxy group, heterocyclic oxy group, alkylthio group, arylthio group, heterocyclic thio group, amino group, alkylamino group, anilino group, heterocyclic amino group, acylamino group (more specifically, perfluoroalkaneamide group), sulfoneamide group, substituted or unsubstituted phenyl group or heterocyclic group. Still more preferable are hydroxyl group (or salt thereof), mercapto group (or salt thereof), alkoxy group, aryloxy group, heterocyclic oxy group, alkylthio group, arylthio group, heterocyclic thio group, and heterocyclic group; and most preferable are hydroxyl group (or salt thereof), alkoxy group and heterocyclic group.

It is also preferable that Z and $R^1$, or $R^2$ and $R^3$ in the general formula (1) form a cyclic structure. The cyclic structure thus formed is an aromatic carbon ring or non-aromatic heterocycle, preferably having a five- to seven-membered cyclic structure, preferably having a total carbon number including the substituent of 1 to 40, and more preferably 3 to 30.

Among the compounds expressed by the general formula (1), one more preferable example is a compound in which Z represents any one of cyano group, formyl group, acyl group, alkoxycarbonyl group, imino group and carbamoyl group; $R^1$ represents an electron attracting group or aryl group; either $R^2$ or $R^3$ represents a hydrogen atom and the other represents any one of hydroxyl group (or salt thereof), mercapto group (or salt thereof), alkoxy group, aryloxy group, heterocyclic oxy group, alkylthio group, arylthio group, heterocyclic thio group, and heterocyclic group. Among the compounds expressed by the general formula (1), a still more preferable example is a compound in which Z and $R^1$ bind with each other to form a non-aromatic five- to seven-membered ring structure; either $R^2$ or $R^3$ represents a hydrogen atom and the other represents any one of hydroxyl group (or salt thereof), mercapto group (or salt thereof), alkoxy group, aryloxy group, heterocyclic oxy group, alkylthio group, arylthio group, heterocyclic thio group, and heterocyclic group. In this case, Z as forming a non-aromatic cyclic structure together with $R^1$ is preferably acyl group, carbamoyl group, oxycarbonyl group, thiocarbonyl group and sulfonyl group; and $R^1$ is preferably acyl group, carbamoyl group, oxycarbonyl group, thiocarbonyl group, sulfonyl group, imino group, N-substituted imino group, acylamino group and carbonylthio group.

Next, the compound expressed by the general formula (2) will be detailed.

In the general formula (2), $R^4$ represents a substituent. The substituent expressed by $R^4$ can be exemplified as those described for $R^1$ to $R^3$ in the general formula (1).

The substituent expressed by $R^4$ in the general formula (2) is preferably an electron attracting group or aryl group. When $R^4$ represents an electron attracting group, a total carbon number of which is preferably 0 to 30, which can be exemplified as cyano group, nitro group, acyl group, formyl group, alkoxycarbonyl group, aryloxycarbonyl group, alkylsulfony group, arylsulfonyl group, carbamoyl group, sulfamoyl group, trifluoromethyl group, phosphoryl group, imino group, and saturated or unsaturated heterocyclic group. Among these, more preferable are cyano group, acyl group, formyl group; alkoxycarbonyl group, carbamoyl group, sulfamoyl group, alkylsulfonyl group, arylsulfonyl group, and heterocyclic group.

When $R^4$ represents an aryl group, it is preferably a substituted or unsubstituted phenyl group with a total carbon number of 6 to 30, the substituent of which can be exemplified as those described for $R^1$, $R^2$ and $R^3$ in the general formula (1) for the case that $R^1$, $R^2$ and $R^3$ represent the substituents.

In a more preferable case, $R^4$ represents cyano group, alkoxycarbonyl group, carbamoyl group, heterocyclic group or substituted or unsubstituted phenyl group, and in the most preferable case, cyano group, heterocyclic group or alkoxycarbonyl group.

Next, the compound expressed by the general formula (3) will be detailed.

The substituents expressed by X and Y in the general formula (3) independently represent hydrogen atom or substituent, and A and B independently represent alkoxy group, alkylthio group, alkylamino group, aryloxy group, arylthio group, anilino group, heterocyclic thio group, heterocyclic oxy group or heterocyclic amino group. X and Y, and A and B may bind with each other to form a cyclic structure.

In the general formula (3), substituents expressed by X and Y may be those exemplified above in relation to $R^1$ to $R^3$ in the general formula (1), which is more specifically alkyl group (including perfluoroalkyl group and trichloromethyl group), aryl group, heterocyclic group, halogen atom, cyano group, nitro group, alkenyl group, alkynyl group, acyl group, formyl group, alkoxycarbonyl group, aryloxycarbonyl group, imino group, N-substituted imino group, carbamoyl group, thiocarbonyl group, acyloxy group, acylthio group, acylamino group, alkylsulfonyl group, arylsulfonyl group, sulfamoyl group, phosphoryl group, carboxyl group (or salt thereof), sulfo group (or salt thereof), hydroxyl group (or salt thereof), mercapto group (or salt thereof), alkoxy group, aryloxy group, heterocyclic oxy group, alkylthio group, arylthio group, heterocyclic thio group, amino group, alkylamino group, anilino group, heterocyclic amino group or silyl group.

These group may be further substituted with other substituent. It is also preferable that X and Y bind with each other to form a non-aromatic carbon ring or non-aromatic hetero ring.

In the general formula (3), substituents expressed by X and Y preferably have an total carbon number of 1 to 40, and more preferably 1 to 30, which are exemplified as cyano group, alkoxycarbonyl group, aryloxycarbonyl group, carbamoyl group, imino group, N-substituted imino group, thiocarbonyl group, sulfamoyl group, alkylsulfonyl group, arylsulfonyl group, nitro group, perfluoroalkyl group, acyl group, formyl group, phosphoryl group, acylamino group, acyloxy group, acylthio group, heterocyclic group, alkylthio group, alkoxy group and aryl group.

In the general formula (3), X and Y are more preferably cyano group, nitro group, alkoxycarbonyl group, carbamoyl group, acyl group, formyl group, acylthio group, acylamino group, thiocarbonyl group, sulfamoyl group, alkylsulfonyl group, arylsulfonyl group, imino group, N-substituted imino group, phosphoryl group, trifluoromethyl group, heterocyclic group and substituted phenyl group. Still more preferable are cyano group, alkoxycarbonyl group, carbamoyl group, alkylsulfonyl group, arylsulfonyl group, acyl group, acylthio group, acylamino group, thiocarbonyl group, formyl group, imino group, N-substituted imino group, heterocyclic group and phenyl group substituted by arbitrary substituent.

It is also preferable that X and Y bind with each other to form a non-aromatic carbon ring or non-aromatic hetero ring. The rings thus formed are preferably of five- to seven-membered with a total carbon number of 1 to 40, and more preferably 3 to 30. Substituents X and Y capable of forming the cyclic structure are preferably acyl group, carbamoyl group, oxycarbonyl group, thiocarbonyl group, sulfonyl group, imino group, N-substituted imino group, acylamino group or carbonylthio group.

In the general formula (3), A and B independently represent alkoxy group, alkylthio group, alkylamino group, aryloxy group, arylthio group, anilino group, heterocyclic thio group, heterocyclic oxy group or heterocyclic amino group, which may bind with each other to form a cyclic structure. The substituents expressed by A and B in the general formula (3) may have a total carbon number of 1 to 40, and more preferably 1 to 30, and may also have additional substituent.

A more preferable case relates to that A and B in the general formula (3) bind with each other to form a cyclic structure. The cyclic structure thus obtained is preferably a five- to seven-membered non-aromatic hetero ring with a total carbon number of 1 to 40, and more preferably 3 to 30. The bound structures between A and B (—A—B—) include, for example, $—O—(CH_2)_2—O—$, $—O—(CH_2)_3—O—$, $—S—(CH_2)_2—S—$, $—S—(CH_2)_3—S—$, —S—Ph—S—, $—N(CH_3)—(CH_2)_2—O—$, $—O—(CH_2)_3—S—$, $—N(CH_3)—Ph—O—$, $—N(CH_3)—Ph—S—$ and $—N(Ph)—(CH_2)_2—S—$.

The compounds expressed by the general formulae (1) to (3) used in the present invention may be incorporated with an adsorptive group capable of adsorbing silver halide. Such adsorptive group is exemplified as alkylthio group, arylthio group, thiourea group, thioamide group, mercapto heterocyclic group and triazole group, examples of which are disclosed in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246. These adsorptive groups for the silver halide may be provided as precursors. An exemplary group in a form of a precursor is typically disclosed in JP-A-2-285344.

The compounds expressed by the formulae (1) to (3) available in the present invention may be incorporated with a ballast group or polymer, which are commonly used for in immobile photographic additives such as a coupler, in which those incorporated with the ballast group are the preferable examples of the present invention. The ballast group refers to a group having a carbon number of 8 or more, and being relatively inactive in terms of photographic property, and can be selected from alkyl group, aralkyl group, alkoxy group, phenyl group, alkylphenyl group, phenoxy group, alkylphenoxy group or the like. The polymer is typically disclosed in JP-A-1-100530.

The compounds expressed by the formulae (1) to (3) available in the present invention may have cationic group (e.g., a group containing quaternary ammonio group, or nitrogen-containing hetero ring containing a quaternized nitrogen atom); a group containing repetitive units of ethyleneoxy group or propyleneoxy group; (alkyl, aryl or heterocyclic)thio group; or dissociative group capable of dissociating under the presence of base (e.g., carboxyl group, sulfo group, acylsulfamoyl group, carbamoylsulfamoyl group). Those having a group containing repetitive units of ethyleneoxy group or propyleneoxy group or having (alkyl, aryl or heterocyclic)thio group are preferable example in the present invention. Examples of these groups are disclosed in JP-A-7-234471, JP-A-5-333466, JP-A-6-19032, JP-A-6-19031, JP-A-5-45761, U.S. Pat. Nos. 4,994,365 and4,988,604, JP-A-3-259240, JP-A-7-5610, JP-A-7-244348 and German Patent No. 4,006,032.

Specific examples of the compounds expressed by the general formulae (1) to (3) are listed below, while not particularly being limited thereto:

1

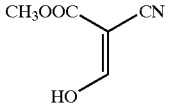

2

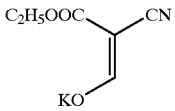

3

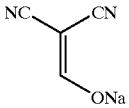

4

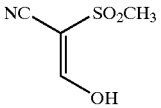

5

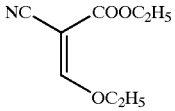

6

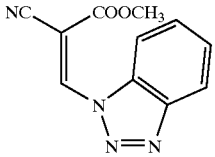

7

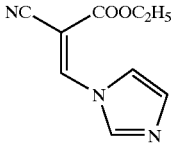

8

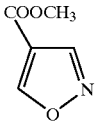

-continued

9

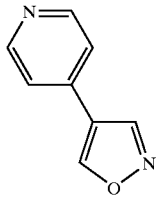

10

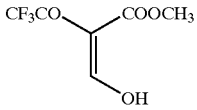

11

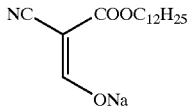

12

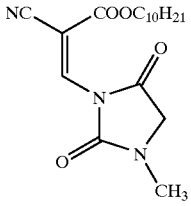

13

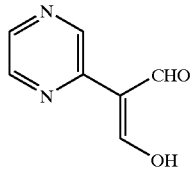

14

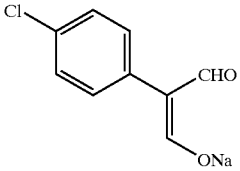

15

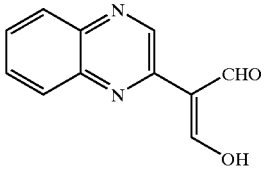

16

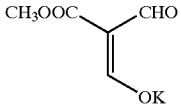

17

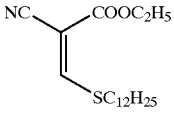

18

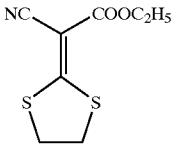

-continued
19
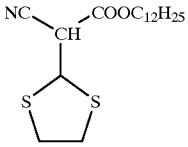
20
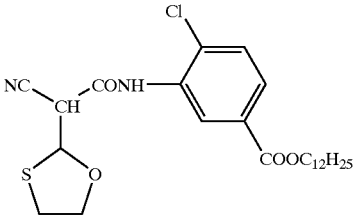
21
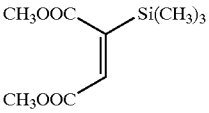
22
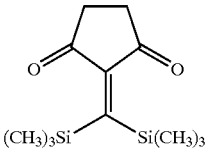
23
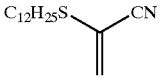
24
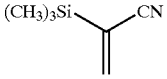
25
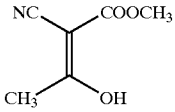
26
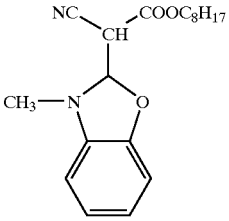
27
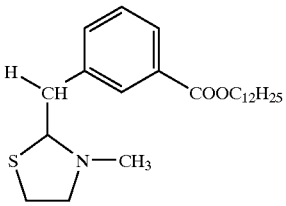
28
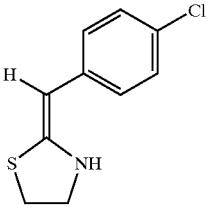
-continued
29
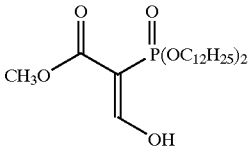
30
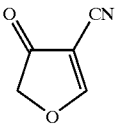
31
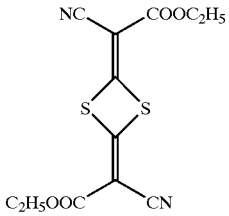
32
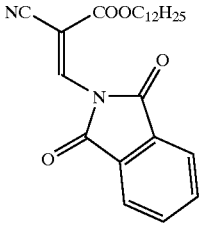
33
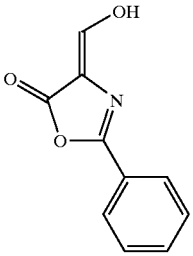
34
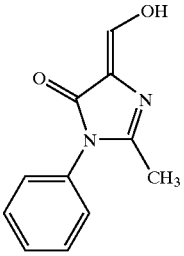
35
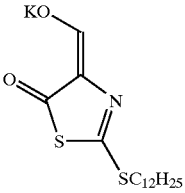

-continued
36
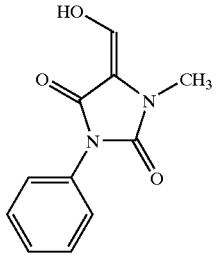
37
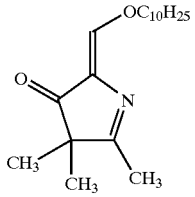
38
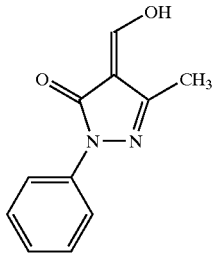
39
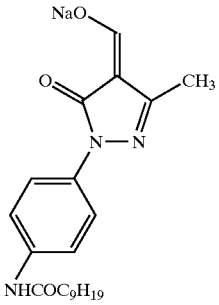
40
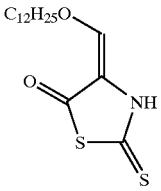
41
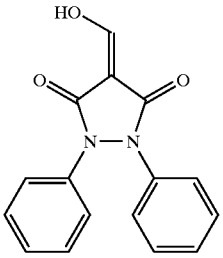
-continued
42
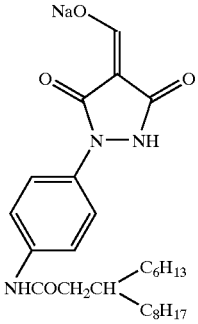
43
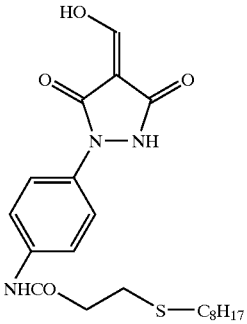
44
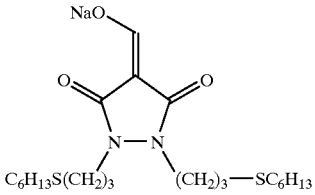
45
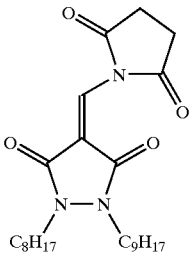
46
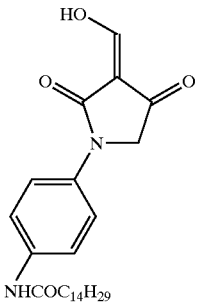

-continued
47
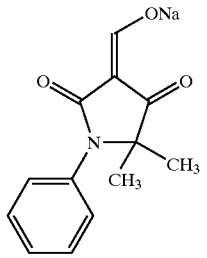
48
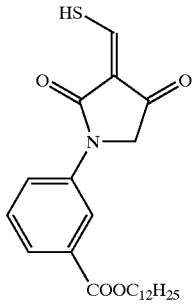
49
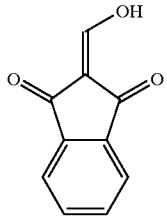
50
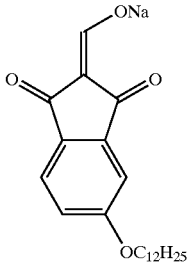
51
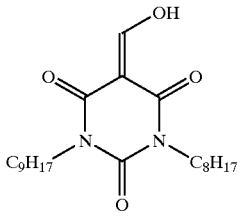
-continued
52
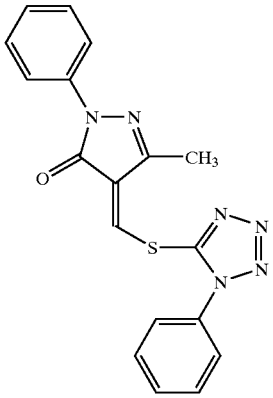
53
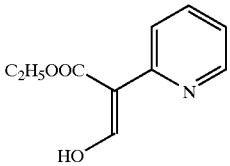
54
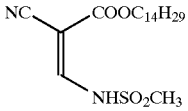
55
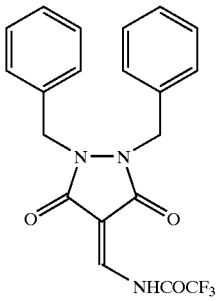
56
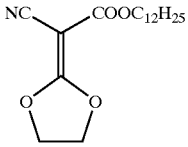
57
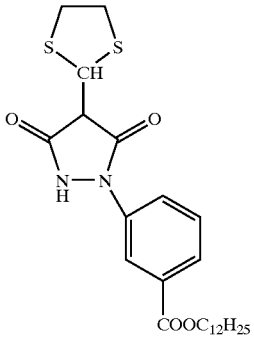

-continued
58
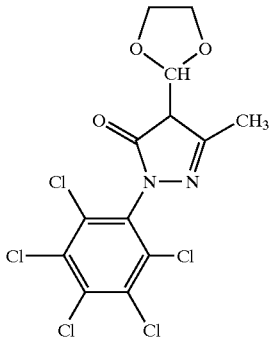
59
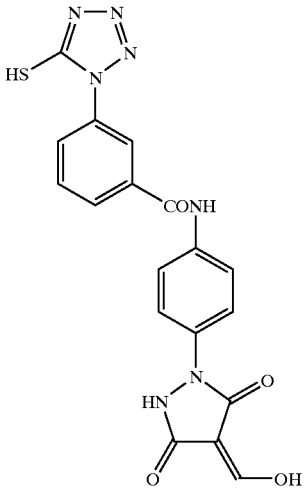
60
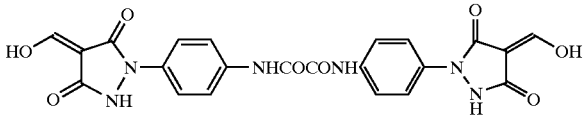
61
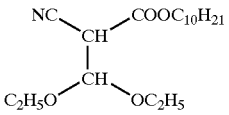
62
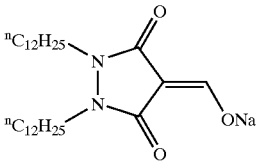
63
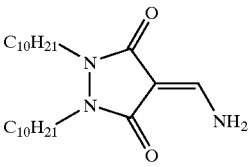
-continued
64
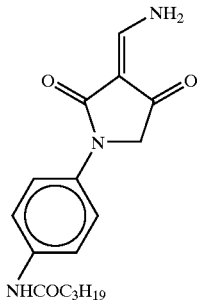
65
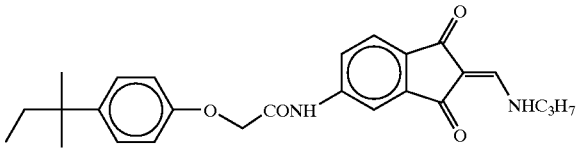
66
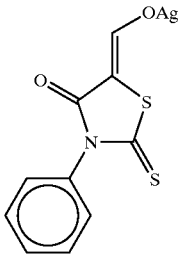
67
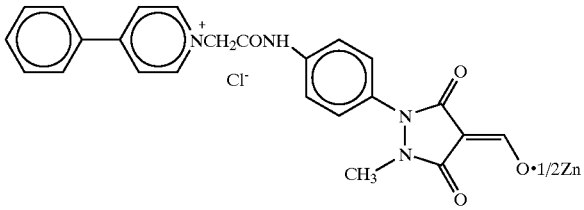
68
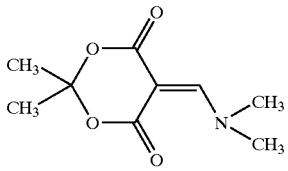
69
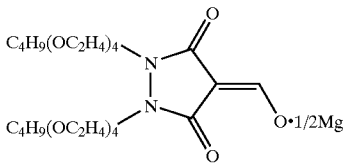

-continued

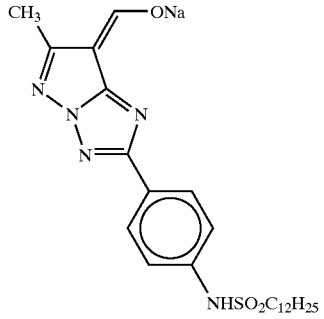

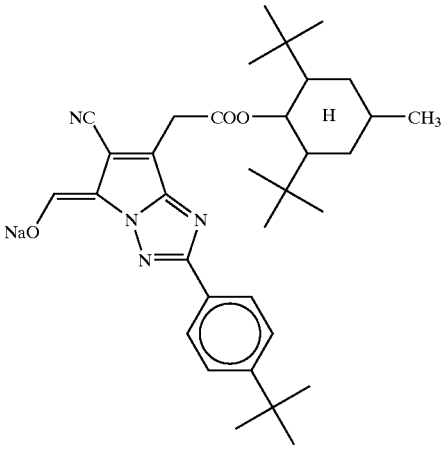

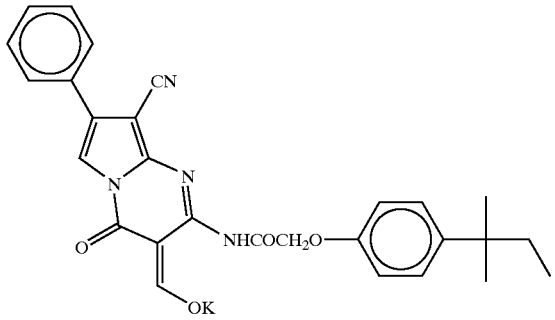

The compounds expressed by the formulae (1) to (3) can be used in the present invention as dissolved in water or other appropriate organic solvents such as alcohols (methanol, ethanol, propanol, fluorinated alcohol), ketones (acetone, methyl ethyl ketone), dimethylformamide, dimethylsulfoxide and Methyl Cellosolve.

The compounds can also be used in a form of emulsified dispersion obtained mechanically by the well-known emulsifying dispersion method by which the compounds are dissolved in oil such as dibutyl phthalate, tricresyl phosphate, glyceryl triacetate and diethyl phthalate; or in auxiliary solvent such as ethyl acetate and cyclohexanone. Alternative method relates to the solid dispersion method by which powders of the compounds are dispersed into water with aid of a ball mill, colloid mill or ultrasonic wave.

The compounds of the general formulae (1) to (3) used in the present invention can be added to any layer provided on the same side of the image producing layer as viewed from a support, where addition to the image producing layer or to the layer adjacent thereto is preferable.

The compounds expressed by the general formulae (1) to (3) are preferably used in an amount, as expressed by a molar amount per mol of silver, from $1\times10^{-4}$ to 1 mol, and more preferably from $1\times10^{-5}$ to $5\times10^{-1}$ mol, and still more preferably from $2\times10^{-5}$ to $2\times10^{-1}$ mol.

The compounds expressed by the general formulae (1) to (3) can easily be synthesized according to known methods referring, for example, to U.S. Pat. No. 5,545,515, No. 5,635,339, No. 5,654,130, International Patent Publication WO 97/34196 or JP-A-11-133546 and JP-A-11-95365.

The compounds expressed by the general formulae (1) to (3) may be used individually or in combination of two or more thereof. In addition to these compounds, compounds described in U.S. Pat. No. 5,545,515, No. 5,635,339 , No. 5,654,130, International Patent Publication WO 97/34196, U.S. Pat. No. 5,686,228, JP application 9-228881, JP-A-11-119372, JP-A-11-133546, JP-A-11-119373, JP-A-11-109546, JP-A-11-95365, JP-A-11-95366 or JP-A-11-149136 may also be used in combination.

In the present invention, the foregoing nucleation aid can be used in combination with various hydrazine derivatives as listed below. The hydrazine derivatives preferably used in the present invention can be synthesized by a variety of methods disclosed in the patent specifications and a literature listed below:

the compounds expressed by (formula 1) of J?-B-6-77138, and more specifically those listed on pages 3 to 4 of the specification;

the compounds expressed by the general formula (1) of JP-B-6-93082, and more specifically Compounds 1 to 38 listed on pages 8 to 18 of the specification;

the compounds expressed by the general formulae (4), (5) and (6) of JP-A-6-230497, and more specifically Compounds 4-1 to 4–10 on pages 25 to 26, Compounds 5-1 to 5-42on pages 28 to 36, and Compounds 6-1 to 6-7 on pages 39 and 40 of the specification;

the compounds expressed by the general formulae (1) and (2) of JP-A-6-289520, and more specifically Compounds 1-1) to 1-17) and 2-1) on pages 5 to 7 of the specification;

the compound expressed by (formula 2) and (formula 3) of JP-A-6-313936, and more specifically those listed on pages 6 to 19 of the specification;

the compounds expressed by (formula 1) of JP-A-6-313951, and more specifically those listed on pages 3 to 5 of the specification;

the compounds expressed by the general formula (1) of JP-A-7-5610, and more specifically Compounds I-1 to I-38 listed an pages 5 to 10 of the specification;

the compounds expressed by the general formula (II) of JP-A-7-77783, and more specifically Compounds II-1 to II-102 listed on pages 10 to 27 of the specification;

the compounds expressed by the general formulae (H) and (Ha) of JP-A-7-104426, and more specifically Compounds H-1 to H-44 listed on pages 8 to 15 of the specification;

the compounds having in the vicinity of a hydrazine group an anionic group or nonionic group capable or forming a intra-molecular hydrogen bond with a hydrogen atom of hydrazine as disclosed in JP-A-9-22082, particularly those expressed by the general formulae (A) to (F), and more specifically Compounds N-1 to N-30;

the compounds expressed by the general formula (1) of JP-A-9-22082, and more specifically Compounds D-1 to D-55;

In addition, various hydrazine derivatives listed on pages 25 to 34 of "Kochi Gijutsu (Prior Art) p. 1 to 207)", published by Astech, Mar. 22, 1991; and Compounds D-2 and D-39 on pages 6 to 7 of JP-A-62-86354.

The hydrazine derivatives preferably used in the present invention can be used as dissolved in an appropriate organic solvent such as alcohols (methanol, ethanol, propanol, fluorinated alcohol), ketones (acetone, methyl ethyl ketone), dimethylformamide, dimethylsulfoxide or Methyl Cellosolve.

The hydrazine derivatives can also be used in a form of emulsified dispersion obtained mechanically by the well-known emulsifying dispersion method by which the compounds are dissolved in oil such as dibutyl phthalate, tricresyl phosphate, glyceryl triacetate and diethyl phthalate; or in auxiliary solvent such as ethyl acetate and cyclohexanone. Alternative method relates to the solid dispersion method by which powders of the hydrazine derivative are dispersed into water with aid of a ball mill, colloid mill or ultrasonic wave.

The hydrazine derivatives preferably used in the present invention can be added to any layer provided on the same side of the image producing layer as viewed from a support, where addition to the image producing layer or to the layer adjacent thereto is preferable.

The amount of addition of the hydrazine derivatives per mol of silver is preferably from $1\times10^{-6}$ to $1\times10^{-2}$ mol, and more preferably from $1\times10^{-5}$ to $5\times10^{-3}$ mol, and still more preferably from $2\times10^{-5}$ to $5\times10^{-3}$ mol.

In the present invention, a contrast accelerator may be used in combination with the above-described nucleation aid so as to produce an ultrahigh contrast image. Examples thereof include amine compounds described in U.S. Pat. No. 5,545,505, specifically, AM-1 to AM-5; hydroxamic acids described in U.S. Pat. No. 5,545,507, specifically, HA-1 to HA-11; acrylonitriles described in U.S. Pat. No. 5,545,507, specifically, CN-1 to CN-13; hydrazine compounds described in U.S. Pat. No. 5,558,983, specifically, CA-1 to CA-6; and onium salts described in JP-A-9-297368, specifically, A-1 to A-42, B-1 to B-27 and C-1 to C-14.

In the photothermographic material containing a non-photosensitive silver salt, a photosensitive silver halide and a binder, formic acid or formate can act as a strong foggant. Thus in the present invention, the content of formic acid or formate in any layer on the same side with the image producing layer containing the photosensitive silver halide is preferably 5 mmol or below per mol of silver, and more preferably 1 mmol or below.

For the thermally processed image forming material of the present invention, it is preferable to use, in combined with the nucleation aid, an acid produced by hydration of phosphorus pentoxide or a salt thereof. An acid produced by hydration of phosphorus pentoxide or a salt thereof include metaphosphoric acid (metaphosohate), pyrophosphoric acid (pyrophosphate), orthophosphoric acid (orthophosphate), triphosphoric acid (triphosphate), tetraphosphoric acid (tetraphosphate), and hexametaphosphoric acid (hexametaphosphate), among which orthophosphoric acid (orthophosphate) and hexametaphosphoric acid (hexametaphosphate) being more preferable. The salts are specified as sodium orthophosphate, sodium dihydrogenorthophosphate, sodium hexametaphosphate and ammonium hexametaphosphate.

An acid produced by hydration of phosphorus pentoxide or a salt thereof preferably used in the present invention is added to the image producing layer or the adjacent binder-containing layer in terms of exhibiting a desired effect in a minimum amount of use.

While an amount of use (an amount of coating per $m^2$ of the image recording material) of an acid produced by hydration of phosphorus pentoxide or a salt thereof can be used in a desired amount considering the properties such as sensitivity and fog, a preferable amount resides in a range from 0.1 to 500 $mg/m^2$, and more preferably 0.5 to 100 $mg/m^2$.

The thermally processed image forming material of the present invention contains the reducing agent for reducing the organic silver salt. The reducing agent may be arbitrary substance capable of reducing silver ion into metal silver, and preferably an organic substance. While conventional photographic developers such as phenidone, hydroquinone and catechol are useful, a hindered phenol reducing agent is preferred. The reducing agent is preferably contained in an amount of from 5 to 50 mol %, more preferably from 10 to 40 mol % per mol of silver presents in the face where the image-forming layer is provided. A layer to which the reducing agent is added may be any layer on the same side with the image producing layer on the substrate. In the case of adding the reducing agent to a layer other than the image producing layer, the reducing agent is preferably used in a slightly larger amount of from 10 to 50 mol % per mol of silver. The reducing agent may also be a so-called precursor which is devised to effectively exhibit its function only at the time of development.

For photothermographic material using a fatty acid silver salt, a wide variety of reducing agents are known, for example, in JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-1023721, JP-A-51-32324, JP-A-51-51933, JP-A-52-84727, JP-A-55-108654, JP-A-56-146133, JP-A-57-82828, JP-A-57-82829, JP-A-6-3793, U.S. Pat. No. 3,679,426, No. 3,751,252, No. 3,751,255, No. 3,761,270, No. 3,782,949, No. 3,839,048, No. 3,928,686 and No. 5,464,738, German Patent No. 2,321,328 and European Patent No. 692,732. Examples thereof include amidoximes such as phenylamidoxime, 2-thienylamidoxime and p-phenoxyphenyl-amidoxime; azines such as 4-hydroxy-3,5-dimethoxybenzaldehyde azine; combinations of an aliphatic carboxylic acid arylhydrazide with an ascorbic acid, such as a combination of 2,2'-bis(hydroxymethyl)propionyl-β-phenylhydrazine with ascorbic acid; combinations of polyhydroxybenzene with hydroxylamine, reductone and/or hydrazine (e.g. combination of hydroquinone with bis(ethoxyethyl)hydroxylamine, piperidinohexose reductone orformyl-4-methylphenylhydrazine; hydroxamic acids such as phenylhydroxamic acid, p-hydroxyphenylhydroxamic acid and β-anilinehydroxamic acid; combinations of azine with sulfonamidophenol such as a combination of phenothiazine with 2,6-dichloro-4-benzenesulfonamidophenol; α-cyancphenylacetic acid derivatives such as ethyl-α-cyano-2-methylphenyl acetate and ethyl-α-cyanophenyl acetate; bis-β-naphthols such as 2,2'-dihydroxy-1,1'-binaphthyl, 6,6'-dibromo-2,21-dihydroxy-1,1'-binaphthyl and bis(2-hydroxy-1-naphthyl)methane; combinations of bis-β-naphthol with 1,3-dihydroxybenzene derivative (e.g., 2,4-dihydroxybenzophenone or 2',4'-dihydroxyacetophenone); 5-pyrazolones such as 3-methyl-1-phenyl-5-pyrazolone; reductones such as dimethylaminohexose reductone, anhydrodihydroaminohexose reductone and anhydrodihydropiperidonehexose reductone; sulfonamidophenol reducing agents such as 2,6-dichloro-4-benzene-sulfonamidophenol and p-benzenesulfonamidophenol; 2-phenylindane-1,3-diones; chromans such as 2,2-dimethyl-7-t-butyl-6-hydroxychroman; 1,4-dihydropyridines such as 2,6-dimethoxy-3,5-dicarbo-ethoxy-1,4-dihydropyridine; bisphenols such as bis (2-hydroxy-3-t-butyl-5-methylphenyl)methane, 2,2-bis(4-hydroxy-3-methyl-phenyl)propane, 4,4-ethylidene-bis(2-t-butyl-6-methylphenol), 1,1-bis(2-hydroxy-3,5-dimethylphenyl)-3,5,5-trimethylhexane and 2,2-bis(3,5-dimethyl-4-hydroxyphenyl)propane; ascorbic acid derivatives such as 1-ascorbyl palmitate and ascorbyl stearate; aldehydes and ketones such as benzyl and biacetyl; 3-pyrazolidone and a certain kind of indane-1,3-diones; and chromanols (e.g. tocopherol). Particularly preferred reducing agents are bisphenols and chromanols.

The reducing agent used in the present invention may be added in any form of solution, powder or solid micrograin dispersion. Dispersion of the solid micrograin is effected using a known pulverizing means (e.g. ball mill, vibrating ball mill, sand mill, colloid mill, jet mill and roller mill). A dispersing agent may be available for dispersing the solid micrograin.

In the present invention, a phenol derivative expressed by the general formula (A) of JP-A-11-73951 is preferably used as a development accelerator. The phenol derivative expressed by the general formula (A) can exhibit a strong development accelerating effect when used in combination with the foregoing reducing agent. Preferable examples are specified as Compounds A-1 to A-54 in the same specification. The phenol derivative expressed by the general formula (A) is used in an amount of 0.01 to 100 mol % with respect to the reducing agent, and more preferably 0.1 to 20 mol %.

The phenol derivative expressed by the general formula (A) can be added to the image producing layer or any other layer provided on the same side therewith as viewed from a support, where addition to a layer containing the reducing agent is preferable.

The phenol derivative expressed by the general formula (A) used in the present invention may be added in any form of solution, powder or solid micrograin dispersion. Dispersion of the solid micrograin is effected using a known pulverizing means (e.g. ball mill, vibrating ball mill, sand mill, colloid mill, jet mill and roller mill). A dispersing agent may be available for dispersing the solid micrograin.

Using an additive known as a color toner may sometimes raise the optical density and preferable in the present invention. In some cases the color toner is even advantageous in forming a blackened silver image. The color toner is preferably contained in elsewhere on the side having the image forming layer in an amount of 0.1 to 50 mol % per mol of silver, and more preferably 0.5 to 20 mol %. The color toner may also be a so-called precursor which is devised to effectively exhibit its function only at the time of development.

As for the photothermographic material using the fatty acid silver salt, a wide variety of the color toners are disclosed, for example, in JP-A-46-6077, JP-A-47-10282, JP-A-49-5019, JP-A-49-5020, JP-A-49-92215, JP-A-50-2524, JP-A-50-32927, JP-A-50-67132, JP-A-50-67641, JP-A-50-114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, JP-B-49-10727, JP-B-54-20333, U.S. Pat. No. 3,080,254, No. 3,446,648, No. 3,782,941, No. 4,123,282 and No. 4,510,236, British Patent No. 1,380,795 and Belgian Patent No. 841,910. Examples of the color toner include phthalimide and N-hydroxyphthalimide; cyclic imides such as succinimide, pyrazoline-5-one, quinazolinone, 3-phenyl-2-pyrazoline-5-one, 1-phenylurazole, quinazoline and 2,4-thiazolinedione; naphthalimide (e.g., N-hydroxy-1,8-naphthalimide); cobalt complex (e.g., cobalthexamine trifluoroacetate); mercaptans such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboxyimide (e.g., N,N-(dimethylaminomethyl)phthalimide and N,N-(dimethylaminomethyl)naphthalene-2,3-dicarboxyimide); blocked pyrazole, isothiuronium derivatives and a certain kind of photofading agent [e.g., N,N'-hexamethylenebis(1-carbamoyl-3,5-dimethylpyrazole, 1,8-(3,6-diazaoctane)bis(isothiuronium trifluoroacetate) and 2-tribromomethylsulfonyl)benzothiazole]; 3-ethyl-5-[(3-ethyl-2-benzothiazolinilidene)-1-methylethylidene]-2-thio-2,4-oxazolidinedione; phthalazinone, phthalazinone derivatives or metal salts; or the derivatives such as 4-(1-naphthyl)phthalazinone, 6-chlorophthalazinone, 5,7-dimethoxyphthalazinone or 2,3-dihydro-1,4-phthalazinedione; combinations of phthalazinone and phthalic acid derivatives (e.g., phthalic acid, 4-methyltphthalic acid, 4-nitrophthalic acid and tetrachlorophthalic anhydride); phthalazines, phthalazine derivatives or metal salts; combinations of phthalazine and phthalic acid derivatives (e.g., phthalic acid, 4-methyltphthalic acid, 4-nitrophthalic acid and tetrachlorophthalic anhydride); quinazolinedione, benzoxazine or natphthoxazine derivatives; rhodium complex serves, not only functions as a color toner, but also as an in situ halide ion source for producing silver halide, such as ammonium hexachlororhodate (III), rhodium bromide, rhodium nitrate and potassium hexachlororhodate (III); inorganic peroxides and persulfates such as ammonium disulfide peroxide and hydrogen peroxide; benzoxazine-2,4-diones such as 1,3-benzoxazine-2,4-dione, 8-methyl-1,3-benzoxazine-2,4-dione and 6-nitro-1,3-benzoxazine-2,4-dione; pyrimidines and asymmetric triazine (e.g., 2,4-dihydroxypyrimidine and 2-hydroxy-4-aminopyrimidine); azauracil; and tetraazapentalene derivatives (e.g., 3,6-dimercapto-1,4-diphenyl-1H,4H-2,3a,5,6a-tetraazapentalene and 1,4-di(o-chlorophenyl)-3,6-dimercapto-1H,4H-2,3a,5,6a-tetraazapentalene).

In the present invention, a phthalazine derivative expressed by the general formula (F) of JP-A-2000-35631 is preferably used as a color toner. Preferable examples are specified as Compounds A-1 to A-10 in the same specification.

The color toner may be added in any form of solution, powder or solid micrograin dispersion. Dispersion of the solid micrograin is effected using a known pulverizing means (e.g., ball mill, vibrating ball mill, sand mill, colloid mill, jet mill and roller mill). A dispersing agent may be available for dispersing the solid micrograin.

The pH of the surface of the thermally processed image forming material of the present invention is preferably adjusted to 6.0 or below, and more preferably 5.5 or below. The lower limit is set at approx. pH 3, while not being limited thereto.

Using an organic acid such as phthalic acid, non-volatile acid such as sulfuric acid, or volatile base such as ammonia is preferable from the viewpoint of reducing pH of the surface. Ammonia is particularly preferable to attain a low pH of the surface since it is highly volatile and can easily be removed before the coating or heat development processes. A method for measuring pH is disclosed in the paragraph [0123] of JP-A-11-87297.

The silver halide emulsion and/or organic silver salt for use in the present invention can successfully be prevented, by addition of antifoggant, stabilizer or stabilizer precursor, from additional fogging and from lowered sensitivity during the stock storage. Appropriate examples of antifoggants, stabilizers and stabilizer precursors, available individually or in combination, include thiazonium salts described in U.S. Pat. Nos. 2,131,038 and 2,694,716; azaindenes described in U.S. Pat. Nos. 2,886,437 and 2,444,605; mercury salts described in U.S. Pat. No. 2,728,663; urazoles described in U.S. Pat. No. 3,287,135; sulfocatechol described in U.S. Pat. No. 3,235,652; oximes, nitrons and nitroindazoles described in British Patent No. 623,448; polyvalent metal salts described in U.S. Pat. No. 2,839,405; thiuronium salts described n U.S. Pat. No. 3,220,839; palladium, platinum and gold salts described in U.S. Pat. Nos. 2,566,263 and 2,597,915; halogen-substituted organic compounds described in U.S. Pat. Nos. 4,108,665 and 4,442,202; triazines described in U.S. Pat. No. 4,128,557, No. 4,137,079, No. 4,138,365 and No. 4,459,350; and phosphorus compounds described in U.S. Pat. No. 4,411,985.

The photothermographic material of the present invention may contain a benzoic acids for improving the sensitivity and for preventing fog. Any kind of benzoic acid derivatives are available for the present invention, where preferred examples of the structure include those described in U.S. Pat. Nos. 4,784,939 and 4,152,160 and JP-A-9-329863, JP-A-9-329864 and JP-A-9-281637. Although the benzoic acids for use in the present invention may be added to any portion of the photosensitive material, addition to a layer provided on the same side with the photosensitive layer is preferable, and to a layer containing the fatty acid silver salt is more preferable. The benzoic acids may be added at any step during the preparation of the coating liquid. In the case of addition to the layer containing the fatty acid silver salt, the benzoic acids may be added at any step within a period from the preparation of the fatty acid silver salt to the preparation of the coating liquid, where addition in a period following the preparation of the fatty acid silver salt and immediately before the coating is preferable. The benzoic acids may be added in any form of solution, powder or solid micrograin dispersion. It is also allowable to add the benzoic acids in a form of mixed solution containing other additives such as a sensitizing dye, reducing agent and color toner. The amount of addition or the benzoic acids can arbitrarily be selected, where a preferable range being from $1\times10^{-6}$ to 2 mol per mol of silver, and more preferably from $1\times10^{-3}$ to 0.5 mol.

While not being essential for implementing the present invention, it is advantageous in some cases to add a mercury (II) salt as an antifoggant to the emulsion layer. Preferred mercury(II) salts for this purpose are mercury acetate and mercury bromide. The amount of addition of mercury for use in the present invention is preferably from $1\times10^{-9}$ to $1\times10^{-3}$ per mol of silver coated, and more preferably from $1\times10^{-8}$ to $1\times10^{-4}$ mol.

An antifoggant which is most preferably used in the present invention is organic halide, and the typical examples thereof are disclosed in JP-A-50-119624, JP-A-50-120328, JP-A-31-l21332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809 and U.S. Pat. No. 5,340,712, No. 5,369,000 and No. 5,464,737.

An example of the preferable antifoggant is typically disclosed as a hydrophilic organic halide as expressed by the general formula (P) of JP-A-11-87297, specific examples thereof being Compounds (P-1) to (P-118) listed in the same specification.

The amount of addition of the organic halide, as expressed in a molar amount per mol of silver (mol/mol Ag), is preferably $1\times10^{-5}$ to 2 mol/mol Ag, more preferably $5\times10^{-5}$ to 1 mol/mol Ag, and still more preferably $1\times10^{-4}$ to $5\times10^{-1}$ mol/mol Ag. These compounds may be used individually, or in combination of two or more species.

A salicylic acid derivative expressed by the general formula (Z) of JP-A-11-87297 is also a preferable antifoggant, which are specified as Compounds (A-1) to (A-60) in the same specification.

The amount of addition of the salicylic acid derivative expressed by the general formula (Z), as expressed in a molar amount per mol of silver (mol/mol Ag), is preferably $1\times10^{-5}$ to $5\times10^{-1}$ mol/mol Ag, more preferably $5\times10^{-5}$ to $1\times10^{-1}$ mol/mol Ag, and still more preferably $1\times10^{-4}$ to $5\times10^{-2}$ mol/mol Ag. These compounds may be used individually, or in combination of two or more species.

The antifoggant for use in the present invention can be used as dissolved in water or other appropriate organic solvents such as alcohols (methanol, ethanol, propanol, fluorinated alcohol), ketones (acetone, methyl ethyl ketone), dimethylformamide, dimethylsulfoxide and Methyl Cellosolve.

The antifoggant can also be used in a form of emulsified dispersion obtained mechanically by the well-known emulsifying dispersion method by which the compounds are dissolved in oil such as dibutyl phthalate, tricresyl phosphate, glyceryl triacetate and diethyl phthalate; or in auxiliary solvent such as ethyl acetate and cyclohexanone. Alternative method relates to the solid dispersion method by which powders of the compounds are dispersed into water with aid off a ball mill, colloid mill, sand grinder mill, manthone galling, microfluidizer or ultrasonic wave.

The antifoggant can be added to the image producing layer or any other layer provided on the same side therewith as viewed from a support, where addition to the image producing layer or the adjacent layer is preferable. The image producing layer refers to a layer containing a reducible silver salt (organic silver salt), and more preferably to a photosensitive layer containing a photosensitive silver halide.

The photothermographic material of the present invention may contain mercapto compound, disulfide compound or thione compound so as to control the development by inhibiting or accelerating thereof, to improve the spectral sensitization efficiency, or to improve the storage stability before and after the development.

While any structure of mercapto compound may be available in the present invention, such that expressed by Ar—SM or Ar—S—S—Ar is preferable, wherein M represents a hydrogen atom or alkali metal atom; and Ar represents an aromatic ring or condensed aromatic ring containing one or more nitrogen, sulfur, oxygen, selenium or tellurium atoms. Preferable heteroaromatic rings include benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have a substituent selected from, for example, the group consisting of halogen (e.g., Br, Cl); hydroxyl, amino; carboxyl, alkyl (e.g., alkyl having one or more carbon atoms, preferably from 1 to 4 carbon atoms), alkoxy (e.g., alkoxy having one or more carbon atoms, preferably from 1 to 4 carbon atoms) and aryl (which may also be substituted). Examples of the mercapto-substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 1-phenyl-5-mercaptotetrazole, sodium 3-(5-mercaptotetrazole)benzenesulfonate: N-methyl-N'-[3-(5-mercaptotetrazolyl)phenyl]urea, and 2-mercapto-4-phenyloxazole, while not particularly being limited thereto. The amount of the addition of the mercapto compounds, as expressed in an amount per mol of silver in the emulsion layer, is preferably from 0.0001 to 1.0 mol per one mol of silver, more preferably from 0.001 to 0.3 mol.

Polymer latex as described below is preferably employed as a binder for use in the thermally processed image forming material of the present invention.

In the present invention, at least one layer of the image-forming layer is preferably such that containing the polymer latex at 50 wt % or more of the total binder (such image producing layer will be referred as "image producing layer in the present invention", and such polymer latex used as a binder will be referred as "polymer latex used in the present invention" hereinafter). The polymer latex can be used not only for the image producing layer, but also for the protective layer and back layer. Using the polymer latex for the protective layer and back layer is favorable when the thermally processed image forming material of the present invention is applied to printing where dimensional variation is noted as a critical issue. Now, the "polymer latex" in the context of this specification is defined as a water-insoluble hydrophobic polymer being dispersed as fine particles in a water-soluble dispersion medium. The dispersion may have any form of polymer emulsified in dispersion medium, emulsion-polymerized or dispersed as micells; or the polymer can be dispersed so that its molecular chain per se disperses when the polymer has, in a part of its body, some hydrophilic structure. Details for such polymer latex available in the present invention are found, for example, in "Gosei Jushi Emulsion (Synthetic Resin Emulsion)", ed. by Taira Okuda and Hiroshi Inagaki, issued by Kobunshi Kanko Kai (1978); "Gosei Latex no O-yo (Applications of Synthetic Latex)", ed. by Takaaki Sugimura, Yasuo Kataoka, Souichi Suzuki and Keiji Kasahara, issued by Kobunshi Kanko Kai (1993); and Soichi Muroi, "Gosei Latex no Kagaku (Chemistry of Synthetic Latex)", issued by Kobunshi Kanko Kai (1970). The dispersed particles preferably have an average grain size of 1 to 50,000 nm, more preferably approx. 5 to 1,000 nm. The grain size distribution of the dispersed particles is not particularly limited, and the dispersed particles may have a broad grain size distribution or a manodisperse grain size distribution.

As the polymer latex for use in the present invention, not only an ordinary uniform-structured polymer latex but also a so-called core/shell type latex are available. In some cases, it is preferred that the core and the shell have different glass transition points.

Preferable range of the glass transition point (Tg) of the polymer latex preferably used as a binder in the present invention will differ according to its use for the protective layer, back layer or image producing layer. For use in the image producing layer, the glass transition point is preferably be selected from −30 to 40° C. so as to promote the diffusion of the photographically useful material during the heat development. For use in the protective layer and back layer, a glass transition point of 25 to 70° C. is preferable since the layers come into contact with various kinds of equipment.

The polymer latex for use in the present invention preferably has a minimum film-forming temperature (MFT) of from −30 to 90° C., more preferably from 0 to 70° C. In order to control the MFT, a film-forming aid may be added. The film-forming aid, also called a plasticizer, refers to an organic compound (usually an organic solvent) capable of lowering the MFT or the polymer latex, which is described in "Gosei Latex no Kagaku (Chemistry of Synthetic Latex)", by Souichi Muroi, issued by Kobunshi Kanko Kai (1970), supra.

The polymer species of the polymer latex for use in the present invention include acrylic resin, vinyl acetate resin, polyester resin, polyurethane resin, rubber-based resin, vinyl chloride resin, vinylidene chloride resin, polyolefin resin or copolymers thereof. The polymer may be a straight-chaired polymer, a branched polymer or a cross-linked polymer. The polymer may be a so-called homopolymer consisting of a single kind of monomer or may be a copolymer consisting of two or more kinds of monomers. Both of random copolymer and block copolymer are allowable as the copolymer. The polymer preferably has a number average molecular weight of from 5,000 to 1,000,000, and more preferably from 10,000 to 100,000. Too small molecular weight will result in poor mechanical strength of the image producing layer, whereas too large in degraded and undesirable film-forming property.

Specific examples of the polymer latex for use in the present invention include methyl methacrylate/ethyl acrylate/methacrylic acid copolymer latex, methyl methacrylate/2-ethylhexyl acrylate/styrene/acrylic acid copolymer latex, styrene/butadiene/acrylic acid copolymer latex, styrene/butadiene/divinylbenzene/methacrylic acid copolymer latex, methyl methacrylate/vinyl chloride/acrylic acid copolymer latex, and vinylidene chloride/ethyl acrylate/acrylonitrile/methacrylic acid copolymer latex. Such polymers are also commercially available, which include acrylic resins such as CEBIAN A-4635, 46583 and 4601 (all produced by Dicel Chemical Industries, Ltd.) and Nipol Lx811, 814, 821, 820, 857 (all produced by Nippon Zeon KK); polyester resins such as FINETEX ES650, 611, 675, 850 (all produced by Dai-Nippon Ink & Chemicals, Inc.), WD-size and WMS (both produced by Eastman Chemical); polyurethane resins such as EYDRAN AP10, 20, 30, 40 (all produced by Dai-Nippon Ink & Chemicals, Inc.); rubber-based resins such as LACSTAR 7310K, 3307B, 4700H, 7132C (all produced by Dai-Nippon Ink & Chemicals, Inc., Nipol Lx416, 410, 438C and 2507 (all produced by Nippon Zeon KK); vinyl chloride resins such as G351, G576 (both produced by Nippon Zeon KK); vinylidene chloride resins such as L502, L513 (both produced by Asahi Chemical Industry Co., Ltd.), ARON D7020, D504 and D5071 (all produced by Mitsui Chemical Co., Ltd.); and olefin resins such as CHEMIPEARL S120 and SA100 (both produced by Mitsui Chemical Co., Ltd.). These polymers may be used individually or, as required, as a blend of two or more species.

In the image producing layer in the present invention, the polymer latex preferably accounts for 50 wt % or more of the total binder, and more preferably 70 wt % or more.

To the image producing layer in the present invention, it is allowable to add, as required, hydrochilic polymer such as gelatin, polyvinyl alcohol, methylcellulose, hydroxypropylcellulose, carboxymethylcellulose, and hydroxypropylmethylcellulose. The amount of addition of these hydrophilic polymers is preferably 30 wt % or less of the total binder of the image producing layer, and more preferably 15 wt % or less.

It is preferable that the image producing in the present invention is formed by coating a water-base liquid, which is followed by drying. Here, "water-base" in the context of the present invention refers to that water accounts for 60 wt % or more of the solvent (dispersion medium) of the coating liquid. Possible component other than water may be water-miscible organic solvent such as methanol, ethanol, isopropanol, Methyl Cellosolve, Ethyl Cellosolve, dimethylformamide and ethyl acetate. Specific examples of the solvent composition include water/methanol=90/10, water/methanol=70/30, water/ethanol=90/10, water/isopropanol=90/10, water/dimethylformamide=95/5, water/methanol/dimethylformamide=80/15/5 and water/methanol/dimethylformamide=90/5/5 (the numerals are in wt %).

A combination of polymer latexes with different I/O values is preferably used as a binder for the protective layer, where the I/O value is defined as an inorganicity value divided by an organicity value, both values being found in a conceptional organicity chart described in the paragraphs [0025] to [0029] of JP-A-11-6872.

It is also allowable to form the individual layers using a first polymer latex being introduced with a functional group described in the paragraphs [0023] to [0041] of JP-A-2000-19678, together with a crosslinking agent and/or a second polymer latex having a functional group capable of reacting with the first polymer latex Examples of such functional group include carboxyl group, hydroxyl group, isocyanate group, epoxy group, N-methylol group and oxazolinyl group; and examples of such crosslinking agent include epoxy compounds, isocyanate compounds, block isocyanate compounds, methylol compounds, hydroxyl compounds, carboxyl compounds, amino compounds, ethyleneimine compounds, aldehyde compounds and halogen compounds. More specifically, examples of the crosslinking agent include isocyanate compounds such as hexamethylene isocyanate, Duranate B40-80D, WX-1741 (products of Asahi Chemical), Bayhidur 3100 (Sumitomo Bayer Urethane Co., Ltd.), Takenate WD725 (Takeda Chemical Industries, Ltd.), Aquanate 100, 200 (Nippon Polyurethane Industry Co., Ltd,), and water-dispersed polyisocyanate disclosed in JP-A-9-160172; amino compound such as Sumitex Resin M-3 (Sumitono Chemical); epoxy compound such as Denacol EX-614B (Nagase Chemicals, Ltd.); and halogen compound such as sodium 2,4-dichloro-6-hydroxy-1,3,5-triazine.

The amount of total birder in the image producing layer in the present invention is preferably 0.2 to 30 g/m$^2$, and more preferably 1.0 to 15 g/m$^2$.

The amount of total binder in the protective layer in the present invention is preferably 0.2 to 10.0 g/m$^2$, and more preferably 0.5 to 6.0 g/m$^2$.

The amount of total binder in the back layer in the present invention is preferably 0.01 to 10.0 g/m$^2$, and more preferably 0.05 to 5.0 g/m$^2$.

In some cases, these layers are provided in two or more layers. For the case that two or more image producing layer are provided, it is preferable to use the polymer latex for the binder of all layers. The protective layer is provided, sometimes in two or more layers, on the image producing layer, in which in is preferable to use the polymer latex at least in one protective layer, and in particular in the outermost one. The back layer is provided, sometimes in two or more layers, on the undercoated layer on the rear surface of the substrate, in which it is preferable to use the polymer latex at least in one back layer, and in particular in the outermost one.

The image producing layer may be added with a crosslinking agent for crosslinking or a surfactant for improving coating property.

There is no particular limitation on the species of a smoothing agent used in the present invention, and may be of any compound provided that it can reduce a friction coefficient of a solid surface when applied thereon as compared with that for a solid surface not applied with such compound.

Specific examples of the smoothing agent are typified as those described in the paragraphs [0061] to [0064] of JP-A-11-84573, and the paragraphs [0049] to [0062] of JP-A-11-106881.

Preferable smoothing agents are available as Cellosol 524 (major component: carnauba wax), Polyron A, 393, H-481 (major component: polyethylene wax), Himicron G-110 (major component: ethylene bisstearate amide), Himicron G-270 (major component: amide stearate) (all produced by Chukyo Yushi K.K.) and the compounds expressed by the formula below:

W-1: $C_{16}H_{33}$—O—$SO_3Na$, and

W-2: $C_{18}H_{37}$—O—$SO_3Na$.

The amount of addition of the smoothing agent is preferably 0.1 to 50 wt % of the binder in the target layer, and more preferably 0.5 to 30 wt %.

Heat development of the thermally processed image forming material of the present invention can be effected using, for example, a heat developing apparatus as disclosed in JP-A-2000-171935 and JP-A-11-106881, in which in the preheating zone the recording material is conveyed with opposed rollers, and in the heat developing zone the material is conveyed so that the top surface of the image producing layer side thereof is roller-driven, and the opposite side is slid on a smooth plane. In such development process, a ratio of friction coefficients of the top surface of the image producing layer and the surface of the back layer, at the development temperature, is selected as 1.5 or above, and at most 30 or around, although the upper limit being not specifically limited. A dynamic friction coefficient of the back layer ($\mu b$) is preferably 1.0 or below, and more preferably 0.8 to 0.05, which can be obtained from the equation below:

$$\text{ratio of friction coefficient}=\mu e/\mu b$$

where, $\mu e$=dynamic friction coefficient between the roller members of the heat developing apparatus and the top surface of the image producing layer side; and $\mu b$=dynamic friction coefficient between the smooth plane member and the surface of the back layer.

The sliding property between the contact members of the heat developing apparatus and the outermost layers of the image producing layer side and/or the rear side can be adjusted by adding the smoothing agent to the outermost layers and by controlling the amount of addition thereof.

On both surfaces of the support of the thermally processed image forming material of the present invention, it is preferable to provide an undercoat layer containing a vinylidene chloride copolymer containing a repetitive unit of vinylidene chloride monomer at 70 wt % or above. Such copolymer is disclosed, for example, in JP-A-64-20544, JP-A-1-180537, JP-A-1-2094431 JP-A-1-285939, JP-A-1-296243, JP-A-2-24649, JP-A-2-24648, JP-A-2-184844, JP-A-3-109545, JP-A-3-137637, JP-A-3-141346, JP-A-3-141347, JP-A-4-96055, U.S. Pat. No. 4,645,731, JP-A-4-68344, from line 20 in the right column on page 2 to line 30 in the right column on page 3 of Japanese Patent No. 2,557,641, paragraphs from [0020] to [0037] of JP-A-2000-39684, and paragraphs from [0063] to [0080] of JP-A-11-106881.

The amount of vinylidene chloride monomer of less than 70 wt % will result in insufficient moisture resistance, and will cause a large dimensional changes with time after the heat development. The vinylidene chloride copolymer preferably contains, as a repetitive unit other than the vinylidene chloride monomer, a repetitive unit of a vinyl monomer containing a carboxyl group. This is because a polymer consisting of vinyl chloride monomers only may crystallize, which makes it difficult to form a uniform moisture-proof layer by coating, and also because the vinyl chloride monomer containing the carboxyl group is indispensable for stabilizing the polymer.

The molecular weight of the vinylidene chloride copolymer, as expressed in an weight average molecular weight, is preferably 45,000 or below, and more preferably 10,000 to 45,000. Too large molecular weight may degrade the adhesiveness of the vinylidene chloride layer and the support made of polyester or the like.

Content of the vinylidene chloride, as expressed in the total thickness of the undercoat layers containing thereof on one side of the support, is 0.3 $\mu$m or above, and more preferably 0.3 to 4 $\mu$m.

The vinylidene chloride copolymer layer as an undercoat layer is preferably provided as a first layer formed directly on the support, and may be provided in two or more layers, while one layer each on both sides of the support being the general practice. When two or more layers are provided, total amount of the vinylidene chloride copolymer will be adjusted within the desired range.

The undercoat layer may contain, besides the vinylidene chloride copolymer, a crosslinking agent or matting agent.

On the substrate, it is optionally allowable to form, by coating, an undercoat layer containing SBR (styrene butadiene rubber), polyester or gelatin as a binder, in addition to the vinylidene chloride copolymer layer. These undercoat layers can be formed in a multi-layered structure, and can be provided either on the single side or both sides of the support. Typical thickness of the undercoat layer (per layer) is 0.01 to 5 $\mu$m, and more preferably 0.05 to 1 $\mu$m.

A variety of supports are available for the thermally processed image forming material of the present invention. Typical materials for the support include polyesters such as polyethylene terephthalate and polyethylene naphthalate; cellulose nitrate; cellulose ester; polyvinyl acetal; syndiotactic polystyrene; polycarbonate; and paper having both plane thereof coated with polyethylene. Among these, a biaxially stretched polyester, in particular such polyethylene terephthalate (PET) is preferable in terms of its excellent dimensional stabiity and chemical resistance. The thickness of the support, excluding that of the undercoat layer, is preferably 90 to 180 $\mu$m.

As the support of the thermally processed image forming material of the present invention, preferably used is a polyester film, and in particular polyethylene terephthalate film, annealed at 130 to 185° C. to relax residual internal stress caused by the biaxial stretching and thereby to prevent heat-shrinking distortion during the heat development; such film typically disclosed in JP-A-10-48772, JP-A-10-10676, JP-A-10-10677, JP-A-11-65025 and JP-A-11-138643.

Rate of dimensional change of the support after annealed at 120° C. for 30 seconds is preferably −0.03 to +0.01% in the moving direction (MD) and 0 to +0.04% in the transverse direction (TD).

The thermally processed image forming material of the present invention can be treated by antistatic processing in order to reduce dust adhesion, to prevent static mark from occurring, and to avoid conveyance failure in an automatic conveying process, the antistatic processing being effected with an electro-conductive metal oxide and/or fluorine-containing surfactant disclosed in the paragraphs from [0040] to [0051] of JP-A-11-84573.

Preferable examples of the electro-conductive metal oxide include an antimony-doped needle-like electro-conductive stannic oxide disclosed in U.S. Pat. No. 5,575,957 and the paragraphs from [0012] to [0020] of JP-A-11-223901; and an antimony-doped fibrous stannic oxide disclosed in JP-A-4-29134.

The surface specific resistivity (surface resistivity) of a layer containing such metal oxide is $10^{12}$ Ω or below, and more preferably $10^{11}$ Ω or below in an atmosphere of 25° C., 20% RH (relative humidity), which ensures an excellent antistatic property. A lower limit of the surface resistivity is $10^{7}$ Ω or around in general, while not being limited specifically.

In the present invention, it is preferable that at least either one, and more preferably both, of the outermost layers on the image producing layer side and the opposite side thereof of the thermally processed image forming material has a Bekk smoothness of 2,000 seconds or below, and more preferably 10 to 2,000 seconds.

The Bekk smoothness in the present invention will readily be obtained according to Japanese Industrial Standard (JIS) P8119 "Paper and board—Determination of smoothness by Bekk method" and TAPPI standard method T479.

Bekk smoothness of the outermost layers on the image producing layer side and the opposite side thereof of the thermally processed image forming material can be controlled by properly adjusting the grain size and the amount of addition of a matting agent included in such layers, as disclosed in the paragraphs from [0052] to [0059] of JP-A-11-84573.

In the present invention, the undercoat layer and/or back layer may contain a dye for an antihalation purpose as discussed in the paragraphs from [0204] to [0208] of JP-A-11-84573, and the paragraphs from [0240] to [0241] of JP-A-11-106881.

The thermally processed image forming material of the present invention preferably contains a photosensitive silver halide. There is no specific limitation on the halogen composition of the photosensitive silver halide, and examples of which include silver chloride, silver chlorobromide, silver bromide, silver iodobromide and silver iodochlorobromide. Halogen composition distribution within the grain may be uniform, or may change stepwise or continuously. Silver halide grain with a core/shell structure may also preferably be used, in which the structure thereof is preferably of from double-shelled to quintuple-shelled, and more preferably of from double-shelled to quadruple-shelled. It is also preferable to adopt a technique for localizing silver bromide on the surface of silver chloride or silver chlorobromide.

Methods for preparing photosensitive silver halide are well known in the art, and, for example, the methods described in Research Disclosure, No. 17029 (June, 1978) and U.S. Pat. No. 3,700,458 may be applied. More specifically, photosensitive silver halide is prepared by adding a silver source compound and a halogen source compound in a solution containing gelatin or other polymer, which is followed by addition of an organic acid silver salt. The photosensitive silver halide grain preferably has a small grain size so as to avoid haze after image production. Specifically, the grain size is preferably 0.20 μm or less, more preferably from 0.01 to 0.15 μm, still more preferably from 0.02 to 0.12 μm. The term grain size as used herein means the length of the edge of the silver halide grain for the case that the grain is of a normal crystal having cubic or octahedral shape; means the diameter of a circle having the same area with the projected area of the major plane of the silver halide grain for the case that the grain has a tabular shape; and means the diameter of a sphere having a volume equal to that of the silver halide grain for the case that the grain is of an irregular crystal having a spherical or rod shape.

Examples of the shape of the silver halide grain include cubic, octahedral, tabular, spherical, rod and pebble; among these, cubic and tabular being in particular preferred in the present invention. When a tabular silver halide grain is used, the average aspect ratio is preferably from 100:1 to 2:1, more preferably from 50:1 to 3:1. A silver halide grain having rounded corners is also preferably used. The plane indices (Miller indices) of the outer surface plane of the photosensitive silver halide grain is not particularly limited; however, it is preferred that [100] plane showing a high spectral sensitization efficiency upon adsorption of the spectral sensitizing dye occuping a large percentage. The percentage is preferably 50% or above, more preferably 65% or above, still more preferably 80% or above. The percentage of a plane with a Miller index of [100] can be determined by the method described in T. Tani, J. Imaging Sci., 29, 165 (1985), which is based on the plane dependency of adsorption of the sensitizing dye between [111] and [100] planes.

The photosensitive silver halide grain for use in the present invention contains a Group VIII metal in the Periodic Table, or metal complex. The Group VIII metal in the Periodic Table, or a center metal of the metal complex is preferably rhodium, ruthenium, osmium or iridium. These metal complexes may be used individually, or in combination of two or more complexes of the same metal or different metals. The metal complex content is preferably from $1\times10^{-9}$ to $1\times10^{-3}$ mol per mol of silver, and more preferably from $1\times10^{--3}$ to $1\times10^{-4}$ mol. With respect to the specific structure of the metal complexes, those having the structures described in JP-A-7-225449 may be used.

As the rhodium compound preferably used in the present invention relates to a water-soluble rhodium compound. Examples thereof include a rhodium(III) halide compounds; and rhodium complex salts having a halogen, amines or an oxalates as ligands, such as hexachlororhodium(III) complex salt, pentachloroaquorhodium(III) complex salt, tetrachlorodiaquarhodium(III) complex salt, hexabromorhodium(III) complex salt, hexaamminerhodium (III) complex salt and trioxalatorhodium(III) complex salt. These rhodium compounds are used in a dissolved form in water or other appropriate solvent, where a method commonly used for stabilizing the rhodium compound solution may be applied, in which an aqueous hydrogen halide solution (e.g., hydrochloric acid, bromic acid, fluoric acid) or alkali halide (e.g., KCl, NaCl, KBr, NaBr) is added. In place of using the water-soluble rhodium, separate silver halide grains predoped with rhodium may be added and dissolved at the time of preparation of silver halide.

The amount of the rhodium compound to be added is preferably from $1\times10^{-8}$ to $5\times10^{-4}$ ml per mol of silver halide, and more preferably from $5\times10^{-8}$ to $1\times10^{-5}$ mol. The rhoduim compound may appropriately be added at the time of production of silver halide emulsion grains or at respective stages before coating of the emulsion, where more preferable is to add the compound at the time of emulsion production to be incorporated into the silver halide grain.

Ruthenium or osmium for use in the present invention is added in the form of water-soluble complex salt described in JP-A-63-2042, JP-A-1-285941, JP-A-2-20852 and JP-A-2-20855. An exceptionally preferred example thereof refers to a hexacoordinative complex salt represented by the following formula:

$$[ML_6]^{n-}$$

wherein M represents Ru or Os; and n represents 0, 1, 2, 3 or 4. In this case, ammonium or alkali metal ion is used as counter ion, while the counter ion being of no importance. Preferred examples of the ligand include halide ligand, cyanide ligand, cyanoxide ligand, nitrosyl ligand and thionitrosyl ligand. Specific examples of the complex for use in the present invention are shown below, while not being limited thereto.

$[RuCl_4]^{3-}$ $[RuCl_4(H_2O)_2]^{*}$ $[RuCl_5(H_2O)]^{2-}$ $[RuCl_5(NO)]^{2-}$ $[RuBr_5(NS)]^{2-}$ $[Ru(CO)_3Cl_3]^{2-}$ $[Ru(CO)Cl_5]^{2-}$ $[Ru(CO)Br_5]^{2-}$ $[OsCl_6]^{3-}$ $[OsCl_5(NO)]^{2-}$ $[Os(NO)(CN)_5]^{2-}$ $[Os(NS)Br_5]^{2-}$ $[Os(O)_2(CN)_4]^{4-}$

The amount of addition of these compounds is preferably from $1\times10^{-9}$ to $1\times10^{-4}$ mol per mol of silver halide, and store preferably from $1\times10^{-9}$ to $1\times10^{-5}$ mol.

These compounds may be added appropriately at the time of preparation of silver halide emulsion grains or at respective stages before coating of the emulsion, where more preferable is to add the compound at the time of emulsion production to be incorporated into the silver halide grain.

As for adding the compound during the grain formation of silver halide and integrating it into a silver halide grain, applicable methods include such that previously adding an aqueous solution of metal complex powder together with or without NaCl or KCl to a solution or water-soluble salt or water-soluble halide during the grain formation; such that adding the compound as the third solution at the time of simultaneously mixing a silver salt and a halide solution to prepare silver halide grains by the triple jet method; and such that pouring a necessary amount of an aqueous metal complex solution into a reaction vessel during the grain formation. Among these, preferred is a method comprising adding an aqueous solution of metal complex powder together with or without NaCl or KCl to a water-soluble halide solution.

In order to add the compound to the grain surface, a necessary amount of an aqueous metal complex solution may be charged into a reaction vessel immediately after the grain formation, during or after completion of the physical ripening, or at the time of chemical ripening.

As the iridium compound for use in the present invention, various compounds may be used, and examples thereof include hexachloroiridium, hexammineiridium, trioxalatoiridium, hexacyanoiridium and pentachloronitrosyliridium. These iridium compounds are used in a dissolved form in water or other appropriate solvent, where a method commonly used for stabilizing the iridium compound solution may be applied, in which an aqueous hydrogen halide solution (e.g., hydrochloric acid, bromic acid, fluoric acid) or alkali halide (e.g, KCl, NaCl, KBr, NaBr) is added. In place of using the water-soluble iridium, separate silver halide grains predoped with iridium may be added and dissolved at the time of preparation of silver halide.

The silver halide grain for use in the present invention may further contain a metal atom such as cobalt, iron, rhenium, nickel, chromium, palladium, platinum, gold, thallium, copper and lead. As for cobalt, iron, and chromium compounds, hexacyano metal complex is preferably used. Specific examples thereof include ferricyanate ion, ferrocyanate ion, hexacyanocobaltate ion, hexacyanochromate ion and hexacyanoruthenate ion, while not being limited thereto. The phase of the silver halide, in which the metal complex is contained, is not particularly limited, and the phase may be uniform or the metal complex may be contained in a higher concentration in the core portion or in the shell portion.

The above-described metal is used preferably in an amount of from $1\times10^{-9}$ to $1\times10^{-4}$ mol per mol of silver halide. The metal may be added at the time of preparation of the grains through converting it into a metal salt in the form of simple salt, double salt or complex salt.

The photosensitive silver halide grain may be desalted by water washing according to a method known in the art, such as noodle washing and flocculation, while omission of the desalting being also allowable in the present invention.

For the case that the silver halide emulsion used in the present invention is subjected to gold sensitization, it is allowable to use gold compounds commonly used in the art, where oxidation number of which may be 1 or 3. Typical examples of the gold sensitizers include chloroauric acid, potassium chloroaurate, auric trichloride, potassium auric thiocyanate, potassium iodoaurate, tetracyanoauric acid, ammonium aurothiocyanate, and pyridyltrichloro gold.

The amount of addition of the gold sensitizer varies depending on various conditions, where it is generally $1\times10^{-7}$ to $1\times10^{-3}$ mol per mol of silver halide, and more preferably $1\times10^{-6}$ to $5\times10^{-6}$ mol.

It is preferable to combine the gold sensitization for treating the silver halide emulsion used in the present invention with other chemical sensitization. Other chemical sensitization may be of any known method such as sulfur sensitization, selenium sensitization, tellurium sensitization or noble metal sensitization. As for the case that the gold sensitization is combined with other sensitization, preferable combinations include sulfur and gold sensitizations; selenium and gold sensitizations; sulfur, selenium and gold sensitizations; sulfur, tellerium and gold sensitizations; and sulfur, selenium, tellurium and gold sensitizations.

The sulfur sensitization applied to the present invention is usually performed by adding a sulfur sensitizer and stirring the emulsion at a temperature as high as 40° C. or above for a predetermined time. The sulfur sensitizer may be a known compound and examples thereof include, in addition to the sulfur compound contained in gelatin, various sulfur compounds such as thiosulfates, thioureas, thiazoles and rhodanines, among which thiosulfate and thiourea being preferable. Although the amount of the sulfur sensitizer to be added varies depending upon various conditions such as pH, temperature and grain size of silver halide at the time of chemical ripening, it is preferably from $1\times10^{-7}$ to $1\times10^{-2}$ mol per mol of silver halide, and more preferably from $1\times10^{-5}$ to $1\times10^{-3}$ mol.

The selenium sensitizer for use in the present invention may be a known selenium compound. The selenium sensitization is usually performed by adding a labile and/or non-labile selenium compound and stirring the emulsion at a temperature as high as 40° C. or above for a predetermined time. Examples of the labile selenium compound include those described in JP-B-44-15748, JP-B-43-13489, JP-A-4-25832, JP-A-4-109240, JP-A-3-121798 and JP-A-4-324855. Among these, particularly preferred are those expressed by the formulae (VIII) and (IX) of JP-A-4-324835.

The tellurium sensitizer for use in the present invention is a compound capable of producing silver telluride, presumably serve as a sensitization nucleus, on the surface or inside of salver halide grain. The rate of the formation of silver telluride in a silver halide emulsion can be examined according to a method described in JP-A-5-313284. Examples of the tellurium sensitizer include diacyl tellurides, bis(oxycarbonyl)tellurides, bis(carbamoyl)tellurides, diacyl ditellurides, bis(oxycarbonyl)ditellurides, bis(carbamoyl)ditellurides, compounds having a P═Te bond, tellurocarboxylates, Te-organyltellurocarboxylic esters, di(poly)tellurides, tellurides, tellurols, telluroacetals, tellurosulfonates, compounds having a P—Te bond, Te-containing heterocycles, tellurocarbonyl compounds, inorganic tellurium compounds and colloidal tellurium. Specific examples thereof include the compounds described in U.S. Pat. No. 1,623,499, No. 3,320,069 and No. 3,772,031; British Patents No. 235,211, No. 1,121,496, No. 1,295,462 and No 2,396,696; Canadian Patent No. 800,958; JP-A-4-204640, JP-A-3-53693, JF-A-3-131598, JP-A-4-129787; J. Chem. Soc. Chem. Commun., 635 (1980), ibid., 1102 (1979); ibid., 645 (1979); J. Chem. Soc. Perkin. Trans., 1, 2191 (1980); S. Patai (compiler), The Chemistry of Organic Selenium and Tellurium Compounds, Vol. 1 (1986); and ibid., Vol. 2 (1987). The compounds expressed by the formulae (II), (III) and (IV) of JP-A-5-313284 are particularly preferred.

The amount of the selenium or tellurium sensitizer used in the present invention varies depending on silver halide grains used or chemical ripening conditions. However, it is generally from $1\times10^{-8}$ to $1\times10^{-2}$ mol per mol of silver halide, preferably on the order of from $1\times10^{-7}$ to $1\times10^{-3}$ mol. The conditions for chemical sensitization in the present invention are not particularly restricted. However, in general, pH is from 5 to 8; pAg is from 6 to 11, preferably from 7 to 10; and temperature is from 40 to 95° C., preferably from 45 to 85° C.

As for the silver halide emulsion for use in the present invention, production or physical ripening process for the silver halide grain may be performed under the presence of cadmium salt, sulfite, lead salt or thallium salt.

In the present invention, reductive sensitization may be adoptable. Specific examples of the compound used in the reductive sensitization include ascorbic acid, thiourea dioxide, stannous chloride, aminoiminomethanesulfinic acid, hydrazine derivative, borane compound, silane compound and polyamine compound. The reductive sensitization may be performed by ripening the grains while keeping the emulsion at pH 7 or above, or at pAg 8.3 or below. Also, the reductive sensitization may be performed by introducing a single addition portion of silver ion during the formation of the grains.

To the silver halide emulsion for use in the present invention, thiosulfonic acid compound may be added by the method described in European Patent No. 293,917A.

In the recording material used for the present invention, a single kind of silver halide emulsion may be used, or two or more kinds of silver halide emulsions (for example, those differ in the average grain size, halogen composition, crystal habit or chemical sensitization conditions) may be used in combination.

The amount of the photosensitive silver halide used in the present invention is preferably from 0.01 to 0.5 mol per one mol of the organic silver salt, more preferably from 0.02 to 0.3 mol, still more preferably from 0.03 to 0.23 mol. Methods for mixing photosensitive silver halide and organic silver salt separately prepared include such that mixing, after completion of the individual preparation, the silver halide grains and the organic silver salt in a high-speed stirrer, ball mill, sand mill, colloid mill, vibrating mill, homogenizer or the like; and such that mixing, at any time during preparation of the organic silver salt, already-finished photosensitive silver halide to prepare the organic silver salt; while not being limited thereto so far as sufficient effects of the present invention are obtained.

The photothermographic material of the present invention may contain a sensitizing dye. The sensitizing dye used in the present invention may arbitrarily be selected from those capable of spectrally sensitizing the silver halide particles at a desired wavelength region by adhering thereon. As such sensitizing dyes, usable are, for example, cyanine dyes, merocyanine dyes, complex cyanine dyes, complex merocyanine dyes, holopolar cyanine dyes, styryl dyes, hemicyanine dyes, oxonole dyes and hemioxonole dyes. Sensitizing dyes which are usable in the present invention are described, for example, in Research Disclosure, Item 17643, IV-A (December, 1978, page 23), ibid. Item 1831X (August, 1978, page 437) and also in the references as cited therein. In particular, sensitizing dyes having a spectral sensitivity suitable for spectral characteristics of light sources of various laser imagers, scanners, image setters, process cameras and the like can advantageously be selected.

Exemplary dyes advantageous for the spectral sensitization to red light from so-called red light sources such as He—Ne laser, red semiconductor laser and red LED, include Compounds I-1 to I-38 disclosed in JP-A-54-18726; Compounds I-1 to I-35 disclosed in JP-A-6-75322; Compounds I-1 to I-34 disclosed in JP-A-7-287338; Dyes 1 to 20 disclosed in JP-B-55-39818; Compounds I-1 to I-37 disclosed in JP-A-62-284343; and Compounds I-1 to I-34 disclosed in JP-A-7-287338.

Spectral sensitization as to the wavelength region of from 750 to 1,400 nm from semiconductor laser light sources can advantageously be obtained with various known dyes such as cyanine dye, merocyanine dye, styryl dye, hemicyanine dye, oxonol dye, hemioxonol dye and xanthene dye. Useful cyanine dyes are those having a basic nucleus such as thiazoline nucleus, oxazoline nucleus, pyrroline nucleus, pyridine nucleus, oxazole nucleus, thiazole nucleus, selenazole nucleus or imidazole nucleus. Useful merocyanine dyes are those having the above-described basic nucleus or an acidic nucleus such as thiohydantoin nucleus, rhodanine nucleus, oxazolidinedione nucleus, thiazolinedione nucleus, barbituric acid nucleus, thiazolinone nucleus, malononitrile nucleus or pyrazolone nucleus. Of these cyanine and merocyanine dyes, those having an imino group or a carboxyl group are particularly effective. The dye may be appropriately selected from known dyes described, for example, in U.S. Pat. No. 3,761,279, No. 3,719,495 and No. 3,877,943, British Patents No. 1,466,201, No. 1,469,117 and No. 1,422,057, JP-B-3-10391, JP-B-6-52387, JP-A-5-341132, JP-A-6-194781 and JP-A-6-301141.

The dyes preferably used in particular for the present invention include cyanine dyes having a thioether bond (e.g., those described in JP-A-62-58239, JP-A-3-138638, JP-A-3-138642, JP-A-4-255840, JP-A-5-72659, JP-A-5-72661, JP-A-6-222491, JP-A-2-230506, JP-A-6-258757, JP-A-6-317868, JP-A-6-324425, JP-W-A-7-500926 (the code "JP-W-A" as used herein means an "international application published in Japanese for Japanese national phase"), and U.S. Pat. No. 5,541,054); dyes having a carboxylic acid group (e.g., dyes disclosed in JP-A-3-163440, JP-A-6-301141, and U.S. Pat. No. 5,441,899); merocyanine dyes; polynuclear merocyanine dyes; and polynuclear cyanine dyes (those disclosed in JP-A-47-6329, :P-A-49-105524, JP-A-51-127719, JP-A-52-80829, JP-A-54-61517, JP-A-59-214846, JP-A-60-6750, JP-A-63-159841, JP-A-6-35109, JP-A-6-59381, JP-A-7-146537, JP-W-A-55-50111, British Patent No. 1,467,638, and U.S. Pat. No. 5,281,515) and the like.

Dyes forming J-band have been disclosed in U.S. Pat. Nos. 5,510,236 and 3,871,887 (Example 5), JP-A-2-96131 and JP-A-59-48753, and the like, and they can preferably be used for the present invention.

These sensitizing dyes may be used either individually or in combination of two or more species. The combination of sensitizing dyes is often used for the purpose of supersensitization. In combination with the sensitizing dye, a dye which itself has no spectral sensitization effect, or a material which absorbs substantially no visible light but exhibits supersensitization may be incorporated into the emulsion. Useful sensitizing dyes, combinations of dyes which exhibit supersensitization, and materials which show supersensitization are described in Research Disclosure, Vol. 176, 17643, page 23, Item IV-J (December, 1978), JP-5-49-25500 and JP-B-43-4933, JP-A-59-19032 and JP-A-59-192242, and the like.

The sensitizing dye may be added to the silver halide emulsion by dispersing it directly in the emulsion or may be added to the emulsion after dissolving it in a solvent such as water, methanol, ethanol, propanol, acetone, Methyl Cellosolve, 2,2,3,3-tetrafluoropropanol, 2,2,2-trifluoroethanol, 3-methoxy-1-propanol, 3-methoxy-1-butanol, 1-methoxy-2-propanol and N,N-dimethylformamide; these solvents being used solely or by mixing.

Furthermore, the sensitizing dye may be added using a method disclosed in U.S. Pat. No. 3,469,987 by which the dye is dissolved in a volatile organic solvent, the obtained solution is then dispersed in water or hydrophilic colloid, and the obtained dispersion is added to the emulsion; methods disclosed in JP-B-44-23389, JP-8-44-27555 and JP-3-57-22091 by which the dye is dissolved in an acid, and then the obtained solution is added to the emulsion as it were or in the form of aqueous solution under the presence of acid or base; methods disclosed in U.S. Pat. Nos. 3,822,135 and 4,006,025 by which the dye, under the presence of surfactant, in a form of aqueous solution or colloid dispersion is added to the emulsion; methods disclosed in JP-A-53-102733 and JP-A-58-103141 by which the dye is dispersed directly in hydrophilic colloid and the obtained dispersion is added to the emulsion; or a method disclosed in JP-A-51-74624 by which the dye is dissolved using a compound causing red shift and the obtained solution is added to the emulsion. An ultrasonic wave may also be used in dissolving the dye.

In the preparation of the emulsion, the sensitizing dye may be added in any process steps as far as efficiency of which ever authorized. For example, in the grain formation process of silver halide and/or before desalting, or during the desalting process and/or the time period from desalting up to the initiation of chemical ripening, as disclosed in U.S. Pat. No. 2,735,766, No. 3,628,960, No. 4,183,756 and No. 4,225,666, 7P-A-58-184142 and JP-A-60-196749, or immediately before or during the chemical ripening process, or in the time period after chemical ripening up to coating, as disclosed in JP-A-58-113920. Furthermore, as disclosed in U.S. Pat. No. 4,225,666 and JP-A-58-7629, a single kind of compound per se may be added in parts or the compound in combination with another compound having a different structure may be added in parts, for example, one part is added during grain formation and another part is added during or after the chemical ripening; or one part is added before or during the chemical ripening and another part is added after completion of the chemical ripening. When the compound is added in parts, the compound or combination of the compound added in parts may be altered for each addition process.

The amount of the sensitizing dye used in the present invention may be selected according to the performance such as sensitivity or fog; where it is preferably from $10^{-6}$ to 1 mol per mol of silver halide in the photosensitive layer, and more preferably from $10^{-4}$ to $10^{-1}$ mol.

The pre-development pH of the surface of the thermally processed image forming material of the present invention is preferably adjusted to 6.0 or below, and more preferably 5.5 or below. The lower limit is set at approx. pH 3, while not being limited thereto.

Using an organic acid such as phthalic acid, non-volatile acid such as sulfuric acid, or volatile base such as ammonia is preferable from the viewpoint of reducing pH of the surface. Ammonia is particularly preferable to attain a low pH of the surface since it is highly volatile and can easily be removed before the coating or heat development processes.

In a preferable procedure for measuring the pH of the surface of the thermally processed image forming material according to the present invention, a 2.5 cm×2.5 cm test piece of the pre-development recording material is folded into a boat shape, 300 $\mu$l of a distilled water is dropped on the surface of the image recording layer side thereof, allowed to stand for 30 minutes, and the pH of the water drop is measured with a semiconductor-type pH meter BOY-P2 (product of Shin Dengen Kogyo K.K.) for one minute.

The image producing layer in the photothermographic material of the present invention may contain a plasticizer or lubricant, and examples thereof include polyhydric alcohols (for example, glycerin and diol described in U.S. Pat. No. 2,960,404); fatty acid or ester described in U.S. Pat. Nos. 2,588,765 and 3,121,060; and silicone resin described in British Patent No. 955,061.

The image-forming layer and the protective layer thereof in the present invention may contain a photographic element comprising a light absorbing substance and filter dye as described in U.S. Pat. No. 3,253,921, No. 2,274,782, No. 2,527,583and No. 2,956,879. It is also allowable to dye through mordanting as described, for example, in U.S. Pat. No. 3,282,699. The filter dye is preferably used in an amount so as to attain an absorbance of 0.1 to 3, and more preferably 0.2 to 1.5.

The photosensitive layer in the photothermographic material of the present invention may contain a dye or pigment of various types so as to improve the color tone or prevent the irradiation. Any dye or pigment may be used in the photosensitive layer, and examples thereof include pigments and dyes listed in the Color Index. Specific examples thereof include organic pigments and inorganic pigments such as pyrazoloazole dye, anthraquinone dye, azo dye, azomethine dye, oxonol dye, carbocyanine dye, styryl dye, triphenylmethane dye, indoaniline dye, indophenol dye and phthalocyanine. Preferred examples of the dye for use in the present invention include anthraquinone dyes (e.g. Compounds 1 to 9 described in JP-A-5-341441, Compounds 3-6 to 3-18 and 3-23 to 3-38 described in JP-A-5-165147), azomethine dyes (e.g., Compounds 17 to 47 described in JP-A-5-341441), indoaniline dyes (e.g., Compounds 11 to 19 described in JP-A-5-289227, Compound 47 described in JP-A-5-341441, Compounds 2-10 and 2-11 described in JP-A-5-165147) and azo dyes (Compounds 10 to 16 described in JP-A-5-341441). The dye may be added in any form of solution, emulsified product or solid micrograin dispersion or may be added in the state mordanted with a polymer mordant. The amount or such compounds used may be determined according to desired absorbance, and, in general, the compounds are preferably used in an amount of from $1\times10^{-6}$ to 1 g per $m^2$ of the thermally processed image forming material.

The thermally processed image forming material of the present invention may be of a so-called single-sided type having on one side of the support at least one photosensitive layer containing a silver halide emulsion and on the other side thereof a back layer; or may be of so-called double-sided type having respectively on both sides of the support at least one photosensitive layer containing a silver halide emulsion.

In the present invention, the back layer preferably has a maximum absorption in a desired wavelength region of from approx. 0.3 to 2.0. For the desired wavelength region of 750 to 1400 nm, the back layer is preferably an antihalation layer with an optical density within a wavelength region from 360 to 750 nm of 0.005 or larger and less than 0.5, and more preferably 0.001 or larger and less than 0.3. For the desired wavelength region of 750 nm or shorter, the back layer is preferably an antihalation layer with a maximum optical density within such desired wavelength region before image formation of 0.3 to 2.0, and with an optical density within a wavelength region from 360 to 750 nm after the image formation of 0.005 or larger and less than 0.3. There is no limitation on the method for lowering the optical density into the above-described range after the image production, where possible methods include such that using neat-assisted fading of dye color described in Belgian Patent No. 733,706, and that decreasing the density by photoirradiation-assisted fading described in JP-A-54-17833.

In the case when an antihalation dye is used in the present invention, the dye may be any compound so long as the compound has a desired absorption in the desired wavelength region, the absorption in the visible wavelength region can sufficiently be reduced after the processing, and the back layer can have a preferred absorption spectrum pattern. While examples thereof include those described in the following patent publications, the present invention is by no means limited thereto: single dye is disclosed in JP-A-59-56458, JP-A-2-216140, JP-A-7-13295, JP-A-7-11432, U.S. Pat. No. 5,380,635, JP-A-2-68539 (from page 13, left lower column, line 1 to page 14, left lower column, line 9) and JP-A-3-24539 (from page 14, left lower column to page 16, right lower column); and a dye which is faded after the processing is disclosed in JP-A-52-139136, JP-A-53-132334, JP-A-56-501480, JP-A-57-16060, JP-A-57-68831, JP-A-57-101835, JP-A-59-182436, JP-A-7-36145, JP-A-7-199409, JP-B-48-33692, JP-5-50-16648, JP-B-2-41734 and U.S. Pat. No. 4,088,497, No. 4,283,487, No. 4,548,896 and No. 5,187,049.

In the present invention, layers such as the image producing layer, protective layer and back layer may individually contain a hardening agent. Examples of the hardening agent include polyisocyanates described in. U.S. Pat. No. 4,281,060 and JP-A-6-208193; epoxy compounds described, for example, in U.S. Pat. No. 4,791,042; and vinyl sulfone-base compounds described, for example, in JP-A-62-89048.

Surfactants may preferably be used in the present invention to improve the coating property and electric charging. Nonionic, anionic, cationic, fluorine-containing, and any other types of surfactants can properly be used. More specifically, they are exemplified as fluorine-containing polymer surfactants disclosed, for example, in JP-A-62-170950 and U.S. Pat. No. 5,380,644; fluorine-containing surfactants disclosed, for example, in JP-A-60-244945 and JP-A-63-188135; polysiloxane-base surfactants disclosed, for example, in U.S. Pat. No. 3,885,965; polyalkyleneoxide disclosed, for example, in JP-A-6-301140; and anionic surfactants.

The thermally processed image forming material of the present invention may have, for an antistatic purpose, a layer containing or comprising soluble salts (e.g., chloride, nitrate); vapor-deposited metal; ionic polymers disclosed in U.S. Pat. Nos. 2,861,056 and 3,206,312; insoluble inorganic salts disclosed in U.S. Pat. No. 3,428,451;. and stannic oxide particles disclosed in JP-A-60-252349 and JP-A-57-104931.

A method for obtaining a color image using the thermally processed image forming material of the present invention is described in JP-A-7-13295, from line 43 on page 10 in the left column to line 40 on page 11 in the left column. Stabilizing agents for color dye image are described in British Patent No. 1,326,889, U.S. Pat. No. 3,432,300, No. 3,698,909, No. 3,574,627, No. 3,573,050, No. 3,764,337 and No. 4,042,394.

The thermally processed image forming material of the present invention may have additional layers such as dye accepting layer for accepting mobile dye image, opaque layer for effectuating reflective printing, protective top coat layer, and primer layer already known in the field of photothermal photographic technology. It is preferable that the thermally processed image forming material of the present invention is capable of producing image solely by itself. That is, it is preferable that the functional layer necessary for producing image, such as image accepting layer, is not provided on the separate material.

In the present invention, an exposure apparatus used for the image-wise exposure may be of any type provided that it affords an exposure period of not longer than $10^{-7}$ seconds, and is preferably in general such apparatus having a light source such as a laser diode (LD) or light emitting diode (LED). LD is more preferable in terms of high output and excellent resolution. These light sources may be of any type provided that they can emit light within an electromagnetic spectral range of desired wavelengths. Available LDs include, for example, a dye laser, gas laser, solid state laser and semiconductor laser.

In the present invention, the exposure is effected so that the beam loca are partially overlapped. The overlap means that the subscanning pitch width is smaller than the beam spot diameter. When the beam spot diameter is expressed by, for example, a half width of the beam intensity, the overlap can quantitatively be expressed by FWBM/subscanning pitch width (an overlap coefficient).

The overlap coefficient is preferably 0.2 or larger in the present invention.

There is no particular limitation on the scanning system of the light source of the exposure apparatus employed in the present invention, and available systems include outer cylinder surface scanning system, inner cylinder surface scanning system and planar scanning system. Both of single channel and multi-channel systems are available for the light source, where the multi-channel system is preferable for the outer cylinder surface scanning system.

The thermally processed image forming material of the present invention has a low haze at the time of exposure and is liable to incur generation of interference fringes. For preventing the generation of interference fringes, a technique of entering a laser light obliquely with respect to the recording material disclosed in JP-A-5-113548, and a method of using a multimode laser disclosed in International Patent Publication WO95/31754 are known and these techniques are preferably used.

The thermally processed image forming material of the present invention may be developed by any method, while in general the development is performed by elevating the temperature of the recording material after the image-wise exposure. Preferred embodiments of the heat-developing apparatus used include: those making the thermally processed image forming material into contact with a heat source such as a heat roller or heat drum as disclosed in JP-B-5-56499, Japanese Patent No. 684433, JP-A-9-292695, JP-A-9-297385 and International Patent Publication WO95/30934; and those of non-contacting type as disclosed in JP-A-7-13294, International Patent Publications WO97/28489, WO97/28488 and WO97/28487. Of these, the non-contacting type heat-developing apparatus is preferred. The development temperature is preferably from 80 to 250° C., more preferably from 100 to 140° C. The development time is preferably from 1 to 180 seconds, more preferably from 10 to 90 seconds.

For preventing uneven processing due to dimensional changes in the thermally processed image forming material of the present invention during heat development, it is preferable to heat the material at a temperature of 80° C. or above and less than 115° C. for 5 seconds or more so as to prevent the image from appearing, and then develop the material by heating at a temperature of 110 to 140° C. to produce the image (so-called multi-stage heating method).

Figure 4:
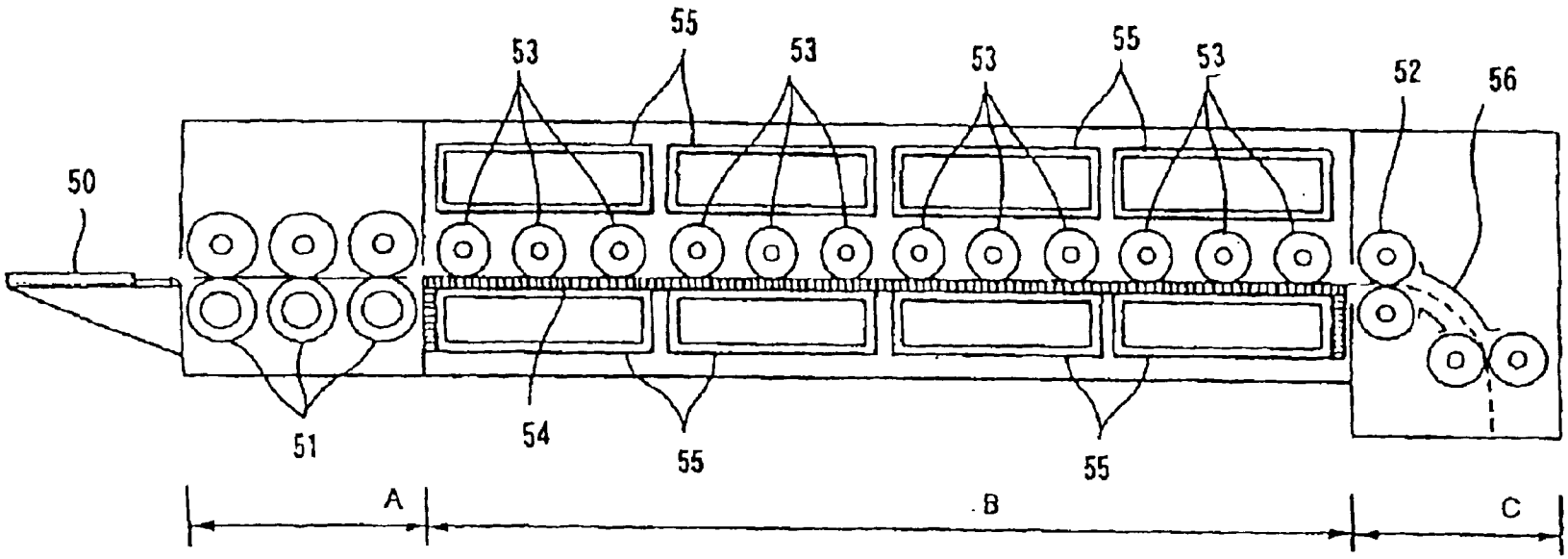
FIG. 4 is a side view showing a heat developing apparatus used in the Examples.

An exemplary constitution of a heat developing apparatus used for the heat development of the thermally processed image forming material of the present invention is shown in FIG. 4. FIG. 4 shows a side view of the heat developing apparatus. The apparatus has a feed-in roller pair 51 (the lower one being a heat roller) for introducing the thermally processed image forming material 50 into a heating section while straightening and preheating it, and has an eject roller pair 52 for ejecting the thermally processed image forming material 50 after the heat development. The thermally processed image forming material is heat-developed during a period that it is conveyed from the feed-in roller pair 51 to the eject roller pair 52. In a conveying means for conveying the thermally processed image forming material 50, a plurality of rollers 53 are aligned on the side where the contact with the top surface of the image producing layer side may occur, and a smooth plane 54 is provided on the opposite side where the contact with the back surface may occur, the surface of the smooth plane 54 being laminated with a nor-woven fabric (made of, for example, polyphenylenesulfite or polytetrafluoroethylene). The thermally processed image forming material 50 is conveyed with the aid of the plurality of rollers 53 driven under contact with the image producing layer side, while the back surface being slid on the smooth plane 54. As a heating means, heaters 55 are aligned behind the rollers 53 and the smooth plane 54 so as to heat the thermally processed image forming material from both sides. Such heating means can be typified as a plate heater or the like. The clearance between the rollers 53 and the smooth plane 54 may vary depending on the materials composing the smooth plane-54, and can properly be adjusted, preferably to 0 to 1 mm, so as to allow a smooth conveyance of the thermally processed image forming material.

Although materials and members composing the rollers 53 and smooth plane 54 may be of any type provided that they are durable to high temperatures and do not adversely affect the conveyance of the thermally processed image forming material 50, silicone rubber is preferable for the surface of the rollers 53, and aromatic polyamide or Teflon (product name of polyteterafluoroethylene) for the smooth plane 54. It is also preferable to compose the heating means with a plurality of unit heaters and to arbitrarily select the individual temperatures.

A preheating section, placed on the upper stream of the heat developing section, is preferably conditioned at a temperature and a heating time sufficient for vaporizing the moisture within the thermally processed image forming material 50, and more specifically, at a temperature higher than the glass transition point (Tg) of the thermally processed image forming material 50 so as to avoid non-uniformity of the development.

On the downstream side of the heat developing section, provided are a guide plate 56 and a slow cooling section.

The guide plate 56 is preferably made of a material with a low heat conductivity, and the cooling is preferably performed gradually so as to avoid deformation of the thermally processed image forming material.

While the apparatus has been described referring to the illustrated example, a variety of other configurations, including such that disclosed in JP-A-7-13294, are allowable without limitation for use in the present invention. For the case of applying the multi-stage heating method, two or more heat sources differed in temperature settings can be provided so as to allow successive heating at different temperatures.

In a preferred embodiment of the present invention, an intermediate layer can optionally be provided in addition to the image recording layer and the protective layer, where these plurality of layers can be formed by the simultaneous stackable coating using water-base coating liquids for the purpose of improving the productivity. Methods for the coating include extrusion coating, slide coating, curtain coating, and a particularly preferable one relates to the slide bead coating disclosed in FIG. 1 of JP-A-2000-2964.

In the case of using a silver halide photosensitive material containing gelatin as a major binder, the photosensitive material will rapidly be cooled in a first drying zone provided on the downstream of a coating die, where a coated film is immobilized due to gellation of the gelatin. Thus immobilized and non-fluidized coated film is then sent to a second drying zone, where, and in any successive drying zone, the solvent contained in the coated film will be vaporized to afford a solid film. Drying system for the second drying zone and thereafter include a air-loop system in which air jet is blown from an U-duct to the support carried on the rollers, and a spiral system (air floating system) in which the support is dried during conveyance as being spirally wound on a cylindrical duct.

As for the coating liquid containing polymer latex as a major component of the binder, preheating only in the first drying zone may be insufficient since the rapid cooling cannot immobilize the coated film. In such a case, the drying system suitable for a silver halide photographic photosensitive material will likely to cause non-uniform liquid flow or drying, which may result in serious failure in the coated surface quality.

A preferable drying system for the present invention is not limited to that having the first and second drying zones as disclosed in JP-A-2000-2964, but such that using a horizontal drying zone at least the constant-rate drying is completed. Conveyance of the support immediately after the coating through the introduction into the horizontal drying zone is not necessarily performed in a horizontal manner, and a rising angle from the horizontal level of the coating apparatus may reside in 0 to 70°. It is to be understood that the horizontal drying zone never requires the conveyance of the support in an absolutely horizontal manner, but allows deflection from the horizontal level of the coating apparatus within ±15°.

The constant-rate drying in the context of this specification means a drying process such that the whole amount of incoming beat while keeping the liquid film temperature constant will be consumed for vaporizing the solvent. The falling-rate drying means a drying process such that the drying rate falls in the terminal period due to miscellaneous factors (rate-determined by internal water migration or diffusion within the material, or recession of the vaporization surface), and incoming heat also contributes the temperature rise of the liquid film. A critical moisture content allowing transition from the constant-drying-rate process to falling-drying-rate process resides in a range from 200 to 300%. While a drying process known for the silver halide photographic photosensitive material may also be applicable since the coated film will thoroughly be dried to be immobilized upon completion of the constant-rate drying, more preferable in the present invention is to sustain the drying in the horizontal drying zone until the final dry point is reached even after the constant-rate drying period.

A preferable drying temperature in the formation of the image producing layer and/or protective layer is such that higher than the minimum film-formation temperature (MFT) of the polymer latex (generally higher than the glass transition point of the polymer by 3 to 5°), usually set at a temperature equivalent to the liquid film surface temperature during the constant-rate drying is applied, and is often set within a range from 25 to 40° C. limited by performances of the production facility. The dry bulb temperature during the falling-rate drying is preferably set to a temperature lower than the glass transition point of the support (usually 80° C. or below for PET support). The liquid film surface temperature in the context of the present invention refers to a surface temperature of the coated liquid film, and more specifically solvent film, coated on the support, and the dry bulb temperature refers to a temperature of drying air flow in the drying zone.

If the constant-rate drying is proceeded by conditions allowing temperature fall of the liquid film surface, the drying tends to be incomplete, which will significantly degrade the film forming property in particular of the protective layer and will readily produce cracks on the film surface. This may also weaken the film strength so that a critical problem such that getting scratches during the conveyance within an exposure apparatus or heat developing apparatus may occur.

On the contrary, if the drying is effected so as to raise the liquid film surface temperature, surface irregularity tends to occur since the protective layer mainly composed of the polymer latex can rapidly form a film, whereas the lower layers including the image producing layer can still fluidize. Applying an excessive heat on the support (base) exceeding the glass transition point thereof also tends to ruin the dimensional stability or curling resistance of the photosensitive material.

In particular in the simultaneous stackable coating, in which the upper layer is stacked on the lower layer still in the wet state and both layer are concomitantly dried, and while the same will apply to the sequential coating in which the upper layer is formed on the lower layer being already coated and dried, it is preferable to adjust a pH difference between the coating liquids for the image producing layer and the protective layer to 2.5 or below, where a smaller pH difference the better. Increase in the pH difference tends to promote a microscopic agglomeration at the interface of the coated liquids, which will result in a critical failure in the surface property such as coating streaks during long span continuous coating.

Viscosity at 25° C. of the coating liquid for the image producing layer is preferably 15 to 100 cp, and more preferably 30 to 70 cp. Viscosity at 25° C. of the coating liquid for the protective layer is preferably 5 to 75 cp and more preferably 20 to 50 cp. The viscosities can be measured using a 5-type viscometer.

Winding up after the drying is preferably conducted at 20 to 30° C., and a relative humidity of 45±20° C. The winding orientation can be optional for the convenience of successive processes, that is, either orientation of Em-out (emulsion layer oriented outward) or Em-in (emulsion layer oriented inward) is allowable. The bag humidity for the thermally processed image forming material is preferably controlled within a range from 20 to 55% (measured at 25° C.).

Defoaming or the coated liquid in the present invention is preferably performed by preliminarily degassing the pre-coating liquid under a reduced pressure, and coating the coating liquid while maintaining the liquid under a pressure of 1.5 kg/cm$^2$ or above, under a continuous flow so as to prevent gas-liquid interface from generating, and under application of ultrasonic vibration. A specific example of such method is described in JP-3-55-6405 (line 20 on page 4 to line 11 on page 7). An apparatus for implementing such defoaming is exemplified as that disclosed in FIG. 3 of JP-A-2000-98534.

In the conventional photographic emulsion coating liquid, which is a viscous liquid containing silver halide grains and gelatin matrix, air bubbles will easily dissolve into the liquid and disappear simply by feeding the liquid under pressure, and the air bubbles will scarcely emerge again even the atmospheric pressure is recovered during the coating.

On the contrary, the coating liquid containing the fatty acid silver salt for use in the present invention has a thixotropic nature, and the general pressure feeding is not sufficient for the defoaming. It is thus necessary to feed the liquid so as to prevent gas-liquid interface from generating and to apply ultrasonic vibration.

Such pressure is preferably 1.5 kg/cm$^2$ or above, more preferably 1.8 kg/cm$^2$ or above, and an upper limit is around 5 kg/cm$^2$ in general, while not being limited thereto. Sound pressure of the applied ultrasonic wave is 0.2 V or above, and more preferably 0.5 to 3.0 V. Higher sound pressure is more preferable in general, where too high sound pressure will cause cavitation and thus locally raise the temperature, which may result in fog. While the sound frequency is not limitative, it is generally selected at 10 kHz or above, and more preferably 20 to 200 kHz. Now, the reduced-pressure defoaming herein relates to closing the tank (liquid reserving tank or storage tank in general), reducing the pressure in the tank to expand the air bubbles entrained in the coating liquid, and making the bubbles escape from the liquid facilitated by their increased buoyancy. The pressure during the reduced-pressure defoaming is −200 mmHg or lower (a pressure lower than the atmospheric pressure by 200 mg or more), and more preferably −250 mmHg or lower, and a lowest pressure of −800 mmHg or around in general, while not being limited thereto. Period of pressure reduction is 30 minutes or longer, and more preferably 45 minutes or longer, where an upper limit is not specifically defined.

EXAMPLES

The present invention will be explained more specifically hereinafter by referring to the following Examples. The materials, amounts of use thereof, ratios, operations, procedures and the like mentioned in the following Examples may properly be modified without departing from the spirit of the present invention. The scope of the present invention, therefore, is not limited to the specific Examples described below.

Example 1

Preparation of Fatty Acid Silver Salt Grain Dispersion "A"

Sodium behenate solution was prepared by mixing 876 g of behenic acid (Edenor C22-85R, product of Henkel Corporation), 4,230 ml of distilled water, 492 ml of a 5 mol/L aqueous NaOH solution and 1,200 ml of tert-butanol, and allowing the mixture to react at 75° C. for one hour under stirring. Independently, 2,062 ml of aqueous solution containing 404 g of silver nitrate (pH 4.0) was prepared and kept at 10° C. A reaction vessel containing 6,350 ml of distilled water and 300 ml of tert-butanol was kept at 30° C., and an entire volume of the sodium behenate solution and an entire volume of the silver nitrate aqueous solution were added at constant flow rates over 62 minutes and 10 second, and over 60 minutes, respectively. In this process, only the silver nitrate aqueous solution was added in a first 7-minute-and-20-second period after the start of the addition, then sodium behenate solution was concomitantly added, and only sodium behenate solution was added in a last 9-minute-and-30-second period after the end of addition of the aqueous silver nitrate solution.

The temperature in the reaction vessel is kept at 30° C., and was controlled externally so as to avoid the liquid temperature rise. A piping in a feeding system of the sodium behenate solution was heated using a steam trace, where a steam aperture being adjusted so as to control the outlet liquid temperature at the end of the feed nozzle at 75° C. A piping in a feeding system of the aqueous silver nitrate solution was heated by circulating cold water in an outer portion of the double pipe. Points of addition of the sodium behenate solution and silver nitrate aqueous solution were symmetrically arranged centered round a stirring axis, the heights of which being adjusted so as to avoid contact to the reaction solution.

After completion of the addition of the sodium behenate solution, the mixture was allowed to stand for 20 minutes under stirring with the temperature thereof unchanged, and then cooled to 25° C. The solid content was separated by suction filtration, and then washed with water until electric conductivity of the wash water decreased as low as 30 μS/cm. The obtained solid content was stored in a form of a wet cake without drying.

From electron microscopic photographing, the obtained silver behenate particle was found to be a scaly crystal having an average sphere-equivalent diameter of 0.52 μm, an average grain thickness of 0.14 μm, and a sphere-equivalent coefficient of variation of 15%.

Next, the silver behenate dispersion was prepared by the procedures described below. To the wet cake equivalent to a dry weight of 100 g, 7.4 g of polyvinyl alcohol (product name; PVA-217, average degree of polymerization of ca. 1,700) and water were added to adjust a total weight of 385 g, and the mixture was then preliminarily dispersed using a homomixer. The preliminarily dispersed solution was then thoroughly dispersed three times using a dispersion apparatus (Micro Fluidizer m-110S-EH, manufactured by Micro Fluidex International Corporation, equipped with G10Z interaction chamber) under an operating pressure of 1,750 kg/cm$^2$, to obtain a silver behenate dispersion. During the dispersion, cooling operation was effected using coiled heat exchangers attached to the inlet side and outlet side of the interaction chamber, and the temperature of the coolant was controlled to keep the desired temperature.

The silver behenate grains contained in thus obtained silver behenate dispersion was found to have a volume weighted mean diameter of 0.52 $\mu$m and a coefficient of variation of 15%, and a viscosity of the dispersion was 18 mPa.s. The grain size was measured using MasterSizer X manufactured by Malvern Instruments, Ltd. Observation through an electron microscope revealed a ratio of the long edge and short edge of 1.5, a grain thickness of 0.14 $\mu$m, and an average aspect ratio (ratio of circle-equivalent diameter of a projected grain area and grain thickness) of 5.1.

Preparation of Fatty Acid Silver Salt Grain Dispersion "B"

The dispersion "B" was prepared using a small-sized crystallization equipment as shown in FIG. 3. While stirring in a tank 32 a mixture of 876 g of behenic acid (Edenor C22-85R, product of Henkel corporation), 4,230 ml of distilled water and 1,200 ml of tert-butanol at 75° C., added thereto was 492 ml of a 5 mol/L aqueous NaOH solution over 5 minutes, and was then allowed to react for 60 minutes to obtain a sodium behenate solution. Independently, 2,062 ml of aqueous solution containing 404 g of silver nitrate (pH 4.0) was prepared and kept in a tank 31 at 10° C. While rotating a rotating blades of a mixing apparatus 38 (Pipeline Mixer Model LR-I, product of Mizuho Kogyo K.K. ) at 10,000 rpm, the above aqueous silver nitrate solution was fed at a constant flow rate of 29 ml/minute, and 5 seconds after, the sodium behenate solution was fed at a constant flow rate of 98 ml/minute, which were then sent via an heat exchanger 39 to be stocked in a tank 40. An average temperature of the content of the tank 40 was 35° C., when a cooling water of 10° C. was supplied to a jacket of the tank 40 at 20 L/minute while ceasing supply of cooling water to the heat exchanger 39. The mixture was allowed to stand for 20 minutes under stirring, and then cooled to 25° C. The solid content was separated by suction filtration, and then washed with water until electric conductivity of the wash water decreased as low as 30 $\mu$S/cm. The obtained solid content was stored in a form of a wet cake without drying.

Successive processes for preparing the dispersion "B" of the fatty acid silver salt grains are similar to those for the dispersion "A".

Preparation of Fatty Acid Silver Salt Grain Dispersion "C"

The dispersion "C" was prepared using the small-sized crystallization equipment as shown in FIG. 3. While stirring in the tank 32 a mixture of 876 g of behenic acid (Edenor C22-85R, product of Henkel Corporation), 4,230 ml of distilled water and 1,200 ml of tert-butanol at 75° C., added thereto was 492 ml of a 5 mol/L aqueous NaOH solution over 5 minutes, and was then allowed to react for 60 minutes to obtain a sodium behenate solution. Independently, 2,062 ml of aqueous solution containing 404 g of silver nitrate (pH 4.0) was prepared and kept in a tank 31 at 10° C., and 6,000 ml of pure water was stored in a tank 41 at 10° C. While rotating rotating blades of a mixing apparatus 38 (Pipeline Mixer Model LR-I, product of Mizuho Kogyo K.K.) at 10,000 rpm, the above aqueous silver nitrate solution and pure water were fed at constant flow rates of 29 ml/minute and 98 ml/minute, respectively, and 5 seconds after, the sodium behenate solution was fed at a constant flow rate of 98 ml/minute, which were then sent via an heat exchanger 39 to a tank 40 and stocked. An average temperature of the content of the tank 40 was 30° C., when a cooling water of 10° C. was supplied to a jacket of the tank 40 at 20 L/minute while ceasing supply of cooling water to the heat exchanger 39. The mixture was allowed to stand for 20 minutes under stirring, and then cooled to 25° C. The solid content was separated by suction filtration, and then washed with water until electric conductivity of the wash water decreased as low as 30 $\mu$S/cm. The obtained solid content was stored in a form of a wet cake without drying.

Successive processes for preparing the dispersion "C" of the fatty acid silver salt grains are similar to those for the dispersion "A".

Preparation of Fatty Acid Silver Salt Grain Dispersion "D"

The dispersion "D" was prepared similarly to the dispersion "C" except that 6,000 ml of a 4 vol % aqueous tert-butanol solution was stored in a tank 41 and fed at a constant flow rate of 98 ml/minute.

Preparation of Fatty Acid Silver Salt Grain Dispersion "E"

The dispersion "E" was prepared using the small-sized crystallization equipment as shown in FIG. 2. While stirring in the tank 12 a mixture of 876 g of behenic acid (Edenor C22-85R, product of Henkel Corporation), 4,230 ml of distilled water and 1,200 ml of tert-butanol at 75° C., added thereto was 492 ml of a 5 mol/L aqueous NaOH solution over 5 minutes, and was then allowed to react for 60 minutes to obtain a sodium behenate solution. Independently, 2,062 ml of aqueous solution containing 404 g of silver nitrate (pH 4.0) was prepared and kept in a tank 11 at 10° C. The tank 20 was pre-charged with 6,000 ml of pure water, which was circulated at a flow rate of 1,000 ml/minute via the pump 17. While rotating rotating blades of a mixing apparatus 18 (Pipeline Mixer Model LR-I, product of Mizuho Kogyo K.K.) at 10,000 rpm, the above aqueous silver nitrate solution was fed at a constant flow rate of 29 ml/minute, and 5 seconds after, the sodium behenate solution was fed at a constant flow rate of 98 ml/minute, which were then sent via an heat exchanger 19 to be stocked in a tank 20. An average temperature of the content of the tank 20 was 30° C., when a cooling water of 10° C. was supplied both to a jacket of the tank 20 and the heat exchanger 19 at 20 L/minute. The mixture was allowed to stand for 20 minutes under stirring, and then cooled to 25° C. The solid content was separated by suction filtration, and then washed with water until electric conductivity of the wash water decreased as low as 30 $\mu$S/cm. The obtained solid content was stored in a form of a wet cake without drying.

Successive processes for preparing the dispersion "E" of the fatty acid silver salt grains are similar to those for the dispersion "A".

Preparation of Fatty Acid Silver Salt Grain Dispersion "F"

The dispersion "F" was prepared similarly to the dispersion "B" except that a cooling water of 5° C. was fed to the heat exchanger 39, thereby to attain an average temperature of the content of the tank 40 of 30° C.

Preparation of Fatty Acid Silver Salt Grain Dispersion "G"

The dispersion "G" was prepared similarly to the dispersion "E" except that a cooling water of 5° C. was fed to the heat exchanger 19, thereby to attain an average temperature or the content of the tank 20 of 25° C.

Conditions for the preparation, grain size and viscosity of the dispersions "A" to "G" of the fatty acid silver salt grains were listed in Table 1.

TABLE 1

| Dispersion | Preparation method | Added Liquid Component 1 | Added Liquid Component 2 | Added Liquid Component 3 | Temp. of cooling water (° C.) | Temp. of content in the tank (° C.) | Grain size Average (μm) | Grain size Coef. of variation (%) | Viscosity (mPa · s) |
|---|---|---|---|---|---|---|---|---|---|
| A (Comp.) | tank | aq. $AgNO_3$ | sodium behenate solution | — | — | 35 | 0.58 | 29 | 19 |
| B (Inv.) | closed mixing apparatus | aq. $AgNO_3$ | sodium behenate solution | — | — | 35 | 0.45 | 17 | 19 |
| C (Inv.) | closed mixing apparatus | aq. $AgNO_3$ | sodium behenate solution | water | — | 30 | 0.41 | 26 | 18 |
| D (Inv.) | closed mixing apparatus | aq. $AgNO_3$ | sodium behenate solution | aqueous t-BuOH solution | — | 30 | 0.42 | 15 | 22 |
| F (Inv.) | closed mixing apparatus | aq. $AgNO_3$ | sodium behenate solution | obtained silver salt dispersion | — | 30 | 0.36 | 15 | 23 |
| G (Inv.) | closed mixing apparatus | aq. $AgNO_3$ | sodium behenate solution | — | 5 | 30 | 0.32 | 16 | 25 |
| H (Inv.) | closed mixing apparatus | aq. $AgNO_3$ | sodium behenate solution | obtained silver salt dispersion | 5 | 25 | 0.26 | 11 | 24 |

Preparation of Silver Halide Emulsion
(Emulsion "A")

To 700 ml of distilled water, 11 g of alkali-treated gelatin (calcium content≦2,700 ppm) and 10 mg of sodium benzenethiosulfonate were dissolved at 40° C., pH of the mixture was adjusted at 5.0, and added thereto were 159 ml of an aqueous solution containing 18.6 g of silver nitrate and an aqueous solution containing 1 mol/L of potassium bromide, $5\times10^{-6}$ mol/L of $(NH_4)_2RhCl_5(H_2O)$, and $2\times10^{-5}$ mol/L of $K_3IrCl_6$ over 6 minutes and 30 seconds by the controlled double jet method while keeping pAg at 7.7. The further added were 476 ml of an aqueous solution containing 55.5 mg of silver nitrate and an aqueous halogen salt solution containing 1 mol/L of potassium bromide and $2\times10^{-5}$ mol/L of $K_3IrCl_6$ over 28 minutes and 30 seconds by the controlled double jet method while keeping pAg at 7.7. The pH of the mixture was lowered to effect agglomerative precipitation and desalting, 0.17 g of Compound "A" listed below and 51.1 g of low-molecular-weight gelatin (average molecular weight=15,000, calcium content=20 ppm) were added, and the pH and pAg were adjusted to 5.9 and 9.0, respectively. The obtained grains were found to be cubic grains having an average grain size of 0.08 μm, a coefficient of variation of the projected area of 9%, and a ratio of [100] plane of 90%.

The above grains were then heated to 60° C., added with $7.6\times10^{-5}$ mol/mol Ag of sodium benzenethiosulfonate, and 3 minutes after further added with $7.1\times10^{-5}$ mol/mol Ag of triethylthiourea, ripened for 100 minutes, added with $5\times10^{-4}$ mol/mol Ag of 4-hydroxy-6-methyl-1,3,3a,7-tetrazaindene, and cooled to 40° C.

While keeping the liquid temperature at 40° C. under stirring, $4.7\times10^{-2}$ mol/mol Ag of potassium bromide, $12.8\times10^{-4}$ mol/mol Ag of Sensitization Dye "A" listed below, and $6.4\times10^{-3}$ mol/mol Ag of Compound "B" listed below were added, and 20 minutes after the mixture was rapidly cooled to 30° C., thereby to complete the preparation of silver halide emulsion "A".

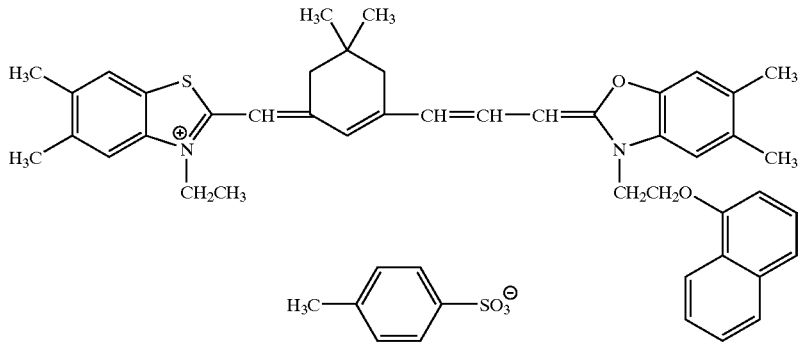

Sensitization Dye "A"

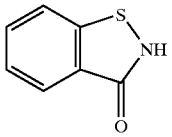

Compound "A"

-continued

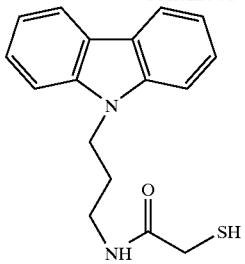

Compount "B"

Preparation of Solid Micrograin Dispersion of 1,1-Bis(2-Hydroxy-3,5-Dimethylphenyl)-3,5,5-Trimethylhexane (Reducing Agent)

Twenty-five grams of 1,1-bis(2-hydroxy-3,5-dimethylphenyl)-3,5,5-trimethylhexane, 25 g of a 20 wt % aqueous solution of a modified polyvinyl alcohol (Poval MP-203, product of Kuraray Co., Ltd.), 0.1 g of Surfinol 104E (product of Nissin Chemical Industry Co., Ltd.), 2 g of methanol and 48 ml of water were mixed and thoroughly mixed to prepare a slurry, which was allowed to stand for 3 hours. The slurry was then transferred to a vessel of a dispersion apparatus (¼ G Sand Grinder Mill, product of Aimex, Ltd.) together with 360 g of zirconia bead of 1 mm diameter and dispersed for 3 hours, thereby to obtain the solid micrograin dispersion of the reducing agent. The obtained grains wee found to follow a grain size distribution such that 80 wt % the grains having a diameter of 0.3 to 1.0 μm.

Preparation of Solid Micrograin Dispersion of Polyhalogen Compound

Thirty grams of Polyhalogen Compound "A" listed later, 4 g of a 20 wt % aqueous solution of a modified polyvinyl alcohol (Poval MP-203, product of Kuraray Co., Ltd.), 0.25 g of Compound "C" listed later and 66 g of distilled water were mixed and then thoroughly stirred to prepare a slurry. The slurry was then transferred to a vessel of a dispersion apparatus (1/16 G Sand Grinder Mill, product of Aimex, Ltd.) together with 200 g of zirconia silicate beads of 0.5 mm diameter and dispersed for 5 hours, thereby to obtain the solid micrograin dispersion of the polyhalogen compound. The obtained grains were found to follow a grain size distribution such that 80 wt % the grains having a diameter of 0.3 to 1.0 μm.

Polyhalogen Compound "B" listed later was also made into a solid micrograin dispersion having an equivalent grain size.

Preparation of Solid Micrograin Dispersion of Nucleation Aid

Ten grams of nucleation aid listed in Table 2 (nucleation aid 62 was shown previously in the specification, nucleation aid "A" is expressed by the formula shown later), 2.5 g of polyvinyl alcohol (PVA-217, product of Kuraray Co., Ltd.) and 87.5 g of distilled water were mixed and then thoroughly stirred to prepare a slurry. After being allowed to stand for 3 hours, the slurry was transferred to a vessel of a dispersion apparatus (¼ G Sand Grinder Mill, product of Aimex, Ltd.) together with 240 g of zirconia beads of 0.5 mm diameter and dispersed for 10 hours, thereby to obtain the solid micrograin dispersion of the nucleation aid. The obtained grains were found to follow a grain size distribution such that 80 wt % the grains having a diameter of 0.1 to 1.0 μm with an average grain size of 0.5 μm.

Preparation of Solid Micrograin Dispersion of Compound "Z"

Thirty grams of Compound "Z" listed later, 3 g of a 20 wt % aqueous solution of a modified polyvinyl alcohol (Poval MP-203, product of Kuraray Co., Ltd.) and 87 g of distilled water were mixed and then thoroughly stirred to prepare a slurry. After being allowed to stand for 3 hours, the slurry was dispersed as explained above for the dispersion of the reducing agent, thereby to obtain the solid micrograin dispersion of the Compound "Z". The obtained grains were found to follow a grain size distribution such that 80 wt % the grains having a diameter of 0.3 to 1.0 μm.

Preparation of Coating Liquid for Emulsion Layer

The foregoing fatty acid silver salt grain dispersions "A", "B", "C", "D", "E", "F" or "G", binder and other materials listed below, where all quantities being those per mol of silver in the fatty acid silver salt grain dispersions "A" to "G", and the foregoing silver halide dispersion (emulsion "A") were mixed according to the compositions shown in Table 2, and then added with water to prepare the coating liquid for the emulsion layer, which was followed by degassing under a reduced pressure lower than the atmospheric pressure by 35 mmHg for 60 minutes. The coating liquid thus obtained has a pH of 7.7, viscosity at 25° C. of 45 cp.

binder (Lacstar 3307B, product of Dai-Nippon Ink & Chemicals, Inc., glass transition point=17° C.) 397 g as a solid content 1,1-bis-(2-hydroxy-3,5-dimethylphenyl)-3,5,5-trimethylhexane 149 g as a solid content Polyhalogen Compound "A" 43.5 g as a solid content Polyhalogen Compound "B" 13.5 g as a solid content sodium ethylthiosulfonate 0.30 g benzotriazole 1.04 g polyvinyl alcohol (PVA-235, product of Kuraray Co., Ltd.) 10.8 g 6-iso-propylphthalazine 12.8 g sodium dihydrogen orthophosphate dihydrate 0.37 g Compound "Z" 9.7 g as a solid content nucleation aid (listed in Table 2) 0.03 mol as a solid content Dye "A"(in a coated amount affording an optical density of 0.3 at 783 nm) ca. 0.37 g silver halide emulsion "A" 0.06 mol as silver amount Compound "C" 2.0 g Compound "A" (antiseptic) 40 ppm in coating liquid (coated amount=2.5 mg/m$^2$)

methanol (solvent) 2 wt % in coating liquid ethanol (solvent) 1 wt % in coating liquid (A glass transition point of the coated film was found to be 17° C.)

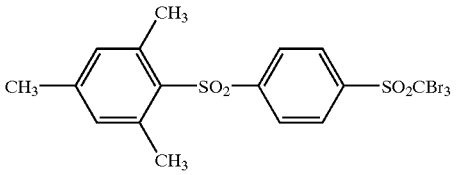

Polyhalogen Compound "A"

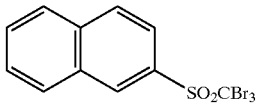

Polyhalogen Compound "B"

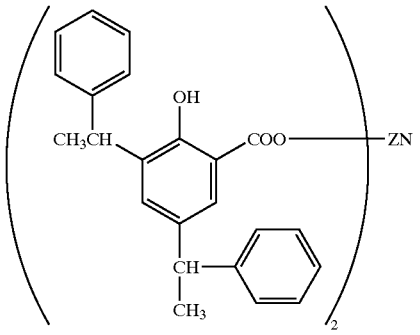

Compound "Z"

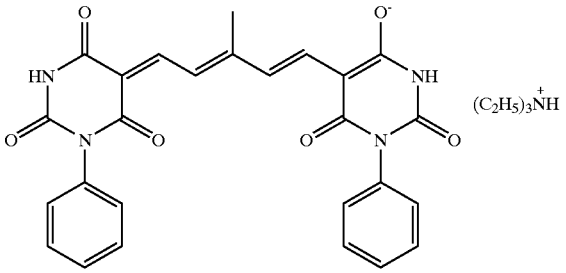

Dye "A"

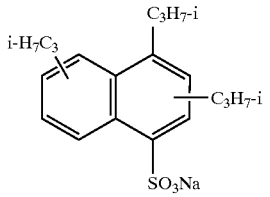

Compound "C"

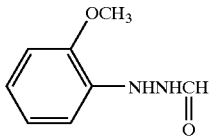

Nucleation Aid "A"

Preparation of Coating Liquid for Lower Protective Layer on the Emulsion Plane

Water was added to 943 g of a polymer latex solution of methyl methacrylate/styrene/2-ethylhexyl acrylate/2-hydrxyethyl methacrylate/acrylic acid copolymer [copolymerization ratio by weight=58.9/8.6/25.4/5.1/2, glass transition point of the copolymer=46° C. (estimated value), solid content=21.5%, containing 15% of Compound "D" as a filming aid, glass transition point of the coating liquid=24° C.], and further added thereto were 1.62 g of Compound "E", 1.98 g of a matting agent (polystyrene particle, average grain size=7 μm), and 29.4 g of polyvinyl alcohol (PVA-235, product of Kuraray Co., Ltd.), and still further added thereto was water, thereby to prepare the coating liquid [with a final concentration of Compound "A" as an antiseptic of 75 ppm (coated amount of 1.0 mg/m$^2$), and a methanol content of 2 wt %], which was followed by degassing under a reduced pressure lower than the atmospheric pressure by 400 mmHg for 60 minutes. The coating liquid was found to have a pH of 5.5 and a viscosity at 25° C. of 45 cp.

Preparation of Coating Liquid for Upper Protective Layer on the Emulsion Plane

Water was added to 649 g of a polymer latex solution of methyl methacrylate/styrene/2-ethylhexyl acrylate/2-hydrxyethyl methacrylate/acrylic acid copolymer [copolymerization ratio by weight=58.9/8.6/25.4/5.1/2, glass transition point of the copolymer=46° C. (estimated value), solid content=21.5%, containing 15% of Compound "D" as a filming aid, glass transition point of the coating liquid=24° C.], and further added thereto were 6.30 g of a 30 wt % solution of carnauba wax (Cellosol 524, product of Chukyo Oil and Fat, Ltd.), 0.23 g of Compound "C", 7.95 g of Compound "F", 0.93 g of Compound "G", 1.8 g of Compound "H", 1.18 g of a matting agent (polystyrene grain, average grain size=7 μm), and 12.1 g of polyvinyl alcohol (PVA-235, product of Kuraray Co., Ltd.), and still further thereto added was water, thereby to prepare the coating liquid [with a final concentration of Compound "A" as an antiseptic of 70 ppm (coated amount of 2.6 mg/m$^2$), and a methanol content of 1.5 wt %], which was followed by degassing under a reduced pressure lower than the atmospheric pressure by 400 mmHg for 60 minutes. The coating liquid was found to have a pH of 2.8 and a viscosity at 25° C. of 30 cp.

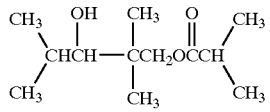

Compound "D"

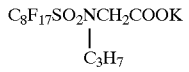

Compound "E"

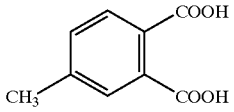

Compound "F"

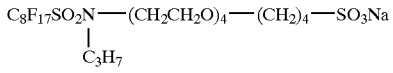

Compound "G"

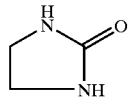

Compound "H"

Fabrication of PET Support (1) Fabrication of Support

PET with an intrinsic viscosity (IV) of 0.66 (measured in phenol/tetrachloroethane=6/4 (ratio by weight) at 25° C.) was obtained by the general procedures using terephthalic acid and ethylene glycol. The obtained PET was pelletized, dried at 130° C. for 4 hours, melted at 300° C., extruded from a T-die and rapidly cooled, to obtain a unstretched film so as to have a thickness after heat setting of 120 μm.

The film was then stretched in the moving direction 3.3 times at 110° C. using rollers different in the peripheral speed and then transversely stretched 4.5 times at 130° C. using a tenter. Subsequently, the film was heat-set at 240° C. for 20 seconds, and then relaxed by 4% in the transverse direction at the same temperature. Thereafter, a portion chucked by the tenter was slit off and the film was knurled at the both edges and then taken up under a tension of 4.8 kg/cm$^2$. Thus, a rolled support of 2.4 m wide, 3,500 m long and 120 μm thick was fabricated.

(2) Formation of Undercoat Layer and Back Layer (i) First Undercoat Layer

A coating liquid having a composition shown below was coated on the support in an amount of 6.2 ml/m$^2$, and was step wisely dried at 125° C. for 30 seconds, at 150° C. for 30 seconds and at 185° C. for 30 seconds.

Latex "A" 280 g
KOH 0.5 g
polystyrene grain (average grain size=2 μm) 0.03 g
cyanuryl chloride 1.8 g
distilled water amount for adjusting total weight to 1,000 g (ii) Second Undercoat Layer A coating liquid having a composition shown below was coated on the first undercoat layer in an amount of 5.5 ml/m$^2$, and was stepwisely dried at 125° C. for 30 seconds, at 150° C. for 30 seconds and at 170° C. for 30 seconds.

gelatin 10 g
acetic acid (20% aqueous solution) 10 g
Compound-Bc-A 0.04 g
methyl cellulose (2% aqueous solution) 25 g
polyethylene oxy compound 0.3 g
distilled water amount for adjusting total grain to 1,000 g (iii) First Back Layer A coating liquid having a composition shown below was coated on the corona-discharge-treated surface of the support opposite to the undercoat layers in an amount of 13.8 ml/m$^2$, and was stepwisely dried at 125° C. for 30 seconds, at 150° C. for 30 seconds and at 185° C. for 30 seconds.

Jurimer ET-410 (30%, product of Nippon Jun'yaku KK) 23 g
gelatin 5.28 g
Compound-Bc-A 0.02 g
Dye-Bc-A 0.88 g
polyoxyethylenephenyl ether 1.7 g
Sumitex Resin M-3 (8% aqueous solution of water-soluble melamine compound, product of Sumitomo Chemical) 15 g
FS-10D (water-base dispersion of Sb-doped $SnO_2$, product of Ishihara Sangyo Kaisha, Ltd.) 24 g
polystyrene grain (average grain size=2 μm) 0.03 g
distilled water amount for adjusting total weight to 1,000 g (iv) Second Back Layer A coating liquid having a composition shown below was coated on the first back layer in an amount of 5.5 ml/m$^2$, and was stepwisely dried at 125° C. for 30 seconds, at 150° C. for 30 seconds and at 170° C. for 30 seconds.

Jurimer ET-410 (30%, product of Nippon Jun'yaku KK) 57.5 g
polyoxyethylenephenyl ether 1.7 g
Sumitex Resin M-3 (8% aqueous solution of water-soluble melamine compound, product of Sumitomo Chemical) 15 g
Cellosol 524 (30% aqueous solution, product of Chukyo Oil and Fat, Ltd.) 6.6 g
distilled water amount for adjusting total weight to 1,000 g (v) Third Back Layer A coating liquid same as that for the first under coat layer was coated on the second back layer in an amount of 6.2 ml/m$^2$, and was stepwisely dried at 125° C. for 30 seconds, at 150° C. for 30 seconds and at 180° C. for.30 seconds.

(vi) Fourth Back Layer

A coating liquid having a composition shown below was coated on the third back layer in an amount of 13.8 ml /m$^2$, and was stepwisely dried at 125° C. for 30 seconds, at 150° C. for 30 seconds and at 170° C. for 30 seconds.

Latex "B" 286 g
Compound-Bc-B 1.5 g
Compound-Bc-C 0.6 g
Compound-Bc-D 0.5 g
Sumitex Resin M-3 (8% aqueous solution of water-soluble melamine compound, product of Sumitomo Chemical) 195 g
polymethyl methacrylate (10% water-base dispersion, average grain size=5 μm) 7.7 g
distilled water amount for adjusting total weight to 1,000 g

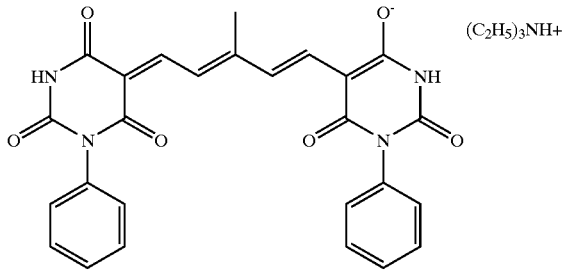

Dye-3c-A

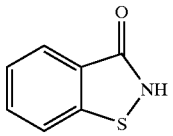

Compound-Bc-A $C_{18}H_{37}OSO_3Na$

Compound-Bc-B $C_8F_{17}SO_3Li$

Compound-Bc-C $C_8H_{17}SO_2-N(C_3H_7)-(CH_2CH_2O)_4-(CH_2)_4-SO_3Na$

Compound-Bc-D

Latex-A

Core/shell type latex, core/shell=90/10 (ratio in wt %)

core portion: vinylidene chloride/methyl acrylate/methyl methacrylate/acrylonitrile/acrylic acid=93/3/3/0.9/0.1 (wt %)

shell portion: vinylidene chloride/methyl acrylate/methyl methacrylate/acrylonitrile/acrylic acid=88/3/3/3/3 (wt %), weight average molecular weight=38,000

Latex-B methyl methacrylate/styrene/2-ethylhexyl acrylate/2-hydroxyethyl methacrylate/acrylic acid=59/9/26/5/1 (wt %)

(vii) Annealing Under Conveyance (vii-1) Annealing

Thus obtained PET support provided with the back layer and undercoat layer were introduced into an annealing zone of 200 m long set at 160° C., and conveyed at a tension of 2 kg/cm$^2$ and a conveyance rate of 20 m/minute.

(vii-2) Post Annealing

Following the foregoing annealing, the PET support was post-annealed by passing through a 40° C. zone for 15 seconds and was wound up into a roll at a winding tension of 10 kg/cm$^2$.

Fabrication of Photothermographic Material

On the undercoat layer, which comprises the lower and upper undercoat layers formed on the support, the above described coating liquid for the emulsion layer was coated so as to attain a coated silver amount of 1.5 g/m$^2$ using the slide bead coating method as shown in FIG. 1 of JP-A-2000-2964. Further thereon, the foregoing coating liquid for the lower protective layer was coated by the concomitant stackable coating method with the coating liquid for the emulsion layer so as to attain a coated solid amount of the polymer latex of 1.31 g/m$^2$. Still further thereon, the foregoing coating liquid for the upper protective layer was coated so as to attain a coated solid amount of the polymer latex of 3.02 g/m$^2$, thereby to fabricate the photothermographic material (sample).

Drying during the coating was effected, both in the constant-rate and falling-rate periods, at a dry bulb temperature of 70 to 75° C., a dew point of 8 to 25° C., a liquid film surface temperature of 35 to 40° C. in a horizontal drying zone (keeping the support inclined by 1.5 to 3° from the horizontal level of the coater). Winding after the drying was performed at 25±5° C. under the relative humidity of 45±10% so as to orient the emulsion coated plane outward for a convenience of the later processing (Em-out winding). A humidity in the bag for the photosensitive material was adjusted to 20 to 40% (measured at 25° C.).

As for the obtained photothermographic material, the film surface of the image-producing side thereof was found to have a pH of 5.0 and a Bekk smoothness of 850 seconds; and the film surface of the opposite side, pH of 5.9 and a Bekk smoothness 560 seconds.

The sample used in the evaluation (photographic property and surface property) described below was fabricated without exception by coating the coating liquid for the emulsion layer after being degassed under reduced pressure and then allowed to stand at 25° C. for 6 hours.

Evaluation of Photographic Property (Exposure)

The obtained photothermographic sample was exposed using a laser exposure apparatus of single-channel inner cylinder surface scanning type, provided with a semiconductor laser device having a beam spot size (FWHM at half beam intensity) of 12.56 μm, a laser output of 50 mW and an output wavelength of 783 nm, in which the exposure period was controlled by varying the number of rotation of the mirror, and the energy of exposure was adjusted by tuning the output value. Actual exposure was performed at $2\times10^{-8}$ seconds and an overlap coefficient of 0.449.

(Heat Development)

The photothermographic material after the exposure was heat-developed using a heat developing apparatus shown in FIG. 4, in which the roller surface being composed of silicone rubber, the smooth plane being composed of a non-woven Teflon (product name of tetrafluoroethylene) fabric, the heat development being effected in the preheating zone at 90 to 100° C. for 5 seconds, and in the developing zone at 120° C. for 20 seconds with a temperature accuracy in the transverse direction of ±1° C.

(Evaluation of Photographic Property)

Obtained image was evaluated using Macbeth TD904 densitometer (visible density). The results were evaluated for Dmin and Dmax.

Evaluation of Coated Surface Property

The obtained sample was visually checked for the coated surface property (surface quality) and classified into four following ranks, among which only ranks "A" and "B" being practically allowable:

rank "A"=good;

rank "B"=good at the center portion, irregular at both edges;

rank "C"=slight failure over the entire surface (coating streaks, agglomeration, crack, non-uniform drying); and rank "D"=significant failure over the entire surface (coating streaks, agglomeration, crack, non-uniform drying)

Results of evaluating the individual photothermographic materials were listed in Table 2.

TABLE 2

| Sample No. | Fatty acid silver salt dispersion | Nucleation aid | Photographic Property Dmin | Photographic Property Dmax | Surface quality | |
|---|---|---|---|---|---|---|
| 1 | A | — | 0.20 | 2.13 | D | |
| 2 | A | A | 0.22 | 3.59 | D | |
| 3 | A | 62 | 0.18 | 4.52 | D | |
| 4 | B | — | 0.14 | 2.15 | B | invention |
| 5 | B | A | 0.14 | 3.61 | B | invention |
| 6 | B | 62 | 0.13 | 4.62 | B | invention |
| 7 | C | 62 | 0.13 | 4.66 | A | invention |
| 8 | D | — | 0.14 | 2.13 | A | invention |
| 9 | D | A | 0.14 | 3.88 | A | invention |
| 10 | D | 62 | 0.11 | 4.68 | A | invention |
| 11 | E | — | 0.14 | 2.09 | A | invention |
| 12 | E | A | 0.15 | 3.56 | A | invention |
| 13 | E | 62 | 0.10 | 4.63 | A | invention |
| 14 | F | 62 | 0.13 | 4.60 | A | invention |
| 15 | G | — | 0.14 | 2.10 | A | invention |
| 16 | G | A | 0.14 | 3.39 | A | invention |
| 17 | G | 62 | 0.10 | 4.58 | A | invention |

It was found that the thermally processed image forming material of the present invention has a low Dmin and a good surface property. The Compounds expressed by the formulae (1) to (3) preferably used in the present invention (nucleation aid 62) gave higher Dmax than formylhydrazine compounds (nucleation aid "A") did. A smaller grain size of the dispersion and an excellent surface property of the photosensitive material employing such dispersion were obtained when the fatty acid silver salt grain dispersions "C" and "E" prepared by adding the third component at a low temperature, or the fatty acid silver salt grain dispersions "F" and "G" prepared by further cooling the mixture immediately after the reaction by supplying water of 10° C. to a heat exchanger were used.

On the contrary, the fatty acid silver salt grain dispersion "A" prepared by the conventional method could provide only a photosensitive material poorer both in the surface quality and Dmax, since the grains are slightly larger in size than in the dispersions used in the present invention and the grain size distribution is polydisperse.

These clearly prove effects of the present invention

Example 2

Fabrication of PET Support

PET with an intrinsic viscosity (IV) of 0.66 (measured in phenol/tetrachloroethane=6/4 (ratio by weight) at 25° C.) was obtained by the general procedures using terephthalic acid and ethylene glycol. The obtained PET was pelletized, dried at 130° C. for 4 hours, melted at 300° C., extruded from a T-die and rapidly cooled, to obtain a unstretched film so as to have a thickness after heat setting of 175 μm.

The film was then stretched in the moving direction 3.3 times at 110° C. using rollers different in the peripheral speed and then transversely stretched 4.5 times at 130° C. using a tenter. Subsequently, the film was heat-set at 240° C. for 20 seconds, and then relaxed by 4% in the transverse direction at the same temperature. Thereafter, a portion chucked by the tenter was slit off and the film was knurled at the both edges and then wound up into a roll. Thus, a rolled support of 175 μm thick was fabricated.

Surface Corona Treatment

Using a solid state corona treatment apparatus (6-kvA model, product of Pillar Corporation), the both planes of the support were treated at 20 m/min under the room temperature. Referring to indicator of current and voltage, it was confirmed that the support was treated at 0.375 kVA.minute/

$m^2$. The treatment frequency was 9.6 kHz and the gap clearance between the electrode and dielectric roll was 1.6 mm.

Fabrication of Undercoated Support (Preparation of Coating Liquid for the Undercoat Layer)

Formulation (1) (for undercoat layer on the photosensitive layer side)

- Pesresin A-515GB (30 wt % solution, manufactured by Takamatsu Oil & Fat Co., Ltd.) 234 g
- polyethylene glycol mononononylphenyl ether (average number of ethylene oxide=8.5), 10 wt % solution 21.5 g
- MP-1000 (polymer micrograin, average grain size=0.4 μm, manufactured by Soken Chemical & Engineering Co., Ltd.) 0.91 g
- distilled water 744 ml Formulation (2) (for a first layer on the back side)

- butadiene-styrene copolymer latex (solid content 40 wt %, ratio by weight of butadiene/styrene=32/68) 158 g
- 2,4-dichloro-6-hydroxy-S-triazine sodium salt (8 wt % aqueous solution) 20 g
- sodium laurylbenzenesulfonate (1 wt % aqueous solution) 10 ml
- distilled water 854 ml Formulation (3) (for a second layer on the back side)

- $SnO_2$/SbO (ratio by weight=9/1, average grain size=0.038 μm, 17 wt % dispersion) 84 g
- gelatin (10% aqueous solution) 89.2 g
- Methollose TC-5 (2% aqueous solution, Manufactured by Shin-Etsu Chemical Co., Ltd.) 8.6 g
- MP-1000 (polymer micrograin, manufactured by Soken Chemical & Engineering Co., Ltd.) 0.01 g
- sodium dodecylbenzenesulfonate (1 wt % aqueous solution) 10 ml
- NaOH (1%) 6 ml
- Proxel (manufactured by ICI Corporation) 1 ml
- distilled water 805 ml (Preparation of Undercoated Support)

Both planes of the biaxially stretched polyethylene terephthalate film of 175 μm thick were individually subjected to the corona discharge treatment, the undercoat coating liquid formulation (1) was then coated using a wire bar with a wet coated amount of 6.6 ml/$m^2$ on one plane (on the photosensitive layer side) and was allowed to dry at 180° C. for 5 minutes, the undercoat coating liquid formulation (2) was then coated using a wire bar with a wet coated amount of 5.7 ml /$m^2$ on the rear plane (back layer side) and was allowed to dry at 180° C. for 5 minutes, and the undercoat coating liquid formulation (3) was further coated using a wire bar with a wet coated amount of 7.7 ml/$m^2$ on the rear plane (back side) and was allowed to dry at 180° C. for 6 minutes, to obtain an undercoated support.

(Preparation of Coating Liquid for the Back Layer)

(Preparation of Solid Micrograin Dispersion (a) of Basic Precursor)

Sixty-four grams of Basic Precursor Compound "I", 28 g of diphenylsulfone, 10 g of Demol-N (surfactant, product of KAO Corporation), and 220 ml of distilled water were mixed, and the mixture was bead-dispersed using a sand mill (¼-gallon Sand Grinder Mill manufactured by AIMEX Corporation) to obtain a solid micrograin dispersion (a) of the basic precursor compound with an average grain size of 0.2 μm.

(Preparation of Solid Micrograin Dispersion of Dye)

To 305 ml of distilled water, added were 9.6 g of the Cyanine Dye Compound "J" and 5.8 g of sodium p-dodecylbenzenesulfonate, and the mixture was then bead-dispersed using a sand mill (¼-gallon Sand Grinder Mill manufactured by AIMEX Corporation) to obtain a solid micrograin dispersion of the dye with an average grain size of 0.2 μm.

(Preparation of Coating Liquid for the Antihalation Layer)

Seventeen grams of gelatin, 9.6 g of polyacrylamide, 70 g of the above-described solid micrograin dispersion (a) of the basic precursor, 56 g of the above-described solid micrograin dispersion of the dye, 1.5 g of polymethyl methacrylate micrograin (average grain size=6.5 μm), 0.03 g of benzoisothiazolinone, 2.2 g of sodium polyethylenesulfonate, 0.2 g of Blue Dye Compound K and 844 ml of water were mixed to prepare a coating liquid for the antihalation layer.

(Preparation of Coating Liquid for the Protective Layer on the Back Side)

While keeping the temperature of a vessel at 40° C., 50 g of gelatin, 0.2 g of sodium polystyrenesulfonate, 2.4 g of N,N-ethylenebis(vinylsulfoneacetamide), 1 g of sodium t-octyl-phenoxyethoxyethanesulfonate, 30 mg of benzothiazolinone, 37 mg of N-perfluorooctylsulfonyl-N-propylalanine potassium salt, 0.15 g of polyethyleneglycol mono(N-perfluorooctylsulfonyl-N-propyl-2-aminoethyl) ether [an average degree of polymerization of ethylene oxide=15], 32 mg of $C_8F_{17}SO_3K$, 64 mg of $C_8F_{17}SO_2N(C_3H_7)(C_3H_7)(CH_2CH_2O)_4(CH_2)_4—SO_3Na$, 8.8 g of acrylic acid/ethyl acrylate copolymer (copolymerization ratio by weight=5/95), 0.6 g of Aerosol OT (American Cyanamide Corporation), liquid paraffin emulsion containing 1.8 g of liquid paraffin, and 950 ml of water were mixed to obtain a coating liquid for the protective layer on the back side.

(Preparation of Silver Halide Emulsion 1)

A solution comprising 1,421 ml of water added with 8.0 ml of an 1 wt % potassium bromide solution, 8.2 ml of an 1 mol/L nitric acid and 20 g of phthalized gelatin was kept stirred in a titanium-coated stainless reaction vessel at a constant liquid temperature of 37° C., and was then added with an entire volume of solution "A" obtained by dissolving 37.04 g of silver nitrate in distilled water and diluting it up to 159 ml, by the controlled double jet method at a constant flow rate over 1 minute while keeping pAg at 8.1. Solution "B" obtained by dissolving 32.6 g of potassium bromide in water and diluting it up to 200 ml was also added by the controlled double jet method. After that, 30 ml of a 3.5 wt % aqueous hydrogen peroxide solution was added, and 36 ml of a 3 wt % aqueous solution of benzimidazole was further added. Solution "A" was further diluted with distilled water to 317.5 ml to obtain solution "A2", and solution "B" was further added with tripotassium hexachloroiridate so as to attain a final concentration thereof of $1\times10^{-4}$ mol per mol of silver and diluted with distilled water up to doubled volume of 400 ml to obtain solution "B2". Again an entire volume of solution "A2" was added to the mixture by the controlled double jet method at a constant flow rate over 10 minutes while keeping pAg at 8.1. Solution "B2" was also added by the controlled double jet method. Thereafter, the mixture was added with 50 ml of a 0.5% methanol solution of 5-methyl-2-mercaptobenzimidazole, the pAg of which adjusted to 7.5 with silver nitrate, the pH of which then adjusted to 3.8 with a 0.5 mol/L sulfuric acid, stopped stirring, subjected to precipitation/desalting/washing processes, added with 3.5 g of deionized gelatin, the pH and pAg of which adjusted to 6.0 and 8.2, respectively, with an 1 mol/L sodium hydroxide to obtain a silver halide emulsion.

Grains in the resultant silver halide emulsion were found to be pure silver bromide grains with an average sphere-equivalent diameter of 0.053 μm and a sphere-equivalent coefficient of variation of 18%. Grain size and so forth were determined based on an average diameter of 1000 grains under electron microscopic observation. Ratio of [100] plane of such grains was determined as 85% based on the method of Kubelka-Munk.

The above emulsion was kept at 38° C. under stirring, 0.035 g of benzoisothiazolinone (in a form of a 3.5 wt % methanol solution) was added thereto, a solid dispersion of Spectral Sensitization Dye "B" (aqueous gelatin solution) was added thereto 40 minutes after in an amount of $5\times10^{-3}$ mol per mol of silver, the temperature thereof was raised to 47° C. one minute after, sodium benzenethiosulfonate was added thereto 20 minutes after in an amount of $3\times10^{-5}$ mol per mol of silver, Tellurium Sensitizer "A" was added thereto 2 minutes after in an amount of $5\times10^{-5}$ mol per one mol of silver, and was then ripened for 90 minutes. Immediately before completion of the ripening, 5 ml of a 0.5 wt % methanol solution of N,N'-dihydroxy-N"-diethylmelamine was added, temperature of which was lowered to 31° C., and 5 ml of a 3.5 wt % methanol solution of phenoxy ethanol, $7\times10^{-3}$ mol per mol of silver of 5-methyl-2-mercaptobenzimidazole, and $6.4\times10^{-3}$ mol per mol of silver or 1-phenyl-2-heptyl-5-mercapto-1,3,4-triazole were added to obtain a silver halide emulsion 1.

(Preparation of Silver Halide Emulsion 2)

An emulsion containing pure cubic silver bromide grains with an average sphere-equivalent diameter of 0.08 μm and a sphere-equivalent coefficient of variation of 15% was prepared similarly to the preparation of silver halide emulsion 1 except that the temperature of the mixed solution during particle formation was raised to 50° C. from 37° C. Precipitation/desalting/washing/dispersion were performed similarly to those in the case of silver halide emulsion 1. Except that the amount of addition of Spectral Sensitization Dye "B" is altered to $4.5\times10^{-3}$ mol per mol of silver, the addition of the Spectral Sensitization Dye "B", Tellurium Sensitizer "A", 5-methyl-2-mercaptobenzimidazole, and 1-phenyl-2-heptyl-5-mercapto-1,3,4-triazole were also performed similarly to those in the case of the emulsion 1, to obtain the silver halide emulsion 2.

(Preparation of Silver Halide Emulsion 3)

An emulsion containing pure cubic silver bromide particle with an average sphere-equivalent diameter of 0.038 μm and a sphere-equivalent coefficient of variation of 20% was prepared similarly to the preparation or silver halide emulsion 1 except that the temperature of the mixed solution during particle formation was lowered to 27° C. from 37° C. Precipitation/desalting/washing/dispersion were performed similarly to those in the case of silver halide emulsion 1. Except that the amount of addition of Spectral Sensitization Dye "B" is altered to $6\times10^{-3}$ mol per one mol of silver, the addition of the Spectral Sensitization Dye "B", Tellurium Sensitizer "A", 5-methyl-2-mercaptobenzimidazole, and 1-phenyl-2-heptyl-5-mercapto-1,3,4-triazole were also performed similarly to those in the case of the emulsion 1, to obtain the silver halide emulsion 3.

(Preparation of Mixed Emulsion "B" for Coating Liquid)

Mixed were 70 wt % of silver halide emulsion 1, 15 wt % of silver halide emulsion 2 and 15 wt % of silver halide emulsion 3, and thereto an 1 wt % aqueous solution of benzothiazolium iodide was added in an amount of $7\times10^{-3}$ mol per mol of silver.

(Preparation of 25 wt % Dispersion of Reducing Agent)

Ten kilograms of 1,1-bis(2-hydroxy-3,5-dimethylphenyl)-3,5,5-trimethylhexane and 10 kg of a 20 wt % aqueous solution of a modified polyvinylalcohol (Poval MP-203, product of Kuraray Co., Ltd.) were added with 16 kg of water, and were then thoroughly mixed to prepare a slurry. The slurry was then fed with the aid of a diaphragm pump to a lateral sand mill (UVM-2, manufactured by Aimex, Ltd.) filled with zirconia bead with an average diameter of 0.5 mm, dispersed for 3.5 hours, added with 0.2 g of benzoisothiazolinone sodium salt and water so as to adjust the concentration of the reducing agent to 25 wt %, to obtain a dispersion of the reducing agent. Reducing agent grains contained in thus obtained dispersion were found to have a median diameter of 0.42 μm and a maximum diameter of 2.0 μm or less. The obtained reducing agent dispersion was filtered through a polypropylene filter with a pore size of 10.0 μm to separate dust or other foreign matters and then stored.

(Preparation of 10 wt % Dispersion of Mercapto Compound)

Five kilograms of 1-phenyl-2-heptyl-5-mercapto-1,3,4-triazole and 5 kg of a 20 wt % aqueous solution of a modified polyvinyl alcohol (Poval MP-203, product of Kuraray Co., Ltd.) were added with 8.3 kg of water, and then mixed thoroughly to prepare a slurry. The slurry was then fed with the aid of a diaphragm pump to a lateral sand mill (UVM-2, manufactured by Aimex, Ltd.) filled with zirconia bead with an average diameter of 0.5 mm, dispersed for 6 hours, added with water so as to adjust the concentration of the mercapto compound to 10 wt %, to obtain a dispersion of the mercapto compound. Mercapto compound grains contained in thus obtained dispersion were found to have a median diameter of 0.40 μm and a maximum diameter of 2.0 μm or less. The obtained mercapto compound dispersion was filtered through a polypropylene filter with a pore size of 10.0 μm to separate dust or other foreign matters and then stored.

(Preparation of 20 wt % Dispersion-1 of Organic Polyhalogen Compound)

Five kilograms of tribromomethylnaphthylsulfone, 2.5 kg of a 20 wt % aqueous solution of a modified polyvinyl alcohol (Poval MP-203, product of Kuraray Co., Ltd.), and 213 g of a 20 wt % aqueous solution of sodium triisopropylnaphthalenesulfonate were added with 10 kg of water, and then mixed thoroughly to prepare a slurry. The slurry was then fed with the aid of a diaphragm pump to a lateral sand mill (UVM-2 manufactured by Aimex, Ltd.) filled with zirconia bead with an average diameter of 0.5 mm, dispersed for 5 hours, added with 0.2 g of benzoisothiazolinone sodium salt and water so as to adjust the concentration of the organic polyhalogen compound to 20 wt %, to obtain a dispersion of the organic polyhalogen compound. Organic polyhalogen compound particle contained in thus obtained dispersion was found to have a median diameter of 0.36 μm and a maximum diameter of 2.0 μm or less. The obtained organic polyhalogen compound dispersion was filtered through a polypropylene filter with a pore size of 3.0 μm to separate dust or other foreign matters and then stored.

(Preparation of 20 wt % Dispersion-2 of Organic Polyhalogen Compound)

Dispersion was performed similarly to the case with the 20 wt % dispersion-1 of the organic polyhalogen compound, except that using 5 kg of tribromomethyl [4-(2,4,6-trimethylphenylsulfonyl)phenyl]sulfone in place of 5 kg of tribromomethylnaphthylsulfone, which was followed by dilution so as to attain a content of the organic polyhalogen compound of 25 wt %, and by filtration. Organic polyhalogen compound particle contained in thus obtained dispersion was found to have a median diameter of 0.38 μm and a maximum diameter of 2.0 μm or less. The obtained organic polyhalogen compound dispersion was filtered through a polypropylene filter with a pore size of 3.0 μm to separate dust or other foreign matters and then stored.

(Preparation of 20 wt % Dispersion-3 of Organic Polyhalogen Compound)

Dispersion was performed similarly to the case with the 20 wt % dispersion-1 of the organic polyhalogen compound except that using 5 kg of tribromomethylphenylsulfone in place of 5 kg of tribromomethylnaphthylsulfone and that raising the amount of addition of the 20 wt % aqueous solution of MP-203 to 5 kg, which was followed by dilution so as to attain a content of the organic polyhalogen compound of 30 wt %, and by filtration. Organic polyhalogen compound grains contained in thus obtained dispersion were found to have a median diameter of 0.41 μm and a maximum diameter of 2.0 μm or less. The obtained organic polyhalogen compound dispersion was filtered through a polypropylene filter with a pore size of 3.0 μm to separate dust or other foreign matters and then stored at 10° C. when it is not used.

(Preparation of 10 wt % Methanol Solution of Phthalazine Compound)

Ten grams of 6-isopropylphthalazine was dissolved in 90 g of methanol and used.

(Preparation of 20 wt % Dispersion of Pigment)

Sixty-four grams of C.I. Pigment Blue 60 and 6.4 g of Demol-N (surfactant, product of Kao Corporation) were added with 250 g of water, and then mixed thoroughly to prepare a slurry. The slurry was then fed into a vessel of a dispersion apparatus (1/4G Sand Grinder Mill manufactured by Aimex, Ltd.) together with 800 g of zirconia bead with an average diameter of 0.5 mm, and dispersed for 25 hours to obtain a pigment dispersion. Pigment particle contained in thus obtained dispersion was found to have an average diameter of 0.21 μm.

(Preparation of 40 wt % Solution of SBR Latex)

(1) Preparation of 40 wt % SBR Latex-1

SBR latex purified by ultrafiltration was obtained as follows:

A ten-fold diluted aqueous solution of the SBR latex shown below was diluted and purified using UF-purification module FS03-FC-FUY01A1 (manufactured by Daicel Membrane-Systems Ltd.) until the ion conductivity is reduced as low as 1.5 mS/cm, Sandet-BL (product of Sanyo Chemical Industries) was then added so as to attain a concentration of 0.22 wt %, and NaOH and $NH_4OH$ were further added so as to attain a molar ratio of $Na^+:NH_4^+=1:2.3$ and a pH of 8.4. The resultant latex concentration was found to be 40 wt %.

(SBR latex: expressed as -St(68)-Bu(29)-AA(3)-, where St=styrene, Bu=butadiene and AA=acrylic acid, average particle size=0.1 μm, concentration=45%, equilibrium water content at, 25° C., 60% RH=0.6 wt %, ion conductivity=4.2 mS/cm (measured for latex solution (40%) at 25° C. using a conductometer CM-305 manufactured by TOA Electronics Ltd.), pH 8.2

(Preparation of Coating Liquid for Emulsion Layer (Photosensitive Layer)

Mixed were 1.1 g of the above-obtained 20 wt % dispersion of the pigment, 103 g of any one of the organic acid silver dispersions "A" to "G" (see Table 3), 5 g of a 20 wt % aqueous solution of polyvinyl alcohol PVA-205 (product of Kuraray Co., Ltd.), 25 g of the above-obtained 25 wt % dispersion of the reducing agent, total 11.5 g of 5:1:3 mixture (ratio by weight) of the 20 wt % dispersions-1, -2 and -3 of the organic polyhalogen compounds, 6.2 g of the 10 wt % dispersion of the mercapto compound, 106 g of the 40 wt % solution of SBR latex purified by ultrafiltration (UF) and 16 ml of the 10 wt % methanol solution of the phthalazine compound, and further added thereto was 10 g of silver halide mixed emulsion "B". The mixture was then thoroughly mixed to obtain a coating liquid for the emulsion layer, which was then directly fed to a coating die and coated in an amount of 70 ml/$m^2$.

Viscosity of such coating liquid for the emulsion layer was measured using a B-type viscometer (manufactured by Tokyo Keiki K.K.) at 40° C., (with No. 1 rotor at 60 rpm) and was found to be 85 mPa S.

Viscosities of the coating liquid measured under shearing velocities of 0.1, 1, 10, 100 and 1000 (1/second) at 25° C. using RFS Fluid Spectrometer (manufactured by Rheometrix Far East Inc.) were 1500, 220, 70, 40 and 20 mPa.s, respectively.

(Preparation of Coating Liquid for Intermediate Layer on the Emulsion Plane)

A coating liquid for the intermediate layer was prepared by mixing 772 g of a 10 wt % aqueous solution of polyvinyl alcohol PVA-205 (manufactured by Kuraray Co., Ltd.), 5.3 g of the 20 wt % dispersion of the pigment, 226 g of a 27.5 wt % solution of methyl methacrylate/styrene/butyl acrylate/hydroxyethyl methacrylate/acrylic acid copolymer latex (copolymerization ratio by weight of 64/9/20/5/2), 2 ml of a 5 wt % aqueous solution of Aerosol OT (American Cyanamide Corporation) and 10.5 ml of a 20 wt % aqueous solution of diammonium phthalate, and by adding water so as to adjust the total weight to 880 g, which was then fed to a coating die so as to attain a coating amount of 10 ml/$m^2$.

Viscosity of the coating liquid measured at 40° C. using a B-type viscometer (with No. 1 rotor at 60 rpm) was found to be 21 mPa.S.

(Preparation of Coating Liquid for First Protective Layer on the Emulsion Plane)

Sixty-four grams of inert gelatin was dissolved in water, and added thereto were 80 g of a 27.5 wt % solution of methyl methacrylate/styrene/butyl acrylate/hydroxyethyl methacrylate/acrylic acid copolymer latex (copolymerization ratio by weight of 64/9/20/5/2), 64 ml of a 10 wt % methanol solution of phthalic acid, 74 ml of a 10 wt % aqueous solution of 4-methylphthalic acid, 28 ml of 0.5 mol/L sulfuric acid, 5 ml of a 5 wt % aqueous solution of Aerosol 0T (American Cyanamide Corporation.), 0.5 g of phenoxyethanol and 0.1 g or benzoisothiazolinone, and further added with water so as to adjust the total weight to 750 g, thereby to prepare the coating liquid. Twenty-six milliliters of a 4 wt % chrome alum solution was added using a static mixer immediately before the coating, which was fed to a coating die so as to attain a coating amount of 18.6 ml/$m^2$.

Viscosity of the coating liquid measured at 40° C. using a B-type viscometer (with No. 1 rotor at 60 rpm) was found to be 17 mPa.S.

(Preparation of Coating Liquid for Second Protective Layer on the Emulsion Plane)

Eighty grams of inert gelatin was dissolved in water, and added thereto where 102 g of a 27.5 wt % solution of methyl methacrylate/styrene/butyl acrylate/hydroxyethyl methacrylate/acrylic acid copolymer latex (copolymerization ratio by weight of 64/9/20/5/2), 3.2 ml of a 5 wt % solution of N-perfluorooctylsulfonyl-N-propylalanine potassium salt, 32 ml of a 2 wt % aqueous solution of polyethyleneglycol mono(N-perfluorooctylsulfonyl-N-propyl-2-aminoethyl)ether [average degree of polymerization of ethylene oxide=15], 23 ml of a 5 wt % aqueous solution of Aerosol OT (American Cyanamide corporation), 4 g of polymethyl methacrylate micrograin (average grain size 0.7 μm), 21 g of polymethylmethacrylate micrograin (average grain size=6.4 μm), 1.6 g of 4-methylphthalic acid, 8.1 g of phthalic acid, 44 ml of a 0.5 mol/L sulfuric acid, 10 mg of benzoisothiazolinone, and further added thereto water so as to adjust the total weight to 650 g. Immediately before the coating, 445 ml of an aqueous solution containing 4 wt % chrome alum and 0.67% of phthalic acid was added using a static mixer, thereby to prepare the coating liquid, which was fed to a coating die so as to attain a coating amount of 8.3 ml/$m^2$.

Viscosity of the coating liquid measured at 40° C. using a B-type viscometer (with No 1 rotor at 60 rpm) was found to be 9 mPa.S.

(Fabrication of Photothermographic Material)

On the back side of the undercoated support, the coating liquid for the antihalation layer and the coating liquid for the back side protective layer were formed by simultaneous stackable coating, so as to attain a coated amount of solid dye grain of 0.04 g/$m^2$ for the former, and a coated amount of gelatin of 1 g/$m^2$ for the latter, respectively. The coated films were then dried to obtain a back layer for preventing halation.

On the opposite plane of the back side and on the undercoat layer, an emulsion layer (in a coated silver amount of the silver halide of 0.14 g/$m^2$), an intermediate layer, a first protective layer and a second protective layer were formed in this order by the simultaneous stackable coating in the slide beead coating process, thereby to obtain a sample of the photothermographic material.

The sample used in the evaluation (photographic property and surface property) described below was fabricated without exception by coating the coating liquid for the emulsion layer after being allowed to stand at 25° C. for 6 hours.

The coating was effected at a speed of 160 m/min while keeping a gap between the tip of the coating die and the support at 0.14 to 0.28 mm, and adjusting so that coating width becomes wider than the width of the slit for ejecting the coating liquid by 0.5 mm each from the both edges, and keeping a pressure in a reduced pressure chamber lower by 392 Pa than the atmospheric pressure. Care was taken for handling and controlling the temperature and humidity so as to prevent electric charging of the support. Next, the coated liquid was cooled in a chilling zone by flowing air with a dry-bulb temperature of 18° C. and a wet-bulb temperature of 12° C. for 30 seconds, then dried in a helical floating drying zone by blowing wind with a dry-bulb temperature of 30° C. and a wet-bulb temperature of 18° C. for 200 seconds, further dried in a drying zone at 70° C. for 20 seconds, still further dried in a drying zone at 90° C. for 10 seconds, then cooled to 25° C. to vaporize the solvent in the coated liquid. An average velocity of the wind blown onto the surface of the coated liquid in the chilling zone and drying zone was 7 m/s.

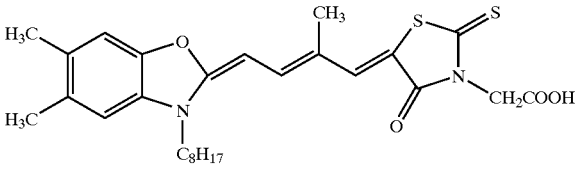

Spectral Sensitization Dye "B"

-continued

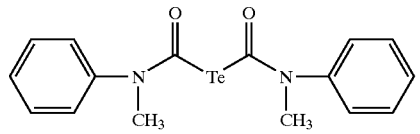

Tellurium Sensitizer "A"

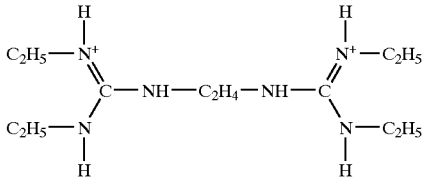

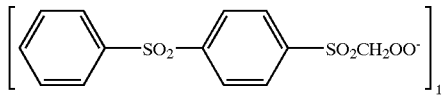

Basic Precursor Compound "I"

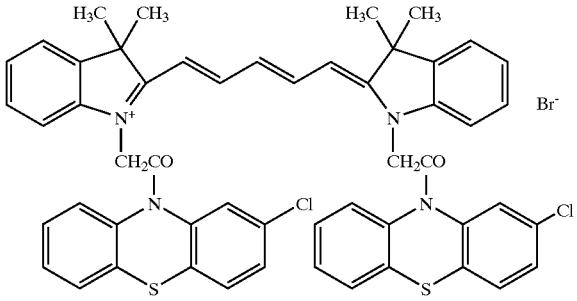

Cyanine Dye Compound "J"

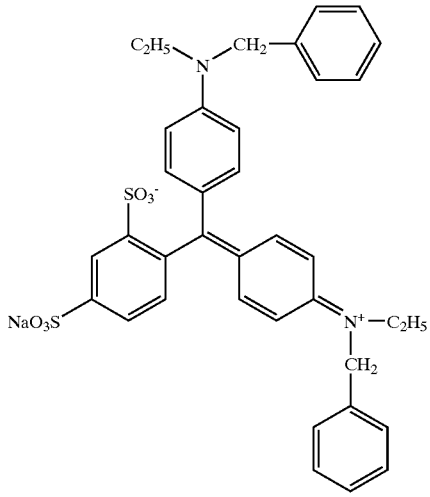

Blue Dye Compound "K"

(Evaluation of Photographic Properties)

The photographic material was exposed using a laser sensitometer, then subjected to heat development at 118° C. for 5 seconds and successively at 122° C. for 16 seconds (heat development), and density of the obtained image was measured with Macbeth TD904 densitometer (visible density). The results were evaluated for Dmin and Dmax.

Laser sensitometer: 35 mw outputs from two 660-nm diode laser units superposed, single-mode, $1/e^2$ Gaussian beam spot size=100 μm, 25 μm shift in the sub-scanning direction, quadruple writing for one pixel Evaluation of Coated Surface Property The obtained sample was visually checked for the coated surface property as described in Example 1 and ranked.

Results of evaluating the individual photothermographic materials were listed in Table 3.

TABLE 3

| Sample No. | Fatty acid silver salt dispersion | Photographic Property Dmin | Photographic Property Dmax | Surface quality | |
|---|---|---|---|---|---|
| 1 | A | 0.20 | 3.32 | D | |
| 2 | B | 0.16 | 3.61 | B | invention |
| 3 | C | 0.15 | 3.66 | A | invention |
| 4 | D | 0.16 | 3.59 | A | invention |
| 5 | E | 0.15 | 3.58 | A | invention |
| 6 | F | 0.17 | 3.62 | B | invention |
| 7 | G | 0.15 | 3.65 | A | invention |

It was confirmed that, similar to Example 1, the thermally processed image forming material of the present invention is low in Dmin and excellent in the surface property.

Example 3

The photothermographic material was fabricated as described in Example 1, except that using a silver halide emulsion A' in place of the organic silver salt grain dispersions "A" to "G", and that using the fatty acid silver salt grain dispersions A' to J' in place of fatty acid silver salt grain dispersions "A" to "G" used in Example 1.

(Preparation of Silver Halide Emulsion A')

To 700 ml of distilled water, 11 g of alkali-treated gelatin (calcium content≦2,700 ppm), 30 mg of potassium bromide and 1.3 g of sodium 4-methylbenzenesulfonate were dissolved at 40° C., pH of the mixture was adjusted at 6.5, and added thereto were 159 ml of an aqueous solution containing 18.6 g of silver nitrate and an aqueous solution containing 1 mol/L of potassium bromide, $5\times10^{-6}$ mol/L of $(NH_4)_2RhCl_5(H_2O)$, and $2\times10^{-5}$ mol/L of $K_3IrCl_6$ over 6 minutes and 30 seconds by the controlled double jet method while keeping pAg at 7.7. The further added were 476 ml of an aqueous solution containing 55.5 mg of silver nitrate and an aqueous halogen salt solution containing 1 mol/L of potassium bromide and $2\times10^{-5}$ mol/L of $K_3IrCl_6$ over 28 minutes and 30 seconds by the controlled double jet method while keeping pAg at 7.7. After the pH of the mixture was lowered to effect agglomerative precipitation and desalting, 51.1 g of low-molecular-weight gelatin (average molecular weight=15,000, calcium content≦20 ppm) was added, and the pH and pAg were adjusted to 5.9 and 8.0, respectively. The obtained grains were found to be cubic grains having an average grain size of 0.08 μm, a coefficient of variation of the projected area of 9%, and a ratio of [100] plane of 90%.

The above emulsion was then heated to 60° C., added with $7.6\times10^{-5}$ mol/mol Ag of sodium benzenethiosulfonate, and 3 minutes after further added with $7.1\times10^{-5}$ mol/mol Ag of triethylthiourea, ripened for 100 minutes, added with $5\times10^{-4}$ mol/mol Ag of 4-hydroxy-6-methyl-1,3,3a,7-tetrazaindene and 0.17 g of Compound "A", and then cooled to 40° C.

Thereafter, while keeping the liquid temperature at 40° C. under stirring, $4.7\times10^{-2}$ mol/mol Ag of potassium bromide (as an aqueous solution), $12.8\times10^{-4}$ mol/mol Ag of Sensitization Dye "A" (as an ethanol solution), and $6.4\times10^{-3}$ mol/mol Ag of Compound "B" (as a methanol solution) were added, and 20 minutes after the mixture was rapidly cooled to 30° C., thereby to complete the preparation of silver halide emulsion A'.

(Preparation of Fatty Acid Silver Salt Grain Dispersions A' to C')

The fatty acid silver salt grain dispersions A' to C' were prepared similarly to the preparation of the fatty acid silver salt grain dispersion "A" in Example 1 except that the pressure during the dispersion using a Micro Fluidizer succeeding the preliminary dispersion was altered as listed in Table 4 below.

(Preparation of Fatty Acid Silver Salt Grain Dispersions D' to F')

The reaction, crystallization, desalting and wet cake process were conducted as described for the fatty acid silver salt grain dispersion "A". To the wet cake equivalent to a dry weight of 100 g, 7.4 g of polyvinyl alcohol (product name; PVA-217, average degree of polymerization of ca. 1,700) and water were added to adjust a total volume of 3,850 g, the temperature of which was adjusted to 25° C. The mixture was then passed once through the dispersion cell shown in FIG. 5 and cooled, thereby to obtain the fatty acid silver salt grain dispersions D' to F'.

(Preparation of Fatty Acid Silver Salt Grain Dispersions G' and H')

In the preparation of the fatty acid silver salt grain dispersion D', a joint dispersion cell combining the cells shown in FIGS. 5 and 6 was used. More specifically, used here was a joint cell composed by connecting the inlet 106 of the dispersion cell shown in FIG. 5 to the outlet 117 of the dispersion cell shown in FIG. 6. The fatty acid silver salt grain dispersions G' and M' were obtained by introducing a mixed solution of polyvinyl alcohol and water conditioned at 25° C. through the inlet 116, and the fatty acid silver salt grains in a form of a wet cake through the inlet 119, and by passing the introduced materials once at a pressure listed in Table 4, which was followed by cooling.

(Preparation of Fatty Acid Silver Salt Grain Dispersion I')

The dispersion "I" was prepared using a small-sized crystallization equipment as shown in FIG. 2. while stirring in a tank 12 a mixture of 876 g of behenic acid (Edenor C22-85R, product of Henkel Corporation), 4,230 ml of distilled water and 1,200 ml of tert-butanol at 75° C., added thereto was 492 ml of a 5 mol/L aqueous NaOH solution over 5 minutes, and was then allowed to react for 60 minutes to obtain sodium behenate solution. Independently, 2,062 ml of aqueous solution containing 404 g of silver nitrate (pH 4.0) was prepared and kept in a tank 11 at 10° C. A tank 20 was pre-charged with a measured volume of 6,000 ml of water, which was circulated at a flow rate of 1,000 ml/minute via a pump 17. While rotating rotating blades of a mixing apparatus 18 (Pipeline Mixer Model LR-I, product of Mizuho Kogyo K.K.) at 10,000 rpm, the above aqueous silver nitrate solution in the tank 11 was fed at a constant flow rate of 29 ml/minute, and 5 seconds after, the sodium behenate solution in the tank 12 was fed at a constant flow rate of 98 ml/minute, which were then sent via an heat exchanger 19 to be stocked in the tank 20. An average temperature of the content of the tank 20 was 30° C., when a cooling water of 10° C. was supplied both to the heat exchanger 19 and a jacket of the tank 20 at 20 L/minute. The mixture was allowed to stand for 20 minutes under stirring, and then cooled to 25° C. The solid content was separated by suction filtration, and then washed with water until electric conductivity of the wash water by decreased as low as 30 μS/cm. The obtained solid content was stored in a form of a wet cake without drying.

Successive processes for preparing the dispersion I' of the fatty acid silver salt grains are similar to those for the dispersion F'.

(Preparation of Fatty Acid Silver Salt Grain Dispersion J')

All processes through the preparation of the wet cake were conducted similarly to those in the preparation o the fatty acid silver salt grain dispersion I', and thereafter the dispersion was performed similarly to that in the production of the fatty acid silver salt grain dispersion H', thereby to obtain the dispersion J'.

Conditions for the preparation, average grain size (volume weighted mean diameter) and viscosity for the fatty acid silver salt grain dispersions A' to J' were summarized in Table 4. The grain size was measured using MasterSizer X manufactured by Malvern Instruments, Ltd.

TABLE 4

| Fatty acid silver grain dispersion | Method for reaction & crystallization | Dispersion apparatus | Pressure during dispersion (kg/cm$^2$) | Grain size Average ($\mu$m) | Grain size Coef. of variation (%) | Viscosity (mPa · s) |
|---|---|---|---|---|---|---|
| A' | tank | homomixer, microfluidizer | 500 | 0.75 | 33 | 10 |
| B' | tank | homomixer, microfluidizer | 1,000 | 0.58 | 29 | 19 |
| C' | tank | homomixer, microfluidizer | 1,700 | 0.35 | 35 | 36 |
| D' | tank | dispersion cell shown in FIG. 5 | 1,700 | 0.68 | 23 | 11 |
| E' (inv.) | tank | dispersion cell shown in FIG. 5 | 2,000 | 0.57 | 17 | 20 |
| F' (inv.) | tank | dispersion cell shown in FIG. 5 | 3,000 | 0.33 | 16 | 38 |
| G' (inv.) | tank | joint dispersion cell combining cells shown in FIGS. 5 and 6 | 2,000 | 0.56 | 18 | 18 |
| H' (inv.) | tank | joint dispersion cell combining cells shown in FIGS. 5 and 6 | 3,000 | 0.34 | 16 | 40 |
| I' (inv.) | closed mixing apparatus | dispersion cell shown in FIG. 5 | 3,000 | 0.35 | 11 | 39 |
| J' (inv.) | closed mixing apparatus | joint dispersion cell combining cells shown in FIGS. 5 and 6 | 3,000 | 0.34 | 10 | 41 |

(Evaluation of Photographic Properties)

The photothermographic material was fabricated using the foregoing material as described in Example 1, and similarly exposed and developed. Obtained image was evaluated using Macbeth TD904 densitometer (visible density). Results of the measurement were evaluated by Dmin (fog), Dmax (maximum density) and sensitivity (an inverse of a ratio of exposure energies giving Dmin and (Dmin plus 1.5), expressed in a relative value assuming a value for Sample 1 in FIG. 5 as 100|. Results were shown in Table 5. As for the sensitivity, a larger value indicates a higher sensitivity.

(Evaluation of Storability)

To evaluate Dmin under forced conditions, a pair of samples were prepared for individual thermally processed image forming materials, the image producing layer of which containing no Compound "Z", and one sample was stored in a refrigerator (−20° C.) and the other sample was kept at 50° C. and a relative humidity of 70% individually for 5 days.

The stored samples were exposed and heat-developed as described above, and Dmin (fog) of the obtained images were evaluated. Results were shown in Table 5.

TABLE 5

| Sample No. | Fatty acid silver salt grain dispersion | Nucleation aid | Photographic property Sensitivity | Photographic property Dmax | Photographic property Dmin | Storability (Dmin) |
|---|---|---|---|---|---|---|
| 1 | A' | — | 100 | 1.96 | 0.29 | 1.36 |
| 2 | B' | — | 101 | 2.21 | 0.21 | 1.23 |
| 3 | B' | A | 138 | 3.62 | 0.22 | 1.30 |
| 4 | B' | 62 | 152 | 4.48 | 0.18 | 1.11 |
| 5 | C' | — | 101 | 2.33 | 0.38 | 2.25 |
| 6 | D' | — | 98 | 2.13 | 0.27 | 1.09 |
| 7 | D' | A | 136 | 3.88 | 0.26 | 1.12 |
| 8 | D' | 62 | 148 | 4.68 | 0.23 | 0.98 |
| 9 (inv.) | E' | — | 102 | 2.09 | 0.14 | 0.45 |
| 10(inv.) | E' | A | 140 | 3.56 | 0.15 | 0.51 |
| 11(inv.) | E' | 62 | 156 | 4.63 | 0.10 | 0.33 |

TABLE 5-continued

| Sample No. | Fatty acid silver salt grain dispersion | Nucleation aid | Photographic property Sensitivity | Photographic property Dmax | Photographic property Dmin | Storability (Dmin) |
|---|---|---|---|---|---|---|
| 12(inv.) | F' | 62 | 155 | 4.60 | 0.13 | 0.35 |
| 13(inv.) | G' | — | 101 | 2.10 | 0.14 | 0.44 |
| 14(inv.) | G' | A | 135 | 3.39 | 0.14 | 0.52 |
| 15(inv.) | G' | 62 | 151 | 4.68 | 0.11 | 0.31 |
| 16(inv.) | H' | — | 98 | 2.13 | 0.14 | 0.42 |
| 17(inv.) | H' | A | 136 | 3.88 | 0.14 | 0.44 |
| 18(inv.) | H' | 62 | 148 | 4.68 | 0.11 | 0.33 |
| 19(inv.) | I' | — | 98 | 2.13 | 0.14 | 0.35 |
| 20(inv.) | I' | A | 135 | 3.88 | 0.14 | 0.33 |
| 21(inv.) | I' | 62 | 155 | 4.58 | 0.10 | 0.19 |
| 22(inv.) | J' | — | 101 | 1.98 | 0.15 | 0.36 |
| 23(inv.) | J' | 62 | 156 | 4.61 | 0.10 | 0.19 |

"inv." denotes sample of the present invention.

As is clear from the above, it became possible by the present invention to provide the thermally processed image forming material which is environmentally and economically beneficial, excellent in the coated surface quality and can produce an image which is low in fog and high in black density.

What is claimed is:

1. A thermally processed image forming material containing elsewhere on a support a reducing agent, a binder and non-photosensitive fatty acid silver salt grains characterized in that the non-photosensitive fatty acid silver salt grains are prepared by mixing and reacting a silver ion-containing solution, the solvent of which being water or a mixture of water and an organic solvent, with a solution of a fatty acid alkali metal salt, the solvent of which being water, an organic solvent, or a mixture of water and an organic solvent, in a closed mixing means.

2. The thermally processed image forming material as claimed in claim 1, wherein the non-photosensitive fatty acid silver salt grains are prepared by cooling a reaction mixture obtained after the reaction proceeded within the closed mixing means.

3. The thermally processed image forming material of claim 1 wherein the non-photosensitive fatty acid silver salt grains are prepared by micro-dispersing the reaction mixture at an operating pressure of 1,800 kg/cm$^2$ or above using a ultrahigh pressure dispersion apparatus, the nucleation aid being at least any one of a compound selected from the group consisting of a substituted alkene derivative expressed by the general formula (1) below, a substituted isooxazole derivative expressed by the general formula (2) below, and an acetal derivative expressed by the general formula (3) below:

(1)

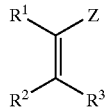

(where, $R^1$, $R^2$ and $R^3$ independently represent a hydrogen atom or substituent; Z represents an electron attracting group or silyl group; and, $R^1$ and Z, $R^2$ and $R^3$, $R^1$ and $R^2$, or $R^3$ and Z may individually bind with each other to form a cyclic structure), (2)

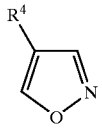

(where, $R^4$ represents a substituent), and (3)

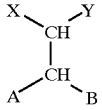

(where, X and Y independently represent a hydrogen atom or substituent; A and B independently represent alkoxy group, alkylthio group, alkylamino group, aryloxy group, arylthio group, anilino group, heterocyclic oxy group, heterocyclic thio group or heterocyclic amino group; and, X and Y, or A and B may individually bind with each other to form a cyclic structure).

4. The thermally processed image forming material as claimed in claim 3, wherein the micro-dispersion using the ultrahigh pressure dispersion apparatus is effected in a ultrahigh pressure jet flow.

5. The thermally processed image forming material as claimed in claim 1, wherein a photosensitive silver halide is additionally contained.

6. The thermally processed image forming material as claimed in claim 1, wherein the non-photosensitive fatty silver salt grains and the binder are contained in an image producing layer, and a polymer latex having a glass transition point of −30 to 40 comprises 50 wt % or more of the binder.

7. The thermally processed image forming material as claimed in claim 1, wherein at least a single species of nucleation aid is contained in at least one layer provided on the same side of the image producing layer on the support.

8. The thermally processed image forming material as claimed in claim 7, wherein the nucleation aid is at least any one of a compound selected from the group consisting of a substituted alkene derivative expressed by the general formula (1) below, a substituted isooxazole derivative expressed by the general formula (2) below, and an acetal derivative expressed by the general formula (3) below:

(1)

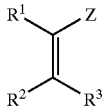

(where, $R^1$, $R^2$ and $R^3$ independently represent a hydrogen atom or substituent; Z represents an electron attracting group or silyl group; and, $R^1$ and Z, $R^2$ and $R^3$, $R^1$ and $R^2$, or $R^3$ and Z may individually bind with each other to form a cyclic structure), (2)

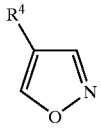

(where, $R^4$ represents a substituent), and (3)

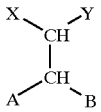

(where, X and Y independently represent a hydrogen atom or substituent; A and B independently represent alkoxy group, alkylthio group, alkylamino group, aryloxy group, arylthio group, anilino group, heterocyclic oxy group, heterocyclic thio group or heterocyclic amino group; and, X and Y, or A and B may individually bind with each other to form a cyclic structure).

9. A thermally processed image forming material containing elsewhere on a support a reducing agent, a binder and non-photosensitive fatty acid silver salt grains characterized in that the non-photosensitive fatty acid silver salt grains are prepared by (1) mixing and reacting a silver ion-containing solution, the solvent of which being water or a mixture of water and an organic solvent, with a solution of a fatty acid alkali metal salt, the solvent of which being water, an organic solvent, or a mixture of water and an organic solvent, in a closed mixing means, and then (2) micro-dispersing the reaction mixture at an operating pressure of 1,800 kg/cm$^2$ or above using a ultrahigh pressure dispersion apparatus.

* * * * *